US011188002B2

(12) United States Patent
Choda et al.

(10) Patent No.: US 11,188,002 B2
(45) Date of Patent: Nov. 30, 2021

(54) ELECTROPHOTOGRAPHIC PHOTORECEPTOR, ELECTROPHOTOGRAPHIC PHOTORECEPTOR CARTRIDGE AND IMAGE FORMING APPARATUS

(71) Applicant: Mitsubishi Chemical Corporation, Chiyoda-ku (JP)

(72) Inventors: Takahiro Choda, Tokyo (JP); Atsushi Yoshizawa, Tokyo (JP)

(73) Assignee: Mitsubishi Chemical Corporation, Chiyoda-ku (JP)

( * ) Notice: Subject to any disclaimer, the term of this patent is extended or adjusted under 35 U.S.C. 154(b) by 0 days.

(21) Appl. No.: 16/839,151

(22) Filed: Apr. 3, 2020

(65) Prior Publication Data

US 2020/0233322 A1 Jul. 23, 2020

Related U.S. Application Data

(63) Continuation of application No. PCT/JP2018/037110, filed on Oct. 3, 2018.

(30) Foreign Application Priority Data

Oct. 4, 2017 (JP) ..... JP2017-194629

(51) Int. Cl.
*G03G 5/00* (2006.01)
*G03G 5/047* (2006.01)
(Continued)

(52) U.S. Cl.
CPC ..... *G03G 5/047* (2013.01); *G03G 5/0539* (2013.01); *G03G 5/0564* (2013.01); *G03G 5/0672* (2013.01); *G03G 15/75* (2013.01)

(58) Field of Classification Search
CPC ..... G03G 5/047; G03G 5/0539; G03G 5/0564
(Continued)

(56) References Cited

U.S. PATENT DOCUMENTS 10,495,992 B2 * 12/2019 Yoshizawa ..... G03G 5/0546
2008/0199795 A1 8/2008 Ogaki et al.
(Continued)

FOREIGN PATENT DOCUMENTS

JP 02-160249 A 6/1990
JP 10-063026 A 3/1998
(Continued)

OTHER PUBLICATIONS

International Search Report dated Jan. 8, 2019 in PCT/JP2018/037110 filed Oct. 3, 2018 (with English Translation), 5 pages.

*Primary Examiner* — Mark A Chapman
(74) *Attorney, Agent, or Firm* — Oblon, McClelland, Maier & Neustadt, L.L.P.

(57) ABSTRACT

The present invention relates to an electrophotographic photoreceptor including a conductive support and a photosensitive layer on the conductive support, and the photosensitive layer contains a polymer A containing a repeating structural unit represented by a specific formula, and a polymer B containing a repeating structural unit represented by a specific formula. In addition, the present invention relates to an electrophotographic photoreceptor cartridge and an image forming apparatus including the electrophotographic photoreceptor.

12 Claims, 1 Drawing Sheet

(51) Int. Cl.
*G03G 5/05* (2006.01)
*G03G 5/06* (2006.01)
*G03G 15/00* (2006.01)

(58) Field of Classification Search
USPC ..... 430/96
See application file for complete search history.

(56) References Cited

U.S. PATENT DOCUMENTS

| | | | | |
|---|---|---|---|---|
| 2009/0130576 | A1 | 5/2009 | Ogaki et al. | |
| 2010/0248100 | A1 | 9/2010 | Ezumi | |
| 2010/0248105 | A1 | 9/2010 | Nukada et al. | |
| 2011/0053064 | A1 | 3/2011 | Kim et al. | |
| 2015/0056547 | A1 | 2/2015 | Murakami et al. | |
| 2016/0282735 | A1 | 9/2016 | Maeda et al. | |
| 2019/0033734 | A1* | 1/2019 | Yoshizawa ..... | G03G 5/0539 |

FOREIGN PATENT DOCUMENTS

| | | | |
|---|---|---|---|
| JP | 10-239886 | A | 9/1998 |
| JP | 2000-338699 | A | 12/2000 |
| JP | 2009-104145 | A | 5/2009 |
| JP | 2010-224503 | A | 10/2010 |
| JP | 2010-230970 | A | 10/2010 |
| JP | 2011-053689 | A | 3/2011 |
| JP | 4877348 | B2 | 2/2012 |
| JP | 2013-218305 | A | 10/2013 |
| JP | 5693106 | B2 | 4/2015 |
| JP | 2016-184059 | A | 10/2016 |
| JP | 6105974 | B2 | 3/2017 |
| JP | 6146432 | B2 | 6/2017 |

* cited by examiner

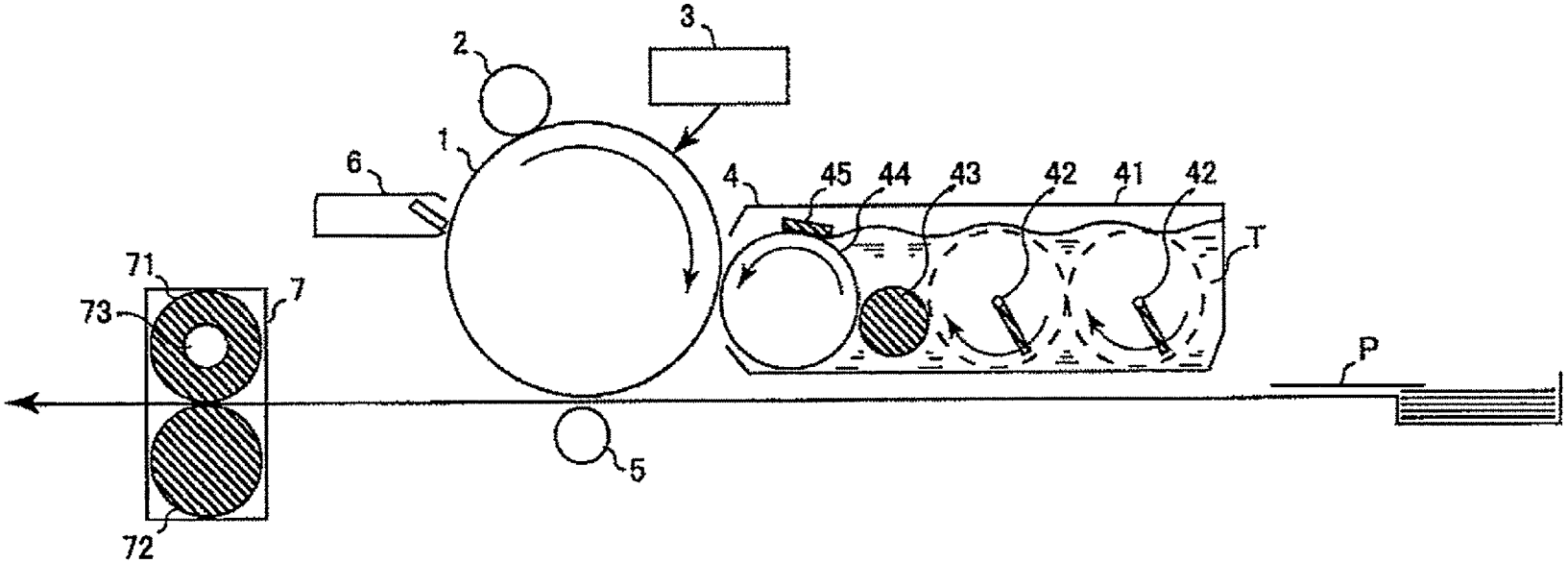
P
T
42
41
42
43
44
45
4
3
2
1
6
5
7
71
73
72

ELECTROPHOTOGRAPHIC PHOTORECEPTOR, ELECTROPHOTOGRAPHIC PHOTORECEPTOR CARTRIDGE AND IMAGE FORMING APPARATUS

TECHNICAL FIELD

The present invention relates to an electrophotographic photoreceptor, an electrophotographic photoreceptor cartridge and an image forming apparatus.

BACKGROUND ART

In recent years, the electrophotographic technology has been widely used and applied not only in the field of copying machines but also in the field of various printers since immediacy and high quality images can be obtained. Regarding electrophotographic photoreceptors which are the core of the electrophotographic technology, in recent years, electrophotographic photoreceptors using, as a photoconductive material thereof, an organic photoconductive material having advantages such as non-pollution, ease of film formation, and ease of production have been generally used. Among these, the mainstream is a lamination type electrophotographic photoreceptor including a charge generation layer and a charge transfer layer, in which a function of generating a charge by absorbing light and a function of transferring the generated charge are separated. Nowadays, these electrophotographic photoreceptors are widely used in the field of image forming apparatuses such as copying machines and laser printers.

However, an organic electrophotographic photoreceptor is inferior in abrasion resistance as compared with an inorganic electrophotographic photoreceptor. In order to improve the abrasion resistance, fluorine atom-containing resin particles may be dispersed in an outermost surface layer of the organic electrophotographic photoreceptor. However, it is known that the fluorine atom-containing resin particles are difficult to disperse, and a polymer having a specific structure is further added in order to improve dispersibility (see Patent Literatures 1 and 2).

CITATION LIST

Patent Literature

Patent Literature 1: JP-A-2009-104145
Patent Literature 2: JP-A-H10-239886

SUMMARY OF INVENTION

Technical Problem

In Patent Literatures 1 and 2, the dispersibility of the fluorine atom-containing resin particles in the outermost surface layer coating liquid is improved indeed, but the dispersibility of the fluorine atom-containing resin particles in the outermost surface layer of the electrophotographic photoreceptor is still insufficient.

The present invention has been made in view of the above circumstances in the related art, and an object thereof is to provide an electrophotographic photoreceptor in which dispersibility of a filler such as fluorine atom-containing resin particles in a coating liquid for forming an outermost surface layer is excellent and the dispersibility of the filler in the outermost surface layer is also excellent, for example, in a case of dispersing the filler in the outermost surface layer of the electrophotographic photoreceptor, and to provide an electrophotographic photoreceptor cartridge using the photoreceptor and an image forming apparatus using the photoreceptor.

Solution to Problem

The inventors of the present invention have intensively studied an electrophotographic photoreceptor capable of solving the above problems. As a result, it is found that by using two kinds of specific copolymers in combination, an electrophotographic photoreceptor is obtained in which the dispersibility of the filler such as fluorine atom-containing resin particles in the outermost surface layer of the electrophotographic photoreceptor is excellent, and the dispersibility of the filler in the coating liquid is also excellent. The present invention as follows has been completed.

Namely, the gist of the present invention lies in the following [1] to [12].

[1] An electrophotographic photoreceptor comprising: a conductive support; and a photosensitive layer on the conductive support, wherein the photosensitive layer contains at least a polymer A containing a repeating structural unit represented by the following Formula (1) and a repeating structural unit represented by the following Formula (2), and a polymer B not containing the repeating structural unit represented by the following Formula (1) but containing the repeating structural unit represented by the following Formula (2):

FORMULA (1)

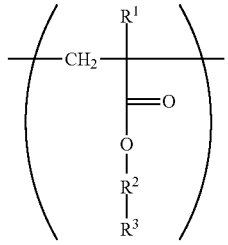

(in the Formula (1), $R^1$ represents a hydrogen atom or a methyl group; $R^2$ represents a single bond, a divalent hydrocarbon group which may have an ether moiety, or a divalent polyether group which may have a substituent; and $R^3$ represents a polycarbonate residue or a polyester residue);

FORMULA (2)

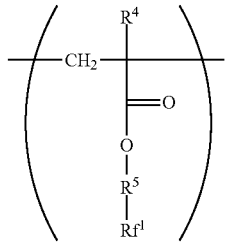

(in the Formula (2), $R^4$ represents a hydrogen atom or a methyl group; $R^5$ represents a single bond, or a divalent hydrocarbon group which may have an ether moiety; and $Rf^1$ represents a linear perfluoroalkyl group having 2 to 6 carbon atoms, a branched perfluoroalkyl group having 2 to 6 carbon atoms, an alicyclic perfluoroalkyl group having 2 to 6 carbon atoms, or a group represented by the following Formula (3)); and

FORMULA (3)

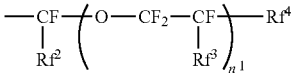

(in the Formula (3), $Rf^2$ and $Rf^3$ each independently represent a fluorine atom or a trifluoromethyl group; $Rf^4$ represents a linear perfluoroalkyl group having 1 to 6 carbon atoms or a branched perfluoroalkyl group having 1 to 6 carbon atoms, and $n^1$ represents an integer of 1 to 3).

[2] The electrophotographic photoreceptor according to item [1], wherein the polymer B contains a repeating structural unit represented by the following Formula (10):

FORMULA (10)

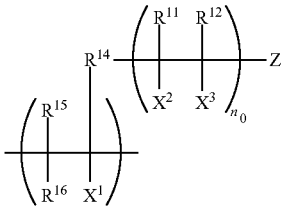

(in the Formula (10), $X^1$, $X^2$ and $X^3$ each independently represent a hydrogen atom, a hydrocarbon group which may have a substituent, or a group represented by the following Formula (11); $R^{11}$, $R^{12}$, $R^{15}$ and $R^{16}$ each independently represent a hydrogen atom, or a hydrocarbon group which may have a substituent; $R^{14}$ represents a hydrocarbon group which may have a substituent or a group represented by the following Formula (13); Z represents a hydrogen atom or a group derived from a radical polymerization initiator, and no represents an integer of 1 or more);

FORMULA (11)

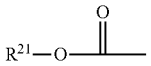

(in the Formula (11), $R^{21}$ represents a hydrogen atom, a hydrocarbon group which may have a substituent, or a heterocyclic group which may have a substituent); and

FORMULA (13)

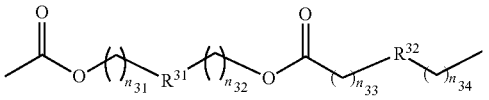

(in the Formula (13), $n_{31}$, $n_{32}$, $n_{33}$, and $n_{34}$ each independently represent 0 or an integer of 1 or more; $R^{31}$ represents an alkylene group, a halogen-substituted alkylene group, —($C_mH_{2m-1}$-(OH))— or a single bond; and $R^{32}$ represents an alkylene group, a halogen-substituted alkylene group, —S—, —O—, —NH— or a single bond, and m represents an integer of 1 or more).

[3] The electrophotographic photoreceptor according to item [1] or [2], wherein the polymer A contains a repeating structural unit represented by the above Formula (10).

[4] The electrophotographic photoreceptor according to any one of items [1] to [3], wherein a content ratio of the polymer A to the polymer B in the photosensitive layer is 4:1 to 1:4 in terms of mass ratio.

[5] The electrophotographic photoreceptor according to any one of items [1] to [4], wherein the photosensitive layer contains a filler.

[6] The electrophotographic photoreceptor according to item [5], wherein the filler contains fluorine atom-containing resin particles.

[7] The electrophotographic photoreceptor according to item [5] or [6], wherein a total content of the polymer A and the polymer B is 1 mass % or more and 20 mass % or less relative to a mass of the filler.

[8] The electrophotographic photoreceptor according to any one of items [1] to [7], wherein the photosensitive layer is an outermost surface layer.

[9] The electrophotographic photoreceptor according to any one of items [1] to [8], wherein the photosensitive layer is a lamination type photosensitive layer in which a charge generation layer and a charge transport layer are sequentially laminated from the conductive support side.

[10] The electrophotographic photoreceptor according to item [9], wherein the photosensitive layer contains a filler, and the polymer A, the polymer B, and the filler are all contained in the charge transport layer.

[11] An electrophotographic photoreceptor cartridge comprising the electrophotographic photoreceptor according to any one of items [1] to [10].

[12] An image forming apparatus comprising the electrophotographic photoreceptor according to any one of items [1] to [10].

Advantageous Effects of Invention

According to the present invention, an electrophotographic photoreceptor, in which the dispersibility of the filler such as fluorine atom-containing resin particles in the coating liquid for forming the outermost surface layer is excellent and the dispersibility of the filler in the outermost surface layer is also excellent, for example, in a case of dispersing the filler in the outermost surface layer of the electrophotographic photoreceptor, can be obtained and an electrophotographic photoreceptor cartridge using the photoreceptor and an image forming apparatus using the photoreceptor can be obtained.

BRIEF DESCRIPTION OF DRAWINGS

FIG. 1 is a schematic diagram showing a main configuration of an image forming apparatus according to an embodiment of the present invention.

DESCRIPTION OF EMBODIMENTS

Hereinafter, the present invention will be described in detail, but the description of the constituent features described below are representative examples of the embodiments of the present invention, and can be appropriately modified and implemented without departing from the spirit of the present invention.

<Electrophotographic Photoreceptor>

The electrophotographic photoreceptor of the present invention includes a photosensitive layer on a conductive support, with or without an undercoat layer.

[Conductive Support]

The conductive support is not particularly limited, and mainly used as the conductive support is, for example, a metallic material such as aluminum, an aluminum alloy, stainless steel, copper, or nickel, a resin material with added conductivity by adding a conductive powder such as a metal, carbon, or tin oxide powder, or a resin, glass, paper, or the like, having a surface on which a conductive material such as aluminum, nickel, or ITO (indium oxide/tin oxide) has been vapor deposited or coated. These conductive supports may be used alone, or may be used in any combination of two or more thereof and in optional ratio. As a form of the conductive support, a drum-like conductive support, a sheet-like conductive support, a belt-like conductive support, or the like can be used. Further, a conductive material having an appropriate resistance value may be applied to the conductive support made of a metal material, for the purpose of control of conductivity, surface properties and the like and coating of defects.

In a case where a metallic material such as an aluminum alloy is used as the conductive support, this material may be used after an anodized layer is applied thereto. In a case where the anodic oxide film is formed, it is desired that a sealing treatment is performed by a known method.

The surface of the conductive support may be smooth, or may be roughened by using a special cutting method or performing a roughening treatment. The surface of the conductive support may also be roughened by mixing particles having an appropriate particle diameter with the material constituting the conductive support. It is also possible to use a centerless polishing treatment or a drawn tube as it is without performing a cutting treatment.

[Photosensitive Layer]

In the present invention, the photosensitive layer is provided on the conductive support, with or without an undercoat layer. Examples of the types of the photosensitive layer include: a single-layer type in which a charge generation substance and a charge transport substance are present on the same layer, and are dispersed in a binder resin; and a function separation type (lamination type) including two layers of a charge generation layer in which the charge generation substance is dispersed in the binder resin and a charge transport layer in which the charge transport substance is dispersed in the binder resin. As the lamination type photosensitive layer, preferred is a lamination type photosensitive layer in which a charge generation layer and a charge transport layer are laminated in this order from the conductive support side. In the case of the lamination type photosensitive layer in which the charge generation layer and the charge transport layer are laminated in this order from the conductive support side, the charge transport layer may be a multilayer charge transport layer having two or more layers.

In a case where the photosensitive layer is a single-layer type, both the polymer A and the polymer B to be described later are contained in the photosensitive layer. In a case where the photosensitive layer is a lamination type, the polymer A and the polymer B may be contained in any of the charge generation layer and the charge transport layer if they are the outermost surface layers. It is preferable that the outermost surface layer is a charge transport layer, and both the polymer A and the polymer B are contained in the charge transport layer.

The photosensitive layer in the electrophotographic photoreceptor of the present invention contains a copolymer (hereinafter, referred to as polymer A) containing a repeating structural unit represented by the following Formula (1) and a repeating structural unit represented by the following Formula (2), and a polymer (hereinafter, referred to as polymer B) not containing the repeating structural unit represented by the following Formula (1) but containing the repeating structural unit represented by the following Formula (2).

<<Polymer A>>

The photosensitive layer in the electrophotographic photoreceptor of the present invention contains the polymer A containing the repeating structural unit represented by the following Formula (1) and the repeating structural unit represented by the following Formula (2). The polymer A may further contain another repeating structural unit such as a structure derived from a macromonomer or low-molecular monomer, or may be composed of only the repeating structural unit represented by the following Formula (1) and the repeating structural unit represented by the Formula (2).

In addition, the repeating structural unit represented by the Formula (1) and the repeating structural unit represented by the Formula (2) may be used in combination of two or more thereof. Examples of the another repeating structural unit that may be further contained other than the repeating structural unit represented by the Formula (1) and the repeating structural unit represented by the Formula (2) include a repeating structural unit represented by the following Formula (10).

The polymer A can contain the repeating structural unit represented by the Formula (1) and the repeating structural unit represented by the Formula (2) at an optional ratio. From the viewpoint of affinity with a filler, the content ratio (mass ratio) of the repeating structural unit represented by the Formula (1) to the repeating structural unit represented by the Formula (2) is generally 0.1 or more, preferably 0.2 or more, more preferably 0.3 or more, and particularly preferably 0.5 or more. On the other hand, from the viewpoint of affinity with a binder resin, the content ratio (mass ratio) is generally 5 or less, preferably 3 or less, more preferably 2 or less, and particularly preferably 1 or less.

FORMULA (1)

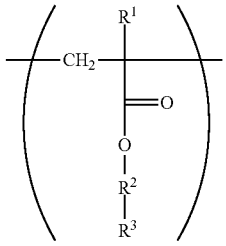

In the Formula (1), $R^1$ represents a hydrogen atom or a methyl group. $R^2$ represents a single bond, a divalent hydrocarbon group which may have an ether moiety, or a divalent polyether group which may have a substituent. $R^3$ represents a polycarbonate residue or a polyester residue.

From the viewpoint of reactivity during polymerization, $R^1$ is preferably a hydrogen atom.

Preferred examples of the divalent hydrocarbon group which may have an ether moiety in the above $R^2$ include a linear, branched, or alicyclic hydrocarbon group. Examples of the linear hydrocarbon group include an alkylene group having 1 to 6 carbon atoms, such as a methylene group and an ethylene group. Examples of the branched hydrocarbon group include an alkylene group having 3 to 10 carbon atoms, such as a methylethylene group, a methylpropylene group, and a dimethylpropylene group. Examples of the alicyclic hydrocarbon group include a cycloalkylene group having 5 to 15 carbon atoms, such as a cyclohexylene group and a 1,4-dimethylcyclohexylene group.

Among these, a linear alkylene group is preferred from the viewpoint of stability and reactivity of a (meth)acrylate which is the source of the repeating structural unit represented by the Formula (1), and an alkylene group having 1 to 3 carbon atoms is particularly preferred from the viewpoint of the simplicity in production.

Examples of the divalent hydrocarbon group which may have an ether moiety of $R^2$ include a structure represented by the following Formula (12).

FORMULA (12)

$$-(CH_2)_{n2}-O-$$

In the Formula (12), $n^2$ represents an integer of 1 to 6. $n^2$ is preferably an integer of 2 to 4 from the viewpoint of reactivity.

Examples of the divalent polyether group which may have a substituent of $R^2$ include a structure represented by the following Formula (9).

FORMULA (9)

$$-\left((CH_2)_{n3}-O\right)_{m1}-$$

In the Formula (9), $n^3$ represents an integer of 1 to 4, and $m^1$ represents an integer of 1 to 20. Specific examples of the Formula (9) include a diethylene glycol residue, triethylene glycol residue, a tetraethylene glycol residue, a polyethylene glycol residue, a dipropylene glycol residue, a tripropylene glycol residue, a tetrapropylene glycol residue, a polypropylene glycol residue, a ditetramethylene glycol residue, a tritetramethylene glycol residue, a tetratetramethylene glycol residue, and a polytetramethylene glycol residue.

Among these, from the viewpoint of electrical characteristics of the obtained electrophotographic photoreceptor, the divalent polyether group which may have a substituent of $R^2$ is preferably a polypropylene glycol residue or a polytetramethylene glycol residue.

The polycarbonate residue in $R^3$ preferably contains a repeating structural unit represented by the following Formula (5).

FORMULA (5)

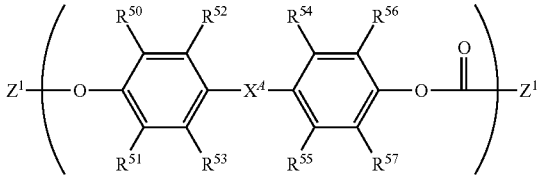

In the Formula (5), $R^{50}$ to $R^{57}$ each independently represent a hydrogen atom, an alkyl group having 1 to 20 carbon atoms and which may have a substituent, an alkoxy group, an aromatic group which may be substituted, or a halogen group. $X^A$ represents a single bond, $—CR^{115}R^{116}—$, —O—, —CO— or —S—. $R^{115}$ and $R^{116}$ each independently represent a hydrogen atom, an alkyl group having 1 to 10 carbon atoms, or an aromatic group having 6 to 12 carbon atoms, or $R^{115}$ and $R^{116}$ are bonded to form a cycloalkylidene group having 5 to 10 carbon atoms and which may have a substituent. Two $Z^1$ each independently represent a binding site with $R^2$ or a residue derived from a terminator.

Specific examples of the alkyl group having 1 to 20 carbon atoms and which may have a substituent of $R^{50}$ to $R^{57}$ include a methyl group, an ethyl group, a propyl group, an isopropyl group, a butyl group, a tert-butyl group, and a cyclohexyl group.

The alkoxy group is preferably an alkoxy group having 1 to 6 carbon atoms. Among the alkoxy group having 1 to 6 carbon atoms, a methoxy group, an ethoxy group, a propoxy group, or a cyclohexoxy group is more preferred.

The aromatic group which may be substituted is preferably an aromatic group having 6 to 8 carbon atoms. Among the aromatic group having 6 to 8 carbon atoms, a phenyl group, a methylphenyl group, a dimethylphenyl group, or a halogenated phenyl group is more preferred.

Examples of the halogen group include a fluorine atom, a chlorine atom and a bromine atom.

From the viewpoints of simplicity in production and abrasion resistance of the obtained electrophotographic photoreceptor, preferred is an alkyl group having 1 to 20 carbon atoms or an alkoxy group having 1 to 6 carbon atoms, and particularly preferred is a methyl group.

$X^A$ is preferably a single bond or $—CR^{115}R^{116}—$ from the viewpoint of reactivity during radical polymerization, and is preferably $—CR^{115}R^{116}—$ from the viewpoint of solubility.

Specific examples of the alkyl group having 1 to 10 carbon atoms of $R^{115}$ and $R^{116}$ include a methyl group, an ethyl group, a propyl group, an isopropyl group, a butyl group, and an iso-butyl group. From the viewpoints of solubility, simplicity in production, and abrasion resistance of the obtained electrophotographic photoreceptor, preferred are a methyl group and an ethyl group.

Specific examples of the aromatic group having 6 to 12 carbon atoms include a phenyl group, a methylphenyl group, and a naphthyl group. From the viewpoint of solubility, a phenyl group is preferred.

Examples of the cycloalkylidene group having 5 to 10 carbon atoms, which may have a substituent and formed by bonding $R^{115}$ and $R^{116}$, include a cyclopentylidene group, a cyclohexylidene group, and a cycloheptylidene group.

Examples of the substituent which the cycloalkylidene group may have include a methyl group and an ethyl group.

Specific examples of dihydric phenol which is the source of the dihydric phenol residue of the repeating structural unit represented by the Formula (5) include: bis-(4-hydroxyphenyl)methane, bis-(4-hydroxy-3-methylphenyl)methane, bis-(3,5-dimethyl-4-hydroxyphenyl)methane, 1,1-bis-(4-hydroxyphenyl)ethane, 1,1-bis-(4-hydroxy-3-methylphenyl)ethane, 1,1-bis-(3,5-dimethyl-4-hydroxyphenyl)ethane, 1,1-bis-(4-hydroxyphenyl)propane, 1,1-bis-(4-hydroxy-3-methylphenyl)propane, 1,1-bis-(3,5-dimethyl-4-hydroxyphenyl)propane, 2,2-bis-(4-hydroxyphenyl)propane, 2,2-bis-(4-hydroxy-3-methylphenyl)propane, 2,2-bis-(3,5-dimethyl-4-hydroxyphenyl)propane, 1,1-bis-(4-hydroxyphenyl)cyclohexane, 1,1-bis-(4-hydroxy-3-methylphenyl)cyclohexane, 1,1-bis-(3,5-dimethyl-4-hydroxyphenyl)cyclohexane, bis-(4-hydroxyphenyl)phenylmethane, 1,1-bis-(4-hydroxyphenyl)-1-phenylethane, 4,4'-biphenol, 3,3'-dimethyl-4,4'-biphenol, 3,3',5,5'-tetramethyl-4,4'-biphenol, 4,4'-dihydroxydiphenyl ether, 3,3'-dimethyl-4,4'-dihydroxydiphenyl ether, bis(4-hydroxyphenyl) sulfide, and 4,4'-dihydroxybenzophenone.

Among these, considering the simplicity in production and solubility of the dihydric phenol component, preferred are bis-(4-hydroxyphenyl)methane, bis-(4-hydroxy-3-methylphenyl)methane, bis-(3,5-dimethyl-4-hydroxyphenyl) methane, 1,1-bis-(4-hydroxyphenyl)ethane, 1,1-bis-(4-hydroxy-3-methylphenyl)ethane, 2,2-bis-(4-hydroxyphenyl) propane, 2,2-bis-(4-hydroxy-3-methylphenyl)propane, 2,2-bis-(3,5-dimethyl-4-hydroxyphenyl)propane, 1,1-bis-(4-hydroxyphenyl)cyclohexane, 1,1-bis-(4-hydroxyphenyl)-1-phenylethane, 4,4'-biphenol, 3,3'-dimethyl-4,4'-biphenol, 3,3',5,5'-tetramethyl-4,4'-biphenol, and 4,4'-dihydroxydiphenyl ether.

From the viewpoint of affinity with an organic solvent, bis-(4-hydroxyphenyl)methane, bis-(4-hydroxy-3-methylphenyl)methane, 1,1-bis-(4-hydroxyphenyl)ethane, 1,1-bis-(4-hydroxy-3-methylphenyl)ethane, 2,2-bis-(4-hydroxy-3-methylphenyl)propane, 4,4'-biphenol, 1,1-bis-(4-hydroxyphenyl)cyclohexane, and 1,1-bis-(4-hydroxyphenyl)-1-phenylethane are more preferred.

The content of the repeating structural unit represented by the Formula (5) is preferably 80 mol % or more in terms of monomer, and is, from the viewpoint of compatibility with other resins when forming a soluble coating film, more preferably 90 mol % or more, relative to the entire polycarbonate residue.

The amount of a chloroformate group present at the terminal of the polycarbonate residue in the above $R^3$ is generally 0.1 μeq/g or less, and preferably 0.05 μeq/g or less. When the amount of the terminal chloroformate group exceeds the above range, the storage stability of the coating liquid tends to decrease.

The amount of an OH group present at the terminal of the polycarbonate residue in the above $R^3$ is generally 50 μeq/g or less, and preferably 20 μeq/g or less. When the amount of the terminal OH group exceeds the above range, the reactivity in the radical polymerization may be reduced or the electrical characteristics may be deteriorated.

The polyester residue in the above $R^3$ preferably contains a repeating structural unit represented by the following Formula (6).

FORMULA (6)

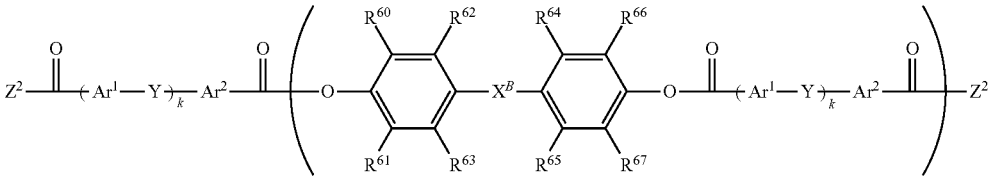

In the Formula (6), $R^{60}$ to $R^{67}$ each independently represent a hydrogen atom, an alkyl group having 1 to 20 carbon atoms and which may have a substituent, an alkoxy group, an aromatic group which may be substituted, or a halogen group. $X^B$ represents a single bond, —$CR^{25}R^{26}$—, —O—, —CO— or —S—. $R^{25}$ and $R^{26}$ each independently represent a hydrogen atom, an alkyl group having 1 to 10 carbon atoms, or an aromatic group having 6 to 12 carbon atoms, or $R^{25}$ and $R^{26}$ are bonded to form a cycloalkylidene group having 5 to 10 carbon atoms and which may have a substituent. $Ar^1$ and $Ar^2$ each independently represent an arylene group which may have a substituent or a cyclohexylene group. Y represents a single bond, —O— or —S—. k represents 0 or 1. Two $Z^2$ each independently represent a binding site with $R^2$ in the above Formula (1), a residue derived from a terminator or a hydroxy group.

Specific examples of $R^{60}$ to $R^{67}$ include those same as that of the above $R^{50}$ to $R^{57}$, and preferred ones are also the same. Specific examples of $R^B$ include those same as that of the above $R^A$, and preferred ones are also the same. $R^{25}$ and $R^{26}$ are the same as $R^{115}$ and $R^{116}$, and preferred ones are also the same. Specific examples of the dihydric phenol which is the source of the dihydric phenol residue in the Formula (6) include those same as that of the dihydric phenol which is the source of the dihydric phenol residue in the above Formula (5), and preferred ones are also the same.

In the Formula (6), $Ar^1$ and $Ar^2$ are preferably an arylene group having 6 to 20 carbon atoms or a cyclohexylene group having 6 to 20 carbon atoms, and examples thereof include a phenylene group, a naphthylene group, an anthrylene group, a phenanthrylene group, a pyrenylene group, and a cyclohexylene group. Among these, a phenylene group, a naphthylene group, a biphenylene group, and a cyclohexylene group are more preferred in terms of production cost. From the viewpoint of the simplicity in production, $Ar^1$ and $Ar^2$ are preferably the same arylene group having the same substituent.

Examples of the substituent which the arylene group may independently have include an alkyl group, an alkoxy group, an aryl group, a condensed polycyclic group, and a halogen group. Considering the solubility in an organic solvent, as the alkyl group, an alkyl group having 1 to 10 carbon atoms is preferred, an alkyl group having 1 to 8 carbon atoms is more preferred, and an alkyl group having 1 to 2 carbon atoms is particularly preferred, and specifically, a methyl group is particularly preferred; as the alkoxy group, a methoxy group, an ethoxy group, and a butoxy group are preferred; as the aryl group, a phenyl group and a naphthyl group are preferred; and as the halogen group, a fluorine atom, a chlorine atom, a bromine atom, and an iodine atom are preferred. The number of the substituent of each of $Ar^1$ and $Ar^2$ is not particularly limited, and is preferably 3 or less, more preferably 2 or less, and particularly preferably 1 or less.

In the Formula (6), Y is a single bond, —O— or —S—, and is preferably —O— from the viewpoint of the solubility in an organic solvent.

In the Formula (6), k is 0 or 1.

In a case where k is 0, specific examples of a divalent carboxylic acid compound for deriving the repeating structural unit represented by the Formula (6) include terephthalic acid and isophthalic acid. In a case where k is 1, specific examples of the divalent carboxylic acid compound for deriving the repeating structural unit represented by the Formula (6) include diphenyl ether-2,2'-dicarboxylic acid, diphenyl ether-2,4'-dicarboxylic acid, and diphenyl ether-4, 4'-dicarboxylic acid. Among these, considering simplicity in production, diphenyl ether-4,4'-dicarboxylic acid is particularly preferred.

The compounds exemplified as the divalent carboxylic acid compound for deriving the repeating structural unit represented by the Formula (6) can be used in combination of a plurality of compounds as necessary. Specific examples of the divalent carboxylic acid compounds which may be combined include adipic acid, suberic acid, sebacic acid, phthalic acid, isophthalic acid, terephthalic acid, toluene-2,5-dicarboxylic acid, p-xylene-2,5-dicarboxylic acid, pyridine-2,3-dicarboxylic acid, pyridine-2,4-dicarboxylic acid, pyridine-2,5-dicarboxylic acid, pyridine-2,6-dicarboxylic acid, pyridine-3,4-dicarboxylic acid, pyridine-3,5-dicarboxylic acid, naphthalene-1,4-dicarboxylic acid, naphthalene-2,3-dicarboxylic acid, naphthalene-2,6-dicarboxylic acid, biphenyl-2,2'-dicarboxylic acid, biphenyl-4,4'-dicarboxylic acid, diphenyl ether-2,2'-dicarboxylic acid, diphenyl ether-2,3'-dicarboxylic acid, diphenyl ether-2,4'-dicarboxylic acid, diphenyl ether-3,3'-dicarboxylic acid, diphenyl ether-3,4'-dicarboxylic acid, and diphenyl ether-4,4'-dicarboxylic acid. Considering the simplicity in production of the dicarboxylic acid component, isophthalic acid, terephthalic acid, and diphenyl ether-4,4'-dicarboxylic acid are particularly preferred.

The amount of a carboxylic acid chloride group present at the terminal of the polyester residue in the above $R^3$ is generally 0.1 eq/g or less, and preferably 0.05 μeq/g or less. The carboxylic acid value of the polyester residue in the above $R^3$ is preferably 300 μeq/g or less, and more preferably 150 μeq/g or less. The amount of an OH group present at the terminal of the polyester residue in the above $R^3$ is generally 100 μeq/g or less, and preferably 50 μeq/g or less.

The total nitrogen amount (T-N amount) contained in the polycarbonate residue or the polyester residue in the above $R^3$ is preferably 500 ppm or less, more preferably 300 ppm or less, and particularly preferably 100 ppm or less.

The weight average molecular weight (Mw) of the polycarbonate residue or the polyester residue in the above $R^3$ is generally 5,000 or more, and from the viewpoint of solubility of the polymer A, is preferably 8,000 or more, more preferably 10,000 or more. In addition, the weight average molecular weight (Mw) is generally 100,000 or less, and from the viewpoint of the dispersibility of the filler, is preferably 50,000 or less.

In the polymer A, the content of at least one of the polycarbonate residue and the polyester residue in $R^3$ is preferably 10 mass % or more, and from the viewpoint of solubility in a solvent, is preferably 30 mass % or more, more preferably 50 mass % or more. On the other hand, the content is preferably 80 mass % or less, and from the viewpoint of the dispersibility of the filler, is more preferably 70 mass % or less.

In addition, the polymer A containing the repeating structural unit represented by the Formula (1) also contains the repeating structural unit represented by the following Formula (2).

FORMULA (2)

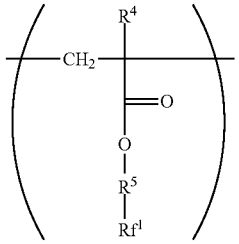

In the Formula (2), $R^4$ represents a hydrogen atom or a methyl group. $R^5$ represents a single bond, or a divalent hydrocarbon group which may have an ether moiety. $Rf^1$ represents a linear perfluoroalkyl group having 2 to 6 carbon atoms, a branched perfluoroalkyl group having 2 to 6 carbon atoms, an alicyclic perfluoroalkyl group having 2 to 6 carbon atoms, or a group represented by the following Formula (3).

FORMULA (3)

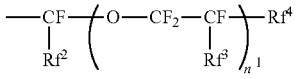

In the Formula (3), $Rf^2$ and $Rf^3$ each independently represent a fluorine atom or a trifluoromethyl group. $Rf^4$ represents a linear perfluoroalkyl group having 1 to 6 carbon atoms or a branched perfluoroalkyl group having 1 to 6 carbon atoms. $n^1$ represents an integer of 1 to 3.

From the viewpoint of reactivity during polymerization, $R^4$ is preferably a hydrogen atom.

Specific examples of the divalent hydrocarbon group which may have an ether moiety of the above $R^5$ include groups same as that of the divalent hydrocarbon group which may have an ether moiety of the above $R^2$. $R^5$ is preferably a divalent hydrocarbon group which may have an ether moiety, and more preferably a divalent hydrocarbon group.

Specific examples of the linear perfluoroalkyl group having 2 to 6 carbon atoms of $Rf^1$ include a perfluoroethyl group, a perfluoropropyl group, a perfluorobutyl group, a perfluoropentyl group, and a perfluorohexyl group. Specific examples of the branched perfluoroalkyl group having 2 to 6 carbon atoms include a perfluoroiso-propyl group, a perfluoroiso-butyl group, a perfluorotert-butyl group, perfluorosec-butyl group, a perfluoroiso-pentyl group, and a perfluoroiso-hexyl group. Examples of the alicyclic perfluoroalkyl group having 2 to 6 carbon atoms include a perfluorocyclopentyl group and a perfluorocyclohexyl group. Among these, from the viewpoint of the filler, particularly the dispersibility of the filler, preferred are a perfluorobutyl group, a perfluoropentyl group, and a perfluorohexyl group.

$Rf^2$ and $Rf^3$ are preferably trifluoromethyl groups from the viewpoint of simplicity in synthesis.

Specific examples of the linear perfluoroalkyl group having 1 to 6 carbon atoms of $Rf^4$ include a perfluoromethyl group, a perfluoroethyl group, a perfluoropropyl group, a perfluorobutyl group, a perfluoropentyl group, and a perfluorohexyl group. Specific examples of the branched perfluoroalkyl group having 1 to 6 carbon atoms include a perfluoroiso-propyl group, a perfluoroiso-butyl group, a perfluorotert-butyl group, perfluorosec-butyl group, a perfluoroiso-pentyl group, and a perfluoroiso-hexyl group.

Among these, from the viewpoint of the filler, particularly the dispersibility of the filler, preferred are a perfluoromethyl group, a perfluoroethyl group, a perfluoropropyl group, and a perfluorobutyl group.

$n^1$ is preferably 1 or 2 from the viewpoint of solubility in a solvent during polymer synthesis.

The (meth)acrylate monomer which is the source of the repeating structural unit represented by the Formula (2) is represented by the following Formula (8).

FORMULA (8)

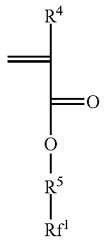

In the Formula (8), $R^4$, $R^5$ and $Rf^1$ are the same as defined above.

Specific examples of the (meth)acrylate monomer represented by the Formula (8) include perfluoroethyl (meth) acrylate, perfluoropropyl (meth)acrylate, perfluorobutyl (meth)acrylate, perfluoropentyl (meth)acrylate, prfluorohexyl (meth)acrylate, prfluoroiso-propyl (meth)acrylate, perfluoroiso-butyl (meth)acrylate, perfluorotert-butyl (meth) acrylate, perfluorosec-butyl (meth)acrylate, perfluoroiso-pentyl (meth)acrylate, perfluoroiso-hexyl (meth)acrylate, prfluorocyclopentyl (meth)acrylate, pfluorocyclohexyl (meth)acrylate, perfluoroethylmethyl (meth)acrylate, perfluoropropylmethyl (meth)acrylate, perfluorobutylmethyl (meth)acrylate, perfluoropentylmethyl (meth)acrylate, perfluorohexylmethyl (meth)acrylate, perfluoroiso-propylmethyl (meth)acrylate, perfluoroiso-butylmethyl (meth)acrylate, perfluorotert-butylmethyl (meth)acrylate, perfluorosec-butylmethyl (meth)acrylate, perfluoroiso-pentylmethyl (meth)acrylate, perfluoroiso-hexylmethyl (meth)acrylate, perfluorocyclopentylmethyl (meth)acrylate, perfluorocyclohexylmethyl (meth)acrylate, 2-(perfluoroethyl)ethyl (meth) acrylate, 2-(perfluoropropyl)ethyl (meth)acrylate, 2-(perfluorobutyl)ethyl (meth)acrylate, 2-(perfluoropentyl)ethyl (meth)acrylate, 2-(perfluorohexyl)ethyl (meth)acrylate, 2-(perfluoroiso-propyl)ethyl (meth)acrylate, 2-(perfluoroiso-butyl)ethyl (meth)acrylate, 2-(perfluorotert-butyl)ethyl (meth)acrylate, 2-(perfluorosec-butyl)ethyl (meth)acrylate, 2-(perfluoroiso-pentyl)ethyl (meth)acrylate, 2-(perfluoroiso-hexyl)ethyl (meth)acrylate, 2-(perfluorocyclopentyl) ethyl (meth)acrylate, 2-(perfluorocyclohexyl)ethyl (meth) acrylate, 3-(perfluoroethyl)propyl (meth)acrylate, 3-(perfluoropropyl)propyl (meth)acrylate, 3-(perfluorobutyl)propyl (meth)acrylate, 3-(perfluoropentyl)propyl (meth)acrylate, 3-(perfluorohexyl)propyl (meth)acrylate, 3-(perfluoroiso-propyl)propyl (meth)acrylate, 3-(perfluoroiso-butyl)propyl (meth)acrylate, 3-(perfluorotert-butyl) propyl (meth)acrylate, 3-(perfluorosec-butyl)propyl (meth) acrylate, 3-(perfluoroiso-pentyl)propyl (meth)acrylate, 3-(perfluoroiso-hexyl)propyl (meth)acrylate, 3-(perfluorocyclopentyl)propyl (meth)acrylate, 3-(perfluorocyclohexyl) propyl (meth)acrylate, 4-(perfluoroethyl)butyl (meth)acrylate, 4-(perfluoropropyl)butyl (meth)acrylate, 4-(perfluorobutyl)butyl (meth)acrylate, 4-(perfluoropentyl) butyl (meth)acrylate, 4-(perfluorohexyl)butyl (meth)acrylate, 4-(perfluoroiso-propyl)butyl (meth)acrylate, 4-(perfluoroiso-butyl)butyl (meth)acrylate, 4-(perfluorotert-butyl) butyl (meth)acrylate, 4-(perfluorosec-butyl)butyl (meth) acrylate, 4-(perfluoroiso-pentyl)butyl (meth)acrylate, 4-(perfluoroiso-hexyl)butyl (meth)acrylate, 4-(perfluorocyclopentyl)butyl (meth)acrylate, 4-(perfluorocyclohexyl) butyl (meth)acrylate, and (meth)acrylates shown below. The structural formulas of these (meth)acrylate monomers are as shown below.

In this description, (meth)acrylate is a general term for acrylate and methacrylate. The same applies to (meth) acrylic acid and (meth)acrylamide.

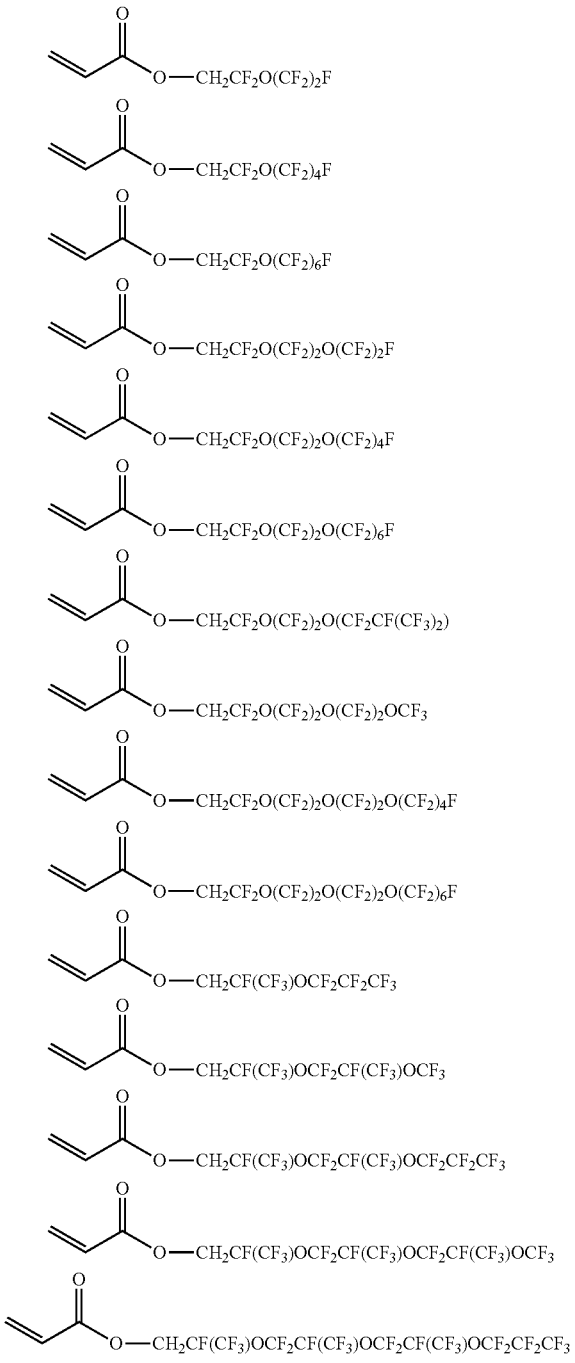

-continued

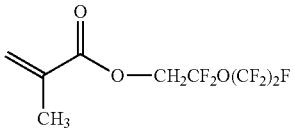

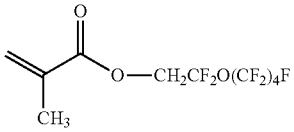

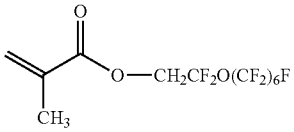

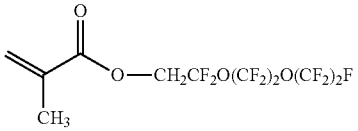

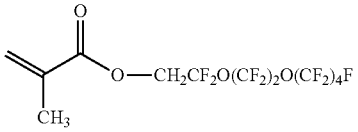

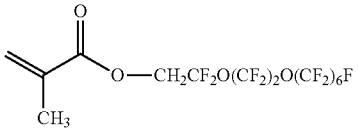

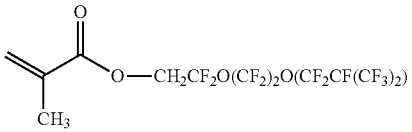

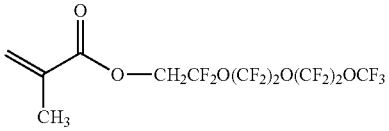

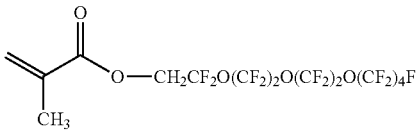

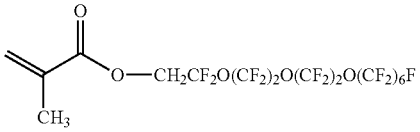

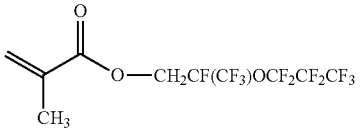

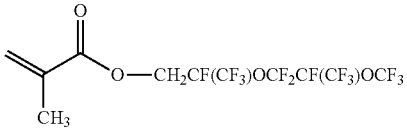

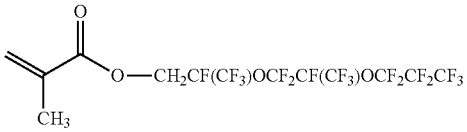

-continued

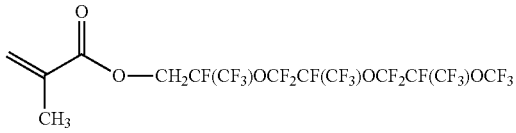

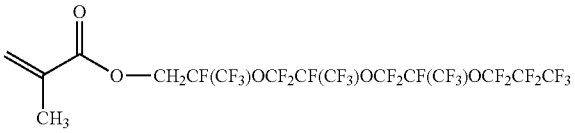

Among theses, from the viewpoint of stability of the (meth)acrylate and simplicity in production, preferred are perfluoroethylmethyl (meth)acrylate, perfluoropropylmethyl (meth)acrylate, perfluorobutylmethyl (meth)acrylate, perfluoropentylmethyl (meth)acrylate, perfluorohexylmethyl (meth)acrylate, 2-(perfluoroethyl)ethyl (meth)acrylate, 2-(perfluoropropyl)ethyl (meth)acrylate, 2-(perfluorobutyl) ethyl (meth)acrylate, 2-(perfluoropentyl)ethyl (meth)acrylate, 2-(perfluorohexyl)ethyl (meth)acrylate, 3-(perfluoroethyl)propyl (meth)acrylate, 3-(perfluoropropyl)propyl (meth)acrylate, 3-(perfluorobutyl)propyl (meth)acrylate, 3-(perfluoropentyl)propyl (meth)acrylate, and 3-(perfluorohexyl)propyl (meth)acrylate.

Further, from the viewpoint of the dispersibility of the filler, particularly preferred are perfluorobutylmethyl (meth) acrylate, perfluoropentylmethyl (meth)acrylate, perfluorohexylmethyl (meth)acrylate, 2-(perfluorobutyl)ethyl (meth) acrylate, 2-(perfluoropentyl)ethyl (meth)acrylate, 2-(perfluorohexyl)ethyl (meth)acrylate, 3-(perfluorobutyl) propyl (meth)acrylate, 3-(perfluoropentyl)propyl (meth) acrylate, and 3-(perfluorohexyl)propyl (meth)acrylate.

The compound represented by the above Formula (8) may be used in combination of two or more thereof, as necessary.

The content of the repeating structural unit represented by the Formula (1) in the polymer A is preferably 20 mass % or more from the viewpoint of the dispersibility of the filler, and is more preferably 30 mass % or more from the viewpoint of storage stability of a dispersion liquid. On the other hand, the content is preferably 70 mass % or less from the viewpoint of solubility in an organic solvent, and is more preferably 60 mass % or less from the viewpoint of the dispersibility of the filler.

The weight average molecular weight of the polymer A is preferably 5,000 or more, and more preferably 10,000 or more, from the viewpoint of the dispersibility of the filler. On the other hand, the weight average molecular weight is preferably 100,000 or less from the viewpoint of compatibility with other resins in forming a coating film, and is more preferably 80,000 or less, and still more preferably 50,000 or less from the viewpoint of the dispersibility of the filler. The weight average molecular weight in the description refers to a weight average molecular weight obtained by gel permeation chromatography (GPC) using polystyrene as a standard substance.

The polymer A may further contain another repeating structural unit, and preferably contains a repeating structural unit represented by the following Formula (10). By containing the repeating structural unit represented by the Formula (10), gelation during polymer production can be prevented, which is preferred. In addition, steric hindrance mainly due to the portion from $R^{14}$ to Z is effective for preventing aggregation of the filler, which is preferred. The repeating structural unit represented by the Formula (10) may be used in combination of two or more thereof.

In a case where the polymer A contains the repeating structural unit represented by the Formula (10), from the viewpoint of preventing gelation during the polymer production, the content ratio (mass ratio) of the repeating structural unit represented by the Formula (10) to the total amount of the repeating structural unit represented by the Formula (1) and the repeating structural unit represented by the Formula (2) is generally 0.001 or more, preferably 0.01 or more, more preferably 0.02 or more, and particularly preferably 0.03 or more. On the other hand, from the viewpoint of the dispersibility of the filler, the content ratio (mass ratio) is generally 1 or less, preferably 0.5 or less, more preferably 0.3 or less, and particularly preferably 0.1 or less.

FORMULA (10)

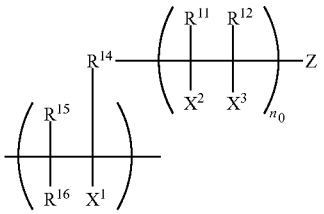

In the Formula (10), $X^1$, $X^2$ and $X^3$ each independently represent a hydrogen atom, a hydrocarbon group which may have a substituent, or a group represented by the following Formula (11). $R^{11}$, $R^{12}$, $R^{15}$ and $R^{16}$ each independently represent a hydrogen atom, or a hydrocarbon group which may have a substituent. $R^{14}$ represents a hydrocarbon group which may have a substituent or a group represented by the following Formula (13). Z represents a hydrogen atom or a group derived from a radical polymerization initiator. no represents an integer of 1 or more.

FORMULA (11)

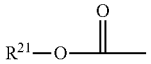

In the Formula (11), $R^{21}$ represents a hydrogen atom, a hydrocarbon group which may have a substituent, or a heterocyclic group which may have a substituent.

FORMULA (13)

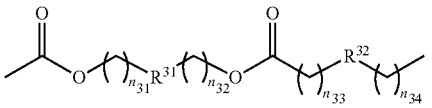

In the Formula (13), $n_{31}$, $n_{32}$, $n_{33}$, and $n_{34}$ each independently represent 0 or an integer of 1 or more. $R^{31}$ represents an alkylene group, a halogen-substituted alkylene group, —($C_mH_{2m-1}$(OH))— or a single bond. $R^{32}$ represents an alkylene group, a halogen-substituted alkylene group, —S—, —O—, —NH— or a single bond. m represents an integer of 1 or more.

The hydrocarbon group in each of $X^1$, $X^2$, $X^3$, $R^{11}$, $R^{12}$, $R^{15}$ and $R^{16}$ in the Formula (10) and $R^{21}$ in the Formula (11) is selected from an aliphatic hydrocarbon group and an aromatic hydrocarbon group.

Examples of the aliphatic hydrocarbon group include linear, branched and cyclic aliphatic hydrocarbon groups, preferably linear and cyclic aliphatic hydrocarbon groups, and more preferably a linear aliphatic hydrocarbon group. A linear or cyclic aliphatic hydrocarbon group has a higher affinity for the solvent and a better dispersion stability of the filler.

Examples of the aliphatic hydrocarbon group include an alkyl group, an alkenyl group, and an alkynyl group. In a case where the aliphatic hydrocarbon group is an alkyl group, the number of carbon atoms is generally 1 or more. In a case where the aliphatic hydrocarbon group is an alkenyl group or an alkynyl group, the number of carbon atoms is generally 2 or more. On the other hand, the number of carbon atoms of the aliphatic hydrocarbon group is preferably 20 or less, more preferably 10 or less, and particularly preferably 6 or less. When the number of carbon atoms is within the above range, high solvent affinity can be obtained.

Examples of the aromatic hydrocarbon group include an aryl group and an aralkyl group. The number of carbon atoms of the aromatic hydrocarbon group is preferably 6 or more, and on the other hand, is preferably 20 or less, and more preferably 12 or less. When the number of carbon atoms is within the above range, solubility and electrical characteristics are excellent.

Specific examples of the alkyl group include an alkyl group having 1 to 5 carbon atoms such as a methyl group, an ethyl group, a n-propyl group, an iso-propyl group, a n-butyl group, a sec-butyl group, an iso-butyl group, a tert-butyl group, a n-pentyl group, an isopentyl group, a sec-pentyl group, a neopentyl group, a 1-methylbutyl group, a 2-methylbutyl group, a 1,1-dimethylpropyl group, and a 1,2-dimethylpropyl group.

Specific examples of the alkenyl group include an alkenyl group having 2 to 5 carbon atoms such as a vinyl group, a 1-propenyl group, a 2-propenyl group, an isopropenyl group, a 1-butenyl group, a 2-butenyl group, a 3-butenyl group, a 1-pentenyl group, a 2-pentenyl group, a 3-pentenyl group, and a 4-pentenyl group.

Specific examples of the alkynyl group include an alkynyl group having 2 to 5 carbon atoms, such as an ethynyl group, a 1-propynyl group, a 2-propynyl group, a 1-butynyl group, a 2-butynyl group, a 3-butynyl group, a 1-pentynyl group, a 2-pentynyl group, a 3-pentynyl group, and a 4-pentynyl group.

Specific examples of the aryl group include a phenyl group, a tolyl group, an xylyl group, an ethylphenyl group, a n-propylphenyl group, an iso-propylphenyl group, a n-butylphenyl group, a sec-butylphenyl group, an iso-butylphenyl group, a tert-butylphenyl group, a naphthyl group, an anthracene group, a biphenyl group, and a pyrene group.

Specific examples of the aralkyl group include an aralkyl group having 7 to 12 carbon atoms, such as a benzyl group, an α-methylbenzyl group, a 1-methyl-1-phenylethyl group, a phenethyl group, a 2-phenylpropyl group, a 2-methyl-2-phenylpropyl group, a 3-phenylpropyl group, a 3-phenylbutyl group, a 3-methyl-3-phenylbutyl group, a 4-phenylbutyl group, a 5-phenylpentyl group, and a 6-phenylhexyl group.

From the viewpoint of the dispersibility of the filler, more preferred as the alkyl group are alkyl groups such as a methyl group, an ethyl group, a n-propyl group, and a n-butyl group; more preferred as the alkenyl group are alkenyl groups such as a vinyl group and a 1-propenyl group; and more preferred as the alkynyl group are alkynyl groups such as an ethynyl group and a 1-propynyl group.

In addition, from the viewpoint of the dispersibility of the filler, more preferred as the aryl group are aryl groups such as a phenyl group, a tolyl group, an xylyl group, a naphthyl group, a biphenyl group, and a tert-butylphenyl group; and more preferred as the aralkyl group are alkyl groups such as a benzyl group, a phenethyl group, a 3-phenylpropyl group, and a 4-phenylbutyl group.

Among these, from the viewpoint of the electrical characteristics of the obtained electrophotographic photoreceptor and the viewpoint of the dispersibility of the filler, the hydrocarbon group is particularly preferably a methyl group, an ethyl group, a n-propyl group, a n-butyl group, a phenyl group, a tolyl group, a naphthyl group, or a benzyl group, and most preferably a methyl group, an ethyl group, a phenyl group, or a benzyl group.

With the above groups, both the solubility of the polymer A and the reactivity during the polymer production can be achieved.

The hydrocarbon group in $X^1$, $X^2$, $X^3$, $R^{11}$, $R^{12}$, $R^{15}$ and $R^{16}$ in the Formula (10) and $R^{21}$ in the Formula (11) may further have a substituent.

Examples of the substituent include an alkoxy group and a halogen group.

Examples of the alkoxy group include a methoxy group, an ethoxy group, a phenoxy group, a one-terminal alkoxypolyethylene glycoloxy group, and a one-terminal alkoxypolypropylene glycoxy group. Examples of the halogen group include a fluorine atom, a chlorine atom and a bromine atom.

Examples of the substituent further include a cyano group, an acyloxy group, a carboxyl group, an alkoxycarbonyl group, a carbamoyl group, an allyl group, a hydroxy group, an amino group, a siloxane group, and a hydrophilic or ionic group.

Examples of the acyloxy group include an acetate group, a propionate group, a succinate group, a malonate group, a phthalate group, a 2-hydroxyethyl-phthalate group, a benzoate group, and a naphthoate group. Examples of the alkoxycarbonyl group include a methoxycarbonyl group, an ethoxycarbonyl group, a propoxycarbonyl group, a butoxycarbonyl group, and a benzyl alkoxycarboxyl group. Examples of the amino group include a monoalkylamino group and a dialkylamino group.

From the viewpoint of the electrical characteristics, preferred are alkoxy groups such as a methoxy group, an ethoxy group, and a phenoxy group; acyloxy groups such as an acetate group, a propionate group and a phthalate group; and alkoxycarbonyl groups such as a methoxycarbonyl group, an ethoxycarbonyl group, and a benzylalkoxycarbonyl group.

Examples of the heterocyclic group in $R^{21}$ include a heterocyclic group having 2 to 18 carbon atoms.

Examples of the heterocyclic group include an aromatic heterocyclic group, a cyclic ether group, a cyclic amino group, and a cyclic thioether group. Specific examples of the heterocyclic group include a furanyl group, a pyrrolyl group, a pyridinyl group, a thiophenyl group, an oxiranyl group, an oxetanyl group, a tetrahydrofuranyl group, a tetrahydropyranyl group, a dioxolanyl group, a dioxanyl group, and a tetrahydrothiophenyl group. From the viewpoint of electrical characteristics, preferred are a furanyl group, a thiophenyl group, and a tetrahydrofuranyl group.

Examples of the "substituent" which the heterocyclic group may have include substituents same as those described above for the substituent which the hydrocarbon group may have.

$R^{21}$ represents a hydrogen atom, a hydrocarbon group which may have a substituent, or a heterocyclic group which may have a substituent, and preferred is a hydrogen atom, a hydrocarbon group or a heterocyclic group, more preferred is a hydrogen atom or a hydrocarbon group, still more preferred is a hydrocarbon group, and even more preferred is an alkyl group.

The number of carbon atoms of the alkyl group is generally 1 or more, and on the other hand is generally 6 or less, preferably 4 or less, more preferably 2 or less, and still more preferably 1. It is preferable that the number of carbon atoms is within the above range since the dispersibility of the filler in the coating liquid is good. Specific examples of the alkyl group include a methyl group, an ethyl group, a propyl group, a butyl group, a pentyl group, and a hexyl group. Preferred are a methyl group, an ethyl group and a propyl group, and more preferred is a methyl group.

$X^1$, $X^2$ and $X^3$ each independently represent a hydrogen atom, a hydrocarbon group which may have a substituent, or a group represented by the above Formula (11). From the viewpoint of the reactivity during the production of the polymer A and the dispersibility of the filler, $X^1$ is preferably a group represented by the above Formula (11), and preferably, $X^2$ and $X^3$ are each independently a hydrogen atom or a group represented by the above Formula (11). Further, it is more preferable that one of $X^2$ and $X^3$ is a hydrogen atom and the other is a group represented by the Formula (11). In a case where two or more of $X^1$, $X^2$ and $X^3$ are groups represented by the Formula (11), they may be the same or different from each other.

In addition, in a case where no in the Formula (10) is 2 or more, the no $X^2$ contained in one repeating structural unit may be the same or different from each other, and are preferably the same from the viewpoint of ease of synthesis. Further, in a case where no in the Formula (10) is 2 or more, the no $X^3$ contained in one repeating structural unit may be the same or different from each other, and are preferably the same from the viewpoint of ease of synthesis.

From the viewpoints of the reactivity during the polymer production and the dispersibility of the filler, in the case where no is 2 or more, in the partial structure represented by no

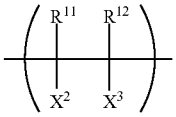

and contained in one repeating structural unit, it is preferable that 60% or more contain a structure represented by the Formula (11) as $X^2$ or $X^3$, it is more preferable that 80% or more contain a structure represented by the Formula (11) as $X^2$ or $X^3$, and it is particularly preferable that 100% contain a structure represented by the formula (11) as $X^2$ or $X^3$.

From the viewpoint of synthesis, $R^{11}$, $R^{12}$, $R^{15}$ and $R^{16}$ in the repeating unit of the formula (10) are preferably each independently a hydrogen atom or a hydrocarbon group, more preferably a hydrogen atom or an alkyl group, and still more preferably a hydrogen atom.

$R^{14}$ represents a hydrocarbon group which may have a substituent or a group represented by the above Formula (13).

In a case where $R^{14}$ is a hydrocarbon group, $R^{14}$ is a divalent group obtained by removing one hydrogen atom from the above-mentioned hydrocarbon group, and is preferably a methylene group, an ethylene group, a trimethylene group, and a tetramethylene group, more preferably a methylene group, an ethylene group, and a trimethylene group, still more preferably a methylene group and an ethylene group, and particularly preferably a methylene group.

Z represents a hydrogen atom or a group derived from a radical polymerization initiator.

The group derived from the radical polymerization initiator means a group derived from a radical polymerization initiator to be described later, which is used in the production of the polymer A or the polymer B.

$n_0$ in the Formula (10) is an integer of 1 or more. no is preferably 2 or more, more preferably 3 or more, still more preferably 5 or more, and particularly preferably 10 or more. On the other hand, the upper limit thereof is not particularly limited, and no is generally 1,000 or less, preferably 800 or less, more preferably 500, and particularly preferably 200 or less. When no is within the above range, good dispersibility of the filler can be obtained.

The weight average molecular weight (Mw) of the structure represented by the above Formula (10) is not particularly limited, and is preferably 2,000 or more, and particularly preferably 3,000 or more. On the other hand, the weight average molecular weight (Mw) is preferably 20,000 or less, and particularly preferably 15,000 or less.

When the weight average molecular weight (Mv) is within the above range, good solvent affinity can be obtained, and a smooth coating film having good compatibility with other binder resins can be obtained.

In the Formula (13), $n_{31}$, $n_{32}$, $n_{33}$, and $n_{34}$ each independently represent 0 or an integer of 1 or more. $n_{31}$, $n_{32}$, $n_{33}$, and $n_{34}$ are each independently and generally 4 or less, preferably 2 or less, and more preferably 1.

In Formula (13), $R^{31}$ represents an alkylene group, a halogen-substituted alkylene group, —($C_mH_{2m-1}$(OH))— or a single bond.

Examples of the alkylene group include: a linear alkylene group having 1 to 6 carbon atoms such as a methylene group and an ethylene group; a branched alkylene group having 3 to 10 carbon atoms such as a methylethylene group, a methylpropylene group, and a dimethylpropylene group; and an alicyclic alkylene group having 5 to 15 carbon atoms such as a cyclohexylene group or a 1,4-dimethylcyclohexylene group.

Examples of the halogen-substituted alkylene group include a chloromethylene group, a dichloromethylene group, a tetrachloroethylene group, a 1,2-bischloromethylethylene group, a 2,2-bis(chloromethyl) propylene group, a 1,2-bisdichloromethylethylene group, a 1,2-bis(trichloromethyl) ethylene group, a 2,2-dichloropropylene group, a 1,1,2,2-tetrachloroethylene group, a 1-trifluoromethylethylene group, and a 1-pentafluorophenylethylene group.

$R^{31}$ is preferably an alkylene group, —($C_mH_{2m-1}$(OH))—, and more preferably —($C_mH_{2m-1}$(OH))—.

m represents an integer of 1 or more, and is generally 4 or less, preferably 2 or less, and more preferably 1. The above range is preferred since the solubility in a solvent is high.

$R^{32}$ represents an alkylene group, a halogen-substituted alkylene group, —S—, —O—, —NH— or a single bond.

Specific examples of the alkylene group and the halogen-substituted alkylene group in $R^{32}$ are the same as those mentioned for $R^{31}$.

$R^{32}$ is preferably —S—, —O—, —NH—, and more preferably —S—, from the viewpoint of ease of synthesis.

The Formula (10) is preferably the following Formula (10A).

FORMULA (10A)

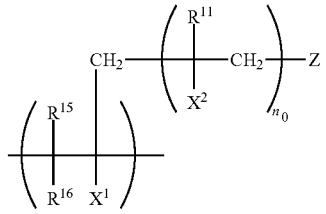

In the Formula (10A), $X^1$, $X^2$, $R^{11}$, $R^{15}$, $R^{16}$, Z and no can be the same as those mentioned for the above Formula (10).

Preferred specific examples of the repeating structural unit represented by the Formula (10) are shown below. In the following specific examples, no can be the same as those mentioned for the above Formula (10).

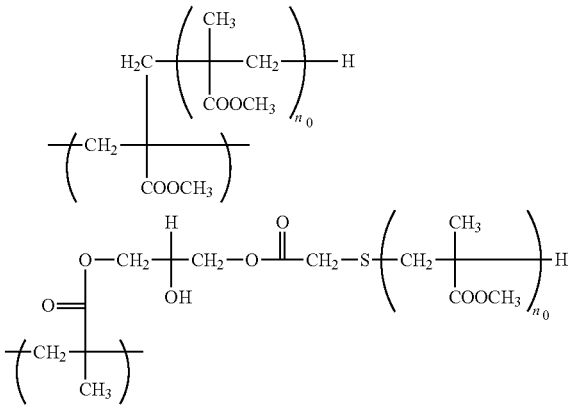

The polymer A may be further polymerized with another monomer as long as the effects of the present invention are not impaired. Examples of the another monomer include a (meth)acrylic acid monomer, a (meth)acrylate monomer other than those described above, macromonomers containing a (meth)acrylate group or a 2-(alkoxycarbonyl)allyl group at the terminal of a polymer such as polymethyl methacrylate resin (PMMA) or polystyrene, a (meth)acrylamide monomer, an aromatic vinyl monomer, a linear or cyclic alkyl vinyl ether monomer having 1 to 12 carbon atoms, and a vinyl ester monomer.

The another monomer is preferably a (meth)acrylate monomer and an aromatic vinyl monomer from the viewpoint of solubility in an organic solvent. The content of the another monomer in the polymer A is preferably 30 mass % or less, and from the viewpoint of the dispersibility of the filler, is more preferably 20 mass % or less.

Specific examples of the (meth)acrylate monomer include methyl (meth)acrylate, ethyl (meth)acrylate, n-butyl (meth) acrylate, tert-butyl (meth)acrylate, benzyl (meth)acrylate, phenyl (meth)acrylate, tetrahydrofurfuryl (meth)acrylate, 2-phenoxyethyl (meth)acrylate, and isobornyl (meth)acrylate. From the viewpoint of the dispersibility of the filler, preferred are n-butyl (meth)acrylate, tert-butyl (meth)acrylate, benzyl (meth)acrylate, tetrahydrofurfuryl (meth)acrylate, and isobornyl (meth)acrylate.

<<Method for Producing Polymer A>>

The method for producing the polymer A is not particularly limited, and examples thereof include: a production method with radical polymerization of a (meth)acrylate monomer and at least one of a polycarbonate resin and a polyester resin containing a radical polymerizable functional group; or a production method with radical polymerization of a (meth)acrylate oligomer containing a hydroxy group or amino group and at least one of a polycarbonate resin and a polyester resin.

In the above production methods, from the viewpoint of using highly reactive radical polymerization in the final stage of polymer production, the production method with radical polymerization of a (meth)acrylate monomer and at least one of a polycarbonate resin and a polyester resin containing a radical polymerizable functional group is effective. This method is also preferred as a method for producing the polymer A from the viewpoint of solubility of an intermediate.

<A. Production with Radical Polymerization of (Meth) Acrylate Monomer and at Least One of Polycarbonate Resin and Polyester Resin Containing Radical Polymerizable Functional Group>

In the production with radical polymerization, a (meth) acrylate monomer which is the source of the repeating structural unit represented by the above Formula (1), and a reactive substance such as at least one of a polycarbonate resin and a polyester resin containing a radical polymerizable functional group are dissolved in an organic solvent, and then a thermal polymerization initiator is added thereto. The above substances are polymerized while being heated to 50° C. to 200° C., so as to obtain a target polymer.

Feed methods for the preparation of polymerization reaction include a method in which all raw materials are fed together, a method in which at least one of raw materials such as an initiator is continuously fed into a reactor, and a method in which all the raw materials are continuously fed and are continuously extracted from a reactor at the same time. The (meth)acrylate monomer, which is the source of the repeating structural unit represented by the above Formula (1), is preferably a (meth)acrylate monomer represented by the above Formula (8).

For at least one of the polycarbonate resin and the polyester resin, a resin described in the following <Polycarbonate Resin or Polyester Resin Containing Reactivity Group> is used. That is, the polycarbonate resin containing a radical reactive group preferably contains a repeating structural unit represented by the above Formula (5), and the polyester resin containing a radical reactive group preferably contains a repeating structural unit represented by the above Formula (6).

The solvent to be used for the radical polymerization is not particularly limited, and specific examples thereof include: alcohols such as methanol, ethanol, propanol, and 2-methoxyethanol; ethers such as tetrahydrofuran, 1,4-dioxane, dimethoxyethane, and anisole; esters such as methyl formate, ethyl acetate, and butyl acetate; ketones such as acetone, methyl ethyl ketone, methyl isobutyl ketone, and cyclohexanone; aromatic hydrocarbons such as benzene, toluene, and xylene; and aprotic polar solvents such as N-methyl pyrrolidone, N,N-dimethylformamide, and dimethyl sulfoxide.

Among these solvents, from the viewpoint of the solubility of the polymer A, preferred are toluene, xylene, anisole, dimethoxyethane, tetrahydrofuran, 1,4-dioxane, butyl acetate, methyl isobutyl ketone, cyclohexanone, and N,N-dimethylformamide; and from the viewpoint of solubility of the polycarbonate resin and the polyester resin as the raw material, and particularly preferred are toluene, anisole, dimethoxyethane, cyclohexanone, and N,N-dimethylformamide.

These solvents may be used alone or in combination of two or more thereof. The organic solvent is used in an amount of 50 to 2,000 parts by mass, for example, 50 to 1,000 parts by mass relative to 100 parts by mass of the total of the monomers.

As the polymerization initiator to be used in the radical polymerization, an azo compound, an organic peroxide, an inorganic peroxide, and a redox-type polymerization initiator can be used.

Examples of the azo compound include 2,2'-azobis(isobutyronitrile), 1,1-azobis(cyclohexane-1-carbonitrile), azocumene, 2,2'-azobis (2-methylbutyronitrile), 2,2'-azobisdimethylvaleronitrile, 4,4'-azobis(4-cyanovaleric acid), 2-(tert-butylazo)-2-cyanopropane, 2,2'-azobis(2,4,4-trimethylpentane), 2,2'-azobis(2-methylpropane), and dimethyl 2,2'-azobis(2-methylpropionate).

Examples of the organic peroxide include cyclohexanone peroxide, 3,3,5-trimethylcyclohexanone peroxide, methylcyclohexanone peroxide, 1,1-bis(tert-butylperoxy)-3,3,5-trimethylcyclohexane, 1,1-bis(tert-butylperoxy) cyclohexane, n-butyl-4,4-bis(tert-butylperoxy) valerate, cumene hydroperoxide, 2,5-dimethylhexane-2,5-dihydroperoxide, 1,3-bis(tert-butylperoxy)-m-isopropyl) benzene, 2,5-dimethyl-2,5-di(tert-butylperoxy) hexane, diisopropyl benzene peroxide, tert-butylcumyl peroxide, decanoyl peroxide, lauroyl peroxide, benzoyl peroxide, 2,4-dichlorobenzoyl peroxide, bis(tert-butylcyclohexyl) peroxydicarbonate, tert-butyl peroxybenzoate, and 2,5-dimethyl-2,5-di (benzoylperoxy) hexane.

Examples of the inorganic peroxide include potassium persulfate, sodium persulfate, and ammonium persulfate.

Examples of the redox-type polymerization initiator include sodium sulfite, sodium thiosulfate, sodium formaldehyde sulfoxylate, ascorbic acid, and ferrous sulfate, which are used as a reducing agent, and potassium peroxodisulfate, hydrogen peroxide, and tert-butyl hydroperoxide, which are used as an oxidant.

Among these polymerization initiators, 2,2'-azobis (isobutyronitrile), 1,1-azobis(cyclohexane-1-carbonitrile), dimethyl 2,2'-azobis(2-methyl propionate), and benzoyl peroxide are preferred from the viewpoint of influences of electrical characteristics due to residues. The polymerization initiator is preferably used in a range of 0.01 to 20 parts by mass, and more preferably in a range of 0.01 to 10 parts by mass, relative to 100 parts by mass of the monomer.

A chain transfer agent may be used in the radical polymerization reaction for the purpose of molecular weight adjustment and introduction of other functional groups. The chain transfer agent to be used is not particularly limited, and examples thereof include thiols such as 1-butanethiol, 1-hexylthiol, 1-decanethiol, and 2-ethylhexyl thioglycol; halogenated hydrogens such as carbon tetrabromide and carbon tetrachloride; α-methylstyrene dimers such as 2,4-diphenyl-4-methyl-1-pentene; and naphthoquinones.

The reaction temperature can be appropriately adjusted depending on the solvent and the polymerization initiator used. Preferred is 50° C. to 200° C., and particularly preferred is 80° C. to 150° C. The polymer-containing solution after the polymerization may be used as a solution dissolved in an organic solvent, or the polymer may be extracting by subjecting the solution to precipitation in an alcohol and other organic solvents in which the polymer is insoluble, or by distilling off the solvent in a dispersion medium in which the polymer is insoluble, or by distilling off the solvent by heating and decompression.

The drying in the case of extracting the polymer is generally performed at a temperature equal to or lower than the decomposition temperature of the polymer. The drying temperature is preferably 30° C. or higher and equal to or lower than the melting temperature of the polymer. At this time, drying under reduced pressure is preferred. The drying is preferably performed for a time period until the purity of impurities such as a residual solvent is equal to or lower than a certain level. Specifically, the drying time is equal to or longer than a time until which the amount of the residual solvent is generally 1000 ppm or less, preferably 300 ppm or less, and particularly preferably 100 ppm or less.

<Polycarbonate Resin or Polyester Resin Containing Radical Polymerizable Functional Group>

The polycarbonate resin or the polyester resin containing a radical polymerizable functional group is not particularly limited as long as it is radically polymerizable, and examples thereof include a (meth)acrylate group, a vinyl group, a (meth)acrylamide group, a styrene group, and an allyl group. Among these functional groups, preferred is a (meth)acrylate group from the viewpoints of being easily introduced into the polycarbonate resin or the polyester resin, the reactivity of the radical reaction, the availability of the monomer, and the electrical characteristics.

That is, the polycarbonate resin or the polyester resin preferably contains a (meth)acrylate group represented by the following Formula (7) at the terminal, side chain, or both.

FORMULA (7)

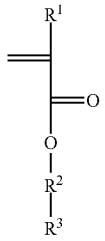

In the Formula (7), $R^1$ to $R^3$ are the same as defined above.

Examples of a method for introducing the radical polymerizable functional group into the polycarbonate resin or the polyester resin include a method using dihydric phenol containing a radical polymerizable functional group as a raw material, a method of introducing a terminator containing a radical polymerizable functional group into the terminal, and a method of introducing a diol containing a radical polymerizable functional group into the side chain.

In the method of introducing a (meth)acrylate group into the terminal, when producing a polycarbonate resin or a polyester resin, for example, the (meth)acrylate group can be introduced by using a monomer represented by the following Formula (20).

FORMULA (20)

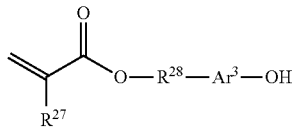

In the Formula (20), $R^{27}$ represents a hydrogen atom or a methyl group. $R^{28}$ is the same as the above $R^2$. $Ar^3$ represents a single bond or an arylene group which may have a substituent.

Examples of the arylene group which may have a substituent of $Ar^3$ include a phenylene group, a naphthylene group, and a biphenylene group. Examples of the substituent which the arylene group may have include an alkyl group, an alkoxy group, and a ketone group. $Ar^3$ is preferably a single bond or a phenylene group.

Specific examples of the monomer represented by the Formula (20) include 2-hydroxyethyl (meth)acrylate, 3-hydroxypropyl (meth)acrylate, 4-hydroxybutyl (meth)acrylate, 1,4-cyclohexanedimethanol mono(meth)acrylate, 2-hydroxypropyl (meth)acrylate, 2-hydroxy-1-methylethyl (meth)acrylate, diethylene glycol mono(meth)acrylate, triethylene glycol mono(meth)acrylate, tetraethylene glycol mono(meth)acrylate, polyethylene glycol mono(meth)acrylate, dipropylene glycol mono(meth)acrylate, tripropylene glycol mono(meth)acrylate, tetrapropylene glycol mono (meth)acrylate, polypropylene glycol mono(meth)acrylate, di(tetramethylene glycol) mono(meth)acrylate, tri(tetramethylene glycol) mono(meth)acrylate, poly(tetramethylene glycol) mono(meth)acrylate, polyethylene glycol-propylene glycol-mono(meth)acrylate, and polyethylene glycol-tetramethylene glycol-mono(meth)acrylate.

From the viewpoint of electrical characteristics, preferred are 2-hydroxyethyl (meth)acrylate, 3-hydroxypropyl (meth) acrylate, 4-hydroxybutyl (meth)acrylate, and 1,4-cyclohexanedimethanol mono(meth)acrylate.

The polycarbonate resin or the polyester resin preferably contains a radical polymerizable functional group at the terminal or the side chain, and particularly preferably contains a radical polymerizable functional group at the terminal from the viewpoint of the availability of the monomer and reactivity during introduction. In addition, the polycarbonate resin or the polyester resin can contain a radical polymerizable functional group at both the terminal and the side chain.

The amount of the radical polymerizable functional group contained in the polycarbonate resin or the polyester resin is preferably 10 μeq/g or more, and more preferably 50 eq/g or more. On the other hand, from the viewpoint of gelation, the amount is preferably 1,000 μeq/g or less, and more preferably 800 μeq/g or less.

The content of the radical polymerizable functional group can be determined by $^1$H-NMR. In this case, the sample preparation conditions and the $^1$H-NMR measurement conditions are not particularly limited as long as the amount of the above radical polymerizable functional group can be suitably determined. For example, a solution obtained by dissolving the above polycarbonate resin or polyester resin in 1 g of chloroform-d solvent is used as a measurement sample, and quantification can be performed by performing $^1$H-NMR measurement at 20° C. using "AVANCE III cryo-400 MHz Spectrometer" manufactured by Bruker BioSpin Corporation.

<Method of Producing Polycarbonate Resin or Polyester Resin Containing Polymerizable Functional Group>

Next, a method for producing the polycarbonate resin or the polyester resin containing a radical polymerizable functional group will be described. Examples of the method for producing the polycarbonate resin or the polyester resin include a solution polymerization method, an interfacial polymerization method, or a production method combining a solution polymerization method and an interfacial polymerization method. Among these, from the viewpoint of the reactivity of the radical polymerizable functional group monomer, preferred is a solution polymerization method or a production method combining a solution polymerization method and an interfacial polymerization method.

In the case of the production with the solution polymerization method, for example, a monomer represented by the above Formula (20), and at least one of a polycarbonate oligomer and a divalent carboxylic acid chloride are dissolved, and a base such as triethylamine is added thereto. Then, after a monomer containing a radical polymerizable functional group is consumed in advance, an insufficient amount of dihydric phenol and base are added. In this way, a polycarbonate resin or a polyester resin containing a radical polymerizable functional group can be obtained.

The polymerization temperature is preferably in a range of −10° C. to 40° C., and the polymerization time is preferably in a range of 0.5 hour to 10 hours from the viewpoint of productivity. After completion of the polymerization, the resin dissolved in the organic phase is washed and collected to obtain a target resin.

Examples of the base to be used in the solution polymerization method include: tertiary amines such as triethylamine, tripropylamine, tributylamine, N,N-diisopropylethylamine, N,N-dipropylethylamine, N,N-diethylmethylamine, N,N-dimethylethylamine, N,N-dimethylbutylamine, N,N-dimethylisopropylamine, N,N-diethylisopropylamine, N,N,N',N'-tetramethyldiethylamine, and 1,4-diazabicyclo[2,2,2]octane; pyridines such as pyridine and 4-methylpyridine; and organic bases such as 1,8-diazabicyclo[5.4.0]-7-undecene.

The base to be used in the solution polymerization method is not particularly limited as long as it is a base used for a carbonate reaction or an esterification reaction of a phosphazene base, an inorganic base, or the like.

Among these bases, triethylamine, N,N-dipropylethylamine, N,N-diethylmethylamine, and pyridine are preferred from the viewpoints of reactivity and easy availability, and triethylamine is particularly preferred from the viewpoints of preventing the decomposition of chloroformate and acid chloride and the easy removal in washing.

When a monomer containing a radical polymerizable functional group is reacted in advance, the amount of the base to be used is generally 1.00 times equivalent or more, and preferably 1.05 times equivalent or more, relative to the radical polymerizable functional group of the monomer. On the other hand, the amount of the base to be used is generally 2.00 times equivalent or less, and more preferably 1.80 times equivalent or less.

The amount of the base to be used in an extension reaction of the polycarbonate resin or the polyester resin is preferably 1.00 time equivalent or more, and more preferably 1.05 times equivalent or more, relative to all the chloroformate groups and all acid chloride groups used. On the other hand, the amount of the base to be used is preferably 2.0 equivalents or less in order to prevent unnecessary decomposition of the chloroformate and acid chloride.

Examples of the solvent to be used in the solution polymerization method include: halogenated hydrocarbon compounds such as dichloromethane, chloroform, 1,2-dichloroethane, trichloroethane, tetrachloroethane, chlorobenzene and dichlorobenzene; aromatic hydrocarbon compounds such as toluene, anisole and xylene; hydrocarbon compounds such as cyclohexane and methylcyclohexane; ether compounds such as tetrahydrofuran, tetrahydropyran, 1,4-dioxane and 1,3-dioxolan; ester compounds such as ethyl acetate, methyl benzoate and benzyl acetate; and amide compounds such as N,N-dimethylformamide and N,N-dimethylacetamide. In addition, pyridine may be used as the base and the solvent.

Among these, from the viewpoint of reactivity, preferred are dichloromethane, chloroform, 1,2-dichloroethane, tetrahydrofuran, N,N-dimethylformamide, and pyridine. Further, from the viewpoint of washing efficiency, particularly preferred is dichloromethane.

When producing the polycarbonate resin or the polyester resin, a molecular weight regulator can be used. Examples of the molecular weight regulator include: alkyl phenols such as phenol, o-, m-, or p-cresol, o-, m-, or p-ethylphenol, o-, m-, or p-propylphenol, o-, m-, or p-(tert-butyl)phenol, pentylphenol, hexylphenol, octylphenol, nonylphenol, 2,6-dimethylphenol derivatives, and 2-methylphenol derivatives; monofunctional phenols such as o-, m-, or p-phenylphenol; and monofunctional acid halides such as acetyl chloride, butyryl chloride, octyl chloride, benzoyl chloride, benzenesulfonyl chloride, benzenesulfinyl chloride, sulfinyl chloride, benzenephosphonyl chloride and substituted products thereof.

Further examples of the molecular weight regulator include: monofunctional aliphatic alcohols such as methanol, ethanol and propanol; monofunctional alcohols having acrylate groups such as 2-hydroxyethyl acrylate, 4-hydroxybutyl acrylate, and 2-hydroxy butyl methacrylate; monofunctional alcohols having a perfluoroalkyl such as 1H,1H,2H,2H-tridecafluoro-1-n-octanol and 1H,1H,2H,2H-heptadecafluoro-1-decanol; and monofunctional alcohols having siloxane.

Among these molecular weight regulators, from the viewpoints of high molecular weight controllability and solution stability, preferred are o-, m-, or p-(tert-butyl)phenol, 2,6-dimethylphenol derivatives, and 2-methylphenol derivatives. Particularly preferred are p-(tert-butyl)phenol, 2,3,6-trimethylphenol, and 2,3,5-trimethylphenol. The amount of the molecular weight regulator to be used can be adjusted to obtain an optional molecular weight, and is preferably equal to or less than the equivalent of the radical reactive group.

Examples of the washing method after polymerization include a method of separating the liquid by stationary separation or centrifugation after washing the solution of the polycarbonate resin or the polyester resin using an alkaline aqueous solution of sodium hydroxide or potassium hydroxide, an aqueous solution of hydrochloric acid, nitric acid or phosphoric acid, or water. Regarding the resin solution after washing, the resin may be extracting by subjecting the solution to precipitation in water, an alcohol and other organic solvents in which the resin is insoluble, or by distilling off the solvent in warm water or a dispersion medium in which the resin is insoluble, or by distilling off the solvent by heating and decompression. In a case where the resin solution after washing is extracted in a slurry state, a solid resin can be extracted by a centrifuge, a filter or the like.

The extracted resin is generally dried at a temperature equal to or lower than the decomposition temperature of the polycarbonate resin or the polyester resin, or can be dried preferably at a temperature equal to or higher than 20° C. and equal to or lower than the melting temperature of the resin. At this time, drying under reduced pressure is preferred. The drying is preferably performed for a time period until the purity of impurities such as a residual solvent is equal to or lower than a certain level. Specifically, the drying time is equal to or longer than a time until which the amount of the residual solvent is generally 1000 ppm or less, preferably 300 ppm or less, and particularly preferably 100 ppm or less.

In a case where the monomer containing a radical polymerizable functional group is an aliphatic hydroxy group, since the reactivity of the aliphatic hydroxy group is lower than that of the phenolic hydroxy group, it is difficult to introduce a radical polymerizable functional group only by an interfacial polymerization method. Therefore, in the case of a production method combining a solution polymerization method and an interfacial polymerization method, the aliphatic hydroxy group is reacted by the solution polymerization method in a first stage, and then the resin chain is extended by an interfacial polymerization method in a second stage, so that a polycarbonate resin or polyester resin containing a radical polymerizable functional group is obtained.

(Solution Polymerization in First Stage) In the solution polymerization in the first stage, a monomer containing a radical reactive group as represented by the Formula (20), a polycarbonate oligomer, and chloroformate (acid chloride) such as divalent carboxylic chloride are dissolved, and a base such as triethylamine is added thereto, so as to cause a reaction. After removing the base by washing, the solution is used as it is or the polymer once dissolved in the solution is extracted for use in the interfacial polymerization in the second stage.

In the solution polymerization in the first stage, a solvent, a base, a reaction temperature, a terminator, and a washing method equivalent to those in the above solution polymerization are preferred. The reaction time is preferably 30 minutes to 10 hours, and more preferably 1 to 4 hours from the viewpoint of sufficient reaction progress and production efficiency.

(Interfacial Polymerization in Second Stage)

In the production with the interfacial polymerization method, for example, in the case of a polycarbonate resin, an alkaline aqueous solution is mixed with the solution obtained by the solution polymerization. At this time, a quaternary ammonium salt or a quaternary phosphonium salt can be used as a catalyst. If necessary, an additional dihydric phenol can be added. The polymerization temperature is preferably in a range of 0° C. to 40° C., and the polymerization time is preferably in a range of 2 to 20 hours from the viewpoint of productivity.

After completion of the polymerization, an aqueous phase and an organic phase are separated, the polymer dissolved in the organic phase is washed and collected using a known method to obtain a target resin. The polyester resin can also be produced by the same production method.

Examples of an alkali component to be used in the interfacial polymerization method include hydroxides of alkali metals such as sodium hydroxide and potassium hydroxide.

The reaction solvent to be used in the interfacial polymerization method is preferably a halogenated hydrocarbon or an aromatic hydrocarbon. Examples of the halogenated hydrocarbon include dichloromethane, chloroform, 1,2-dichloroethane, trichloroethane, tetrachloroethane, and dichlorobenzene. Examples of the aromatic hydrocarbon include toluene, xylene, and benzene.

Examples of the quaternary ammonium salt or quaternary phosphonium salt used as the catalyst include: salts of hydrochloric acid of tertiary alkylamines such as tributylamine and trioctylamine, salts of bromic acid of the tertiary alkylamines and salts of iodic acid of the tertiary alkylamines; benzyltriethylammonium chloride, benzyltrimethylammonium chloride, benzyltributylammonium chloride, tetraethylammonium chloride, tetrabutylammonium chloride, tetrabutylammonium bromide, trioctyl methyl ammonium chloride, tetrabutylphosphonium bromide, triethyloctadecylphosphonium bromide, N-laurylpyridinium chloride, and lauryl picolinium chloride.

In the interfacial polymerization method, a molecular weight regulator can also be used. Examples of the molecular weight regulator include those described for the above solution polymerization method.

In addition, an antioxidant can be added to prevent the dihydric phenol from being oxidized in the alkaline solution. Examples of the antioxidant include sodium sulfite, hydrosulfite (sodium hyposulfite), sulfur dioxide, potassium sulfite, and sodium bisulfite. Among these, hydrosulfite is particularly preferred from the viewpoint of the effect of preventing oxidation and the reduction of environmental load.

The amount of the antioxidant to be used is preferably 0.01 mass % or more and 10.0 mass % or less relative to all dihydric phenols. More preferably, the amount of the antioxidant is 0.1 mass % or more and 5 mass % or less. When the amount of the antioxidant is too small, the antioxidant effect may be insufficient, and when the amount of the antioxidant is too large, the antioxidant may remain in the resin and adversely affects the electrical characteristics. The conditions described in the above solution polymerization method can be applied to the method of washing the obtained resin after polymerization, the method of extracting the resin solution after washing, and the method of drying the extracted resin.

<B. Production Method with Radical Polymerization of (Meth)Acrylate Oligomer Containing Hydroxy Group or Amino Group and at Least One of Polycarbonate Resin and Polyester Resin>

The polymer A can also be obtained by a radical reaction of a (meth)acrylate oligomer containing a functional group such as a hydroxy group or an amino group with a phosgene/dihydric phenol, a polycarbonate oligomer or a dihydric acid chloride/dihydric phenol.

A fluorine-containing (meth)acrylate oligomer containing a functional group such as a hydroxy group and an amino group can be obtained by, for example, a method of mixing a (meth)acrylate, which is the source of the Formula (2) described above, with a chain transfer agent containing a functional group such as a hydroxy group or an amino group by a radical reaction, or a method by polymerization with a (meth)acrylate containing a hydroxy group as in the above Formula (20).

Examples of the chain transfer agent containing a functional group such as a hydroxy group or an amino group include 2-mercaptoethanol, 3-mercaptopropanol, 4-mercaptobutanol, 5-mercaptoheptanol, and 6-mercaptohexanol.

It is also possible to use a chain transfer agent containing a carboxylic acid group such as thioglycolic acid, and the carboxylic acid is introduced into the terminal of the oligomer and is then converted to another functional group. It is also possible to react the carboxylic acid with an epoxy compound containing a hydroxy group, so as to introduce a hydroxy group into the oligomer.

Further, it is also possible to mix other (meth)acrylate monomers when producing the oligomer.

As the conditions of the radical reaction for obtaining the oligomer, the same conditions as those of the radical reaction described above can be applied.

Examples of a method of polymerizing the obtained oligomer with at least one of the polycarbonate resin and the polyester resin include the above solution polymerization method and production method combining a solution polymerization method and an interfacial polymerization method.

<<Polymer B>>

The photosensitive layer in the electrophotographic photoreceptor of the present invention contains the polymer B not containing the repeating structural unit represented by the above Formula (1) but the repeating structural unit represented by the Formula (2). The polymer B can be produced in the same manner as the polymer A described above.

The repeating structural unit represented by the Formula (2) in the polymer B has the same meaning as the repeating structural unit represented by the Formula (2) in the polymer A, and the same structure can be used. The repeating structural unit represented by the Formula (2) in the polymer A and the repeating structural unit represented by the Formula (2) in the polymer B, which are used together in the same photosensitive layer, may be the same or may be different from each other.

In addition, the polymer B, as the polymer A, may contain a repeating structural unit represented by the Formula (10). It is preferable that the polymer B contains the repeating structural unit since gelation during the polymer production is effectively prevented, and steric hindrance mainly due to the portion from $R^{14}$ to Z in the repeating structural unit represented by the Formula (10) is effective for preventing aggregation of the filler. In the polymer B, the repeating structural unit represented by the Formula (10) may be used in combination of two or more thereof.

In a case where the polymer B contains the repeating structural unit represented by the Formula (10), from the viewpoint of compatibility with the binder resin, the content ratio (mass ratio) of the repeating structural unit represented by the Formula (10) to the amount of the repeating structural unit represented by the Formula (2) is generally 0.1 or more, preferably 0.2 or more, more preferably 0.3 or more, and particularly preferably 0.5 or more. On the other hand, from the viewpoint of the dispersibility of the filler, the content ratio (mass ratio) is generally 10 or less, preferably 5 or less, more preferably 3 or less, and particularly preferably 2 or less.

It is preferable that both the polymer A and the polymer B contain the repeating structural unit represented by the Formula (10) from the viewpoints of improving the compatibility of the polymer A and the polymer B, and the dispersibility of the filler.

Each of the polymer A and the polymer B may further contain a repeating structural unit represented by the following Formula (14). In the polymer A and the polymer B, the repeating structural unit represented by the Formula (14) may be used in combination of two or more thereof.

FORMULA (14)

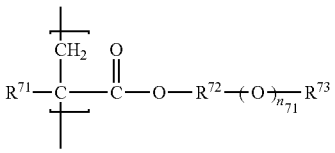

In the Formula (14), $R^{71}$ represents a hydrogen atom or an alkyl group. $R^{72}$ represents a single bond or an alkylene group. $R^{73}$ represents an aryl group or a group having an ether moiety and a cyclic structure. $n_{71}$ represents 0 or 1.

The number of carbon atoms of the alkyl group of $R^{71}$ is generally 1 or more, and is generally 6 or less, preferably 4 or less, more preferably 2 or less, and still more preferably 1. It is preferable that the number of carbon atoms is within the above range since the dispersibility of the filler in the solvent is good.

Specific examples of the alkyl group of $R^{71}$ include a methyl group, an ethyl group, a propyl group, a butyl group, a pentyl group, and a hexyl group. Preferred are a methyl group, an ethyl group and a propyl group, and more preferred is a methyl group. The above specific examples are preferred since the dispersibility of the filler in the solution is good.

The number of carbon atoms of the alkylene group of $R^{72}$ is generally 1 or more, and is generally 6 or less, preferably 4 or less, and more preferably 2 or less. The above range is preferred since the solubility in a solvent is high.

Specific examples of the alkylene group of $R^{72}$ include a methylene group, an ethylene group, a trimethylene group, a tetramethylene group, a pentaethylene group, and a hexamethylene group, and preferred are a methylene group, an ethylene group and a trimethylene group. The above groups are preferred since the solubility in a solvent is high.

The number of carbon atoms of the aryl group of $R^{73}$ is generally 6 or more, and is generally 10 or less, preferably 8 or less, more preferably 7 or less, and still more preferably 6. It is preferable that the number of carbon atoms is within the above range since the dispersibility of the filler in the coating liquid is high.

Specific examples of the aryl group of $R^{73}$ include a phenyl group, a methylphenyl group, a xylyl group, an ethylphenyl group, a propylphenyl group, and a butylphenyl group. Preferred are a phenyl group and a methylphenyl group, and more preferred is a phenyl group. The above aryl groups are preferred since the dispersibility of the filler in the coating liquid is high.

The ring size of the group having an ether moiety and a cyclic structure of $R^{73}$ is not particularly limited, and is generally 3 members or more, preferably 4 members or more, and on the other hand is generally 8 members or less, preferably 6 members or less, and more preferably 5 members. It is preferable that the ring size of the group is within the above range since the dispersibility of the filler in the coating liquid is high.

Preferred specific examples of the repeating structural unit represented by the Formula (14) are shown below. In the following repeating structural units, R represents a hydrogen atom or a methyl group.

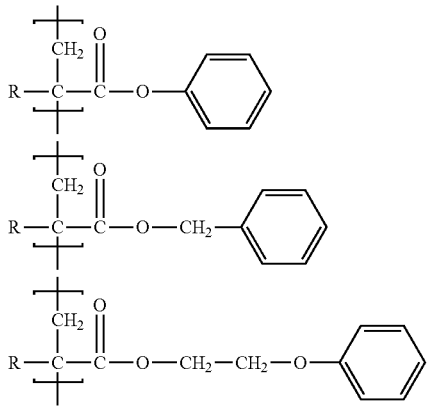

-continued

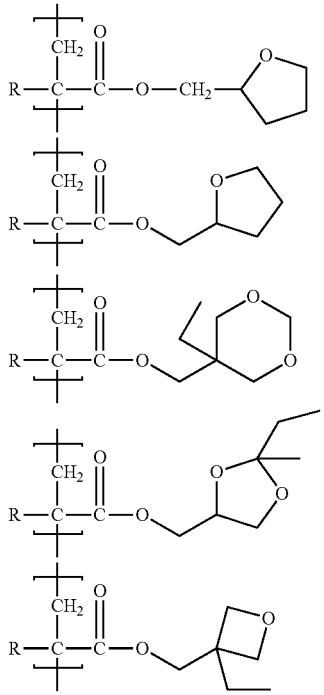

Among these, the following repeating structural units are still more preferred from the viewpoint of the electrical characteristics of the obtained electrophotographic photoreceptor.

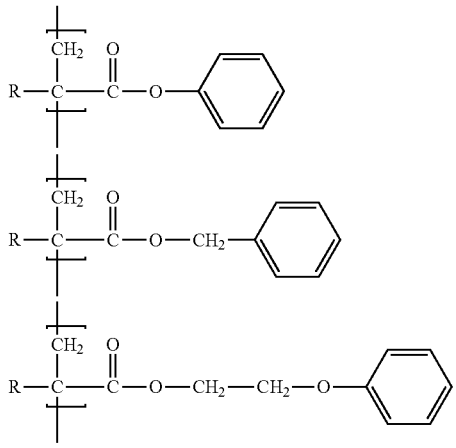

-continued

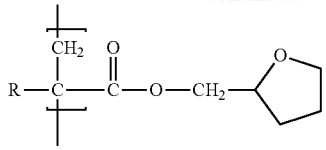

Among these, the following repeating structural units are still more preferred from the viewpoint of the electrical characteristics of the obtained electrophotographic photoreceptor.

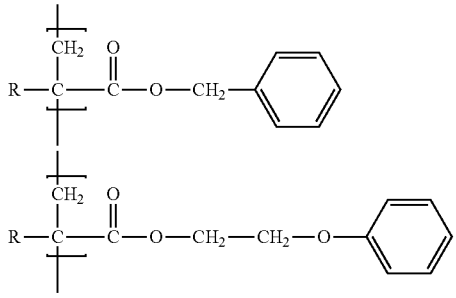

In a case where the polymer A contains a repeating structural unit represented by the Formula (14), from the viewpoint of the dispersibility of the filler in the coating liquid, the content of the repeating structural unit represented by the Formula (14) is preferably 1 mass % or more, more preferably 3 mass % or more, and most preferably 5 mass % or more, relative to the entire polymer A. On the other hand, from the viewpoint of electrical characteristics, the content is preferably 25 mass % or less, more preferably 20 mass % or less, and most preferably 15 mass % or less, relative to the entire polymer A.

In a case where the polymer B contains a repeating structural unit represented by the Formula (14), from the viewpoint of the dispersibility of the filler in the coating liquid, the content of the repeating structural unit represented by the Formula (14) is preferably 1 mass % or more, more preferably 3 mass % or more, and most preferably 5 mass % or more, relative to the entire polymer B. On the other hand, from the viewpoint of electrical characteristics, the content is preferably 25 mass % or less, more preferably 20 mass % or less, and most preferably 15 mass % or less, relative to the entire polymer B.

Specific examples of preferred repeating structural units contained in the polymer A are shown below. In the following repeating structural units, Za and Zb each represent a binding site.

(Z1-1)

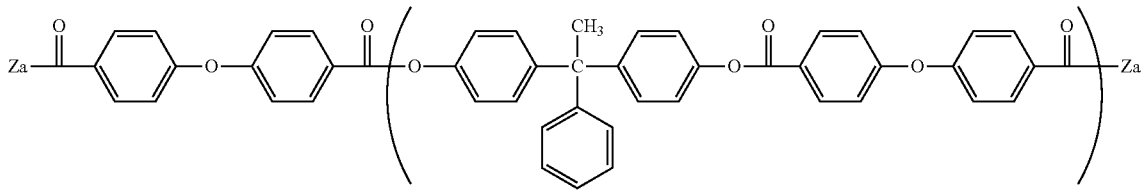

-continued (Z1-2)

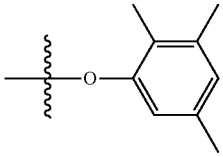

(Z1-3)

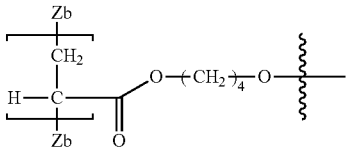

(Z1-4)

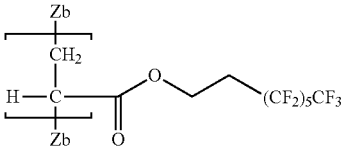

(Z1-5)

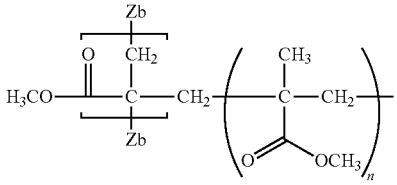

(Z1-10)

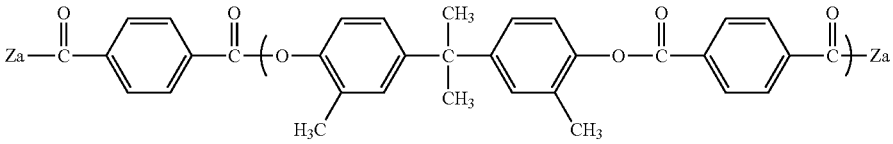

(Z1-2)

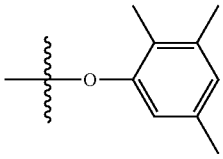

(Z1-3)

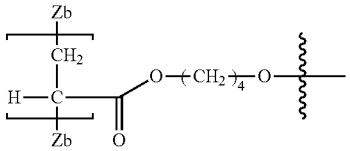

(Z1-4)

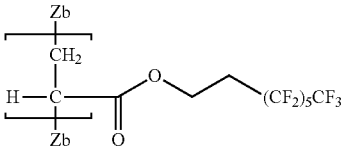

(Z1-5)

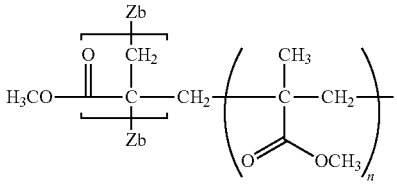

(Z1-20)

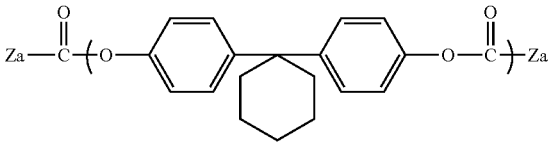

(Z1-2)

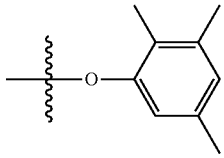

(Z1-3)

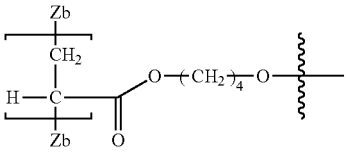

(Z1-4)

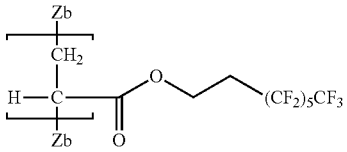

(Z1-5)

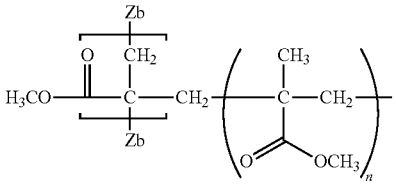

In the binding sites Za in (Z1-1), (Z1-10), and (Z1-20), (Z1-2) or (Z1-3) is independently present. In the binding sites Zb in (Z1-3), (Z1-4) and (Z1-5), Zbs are present independently by binding each other.

When the total of one selected from (Z1-1), (Z1-10) and (Z1-20), and of (Z1-4) and (Z1-5) is 100 parts by mass, the content of one selected from (Z1-1), (Z1-10), and (Z1-20) is 40 parts by mass or more and 70 parts by mass or less, the content of (Z1-4) is 25 parts by mass or more and 55 parts by mass or less, and the content of (Z1-5) is 0 part by mass or more and 20 parts by mass or less. n indicates an average number of repeating units and represents an integer of 20 or more and 50 or less.

In addition, specific examples of preferred repeating structural units contained in the polymer B are shown below. In the following repeating structural units, Zb represents a binding site.

(Z1-4)

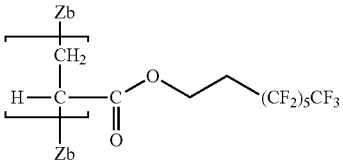

(Z1-5)

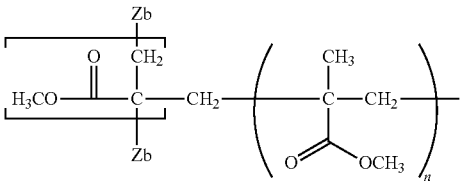

(Z1-6)

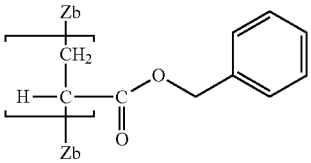

-continued (Z1-7)

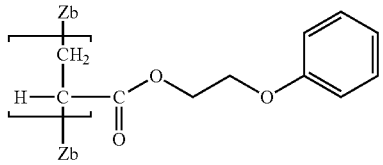

In the binding sites Zb in (Z1-4), (Z1-5), (Z1-6) and (Z1-7), Zbs are present independently by binding each other.

When the total of (Z1-4), (Z1-5), (Z1-6) and (Z1-7) is 100 parts by mass, the content of (Z1-4) is 30 parts by mass or more and 60 parts by mass or less, the content of (Z1-5) is 30 parts by mass or more and 60 parts by mass or less, the content of (Z1-6) is 0 part by mass or more and 15 parts by mass or less, and the content of (Z1-7) is 0 part by mass or more and 15 parts by mass or less. n indicates an average number of repeating units and n represents an integer of 20 or more and 50 or less.

Further, the following are also preferred as the preferred repeating structural units contained in the polymer B. In the following repeating structural units, y indicates an average number of repeating units and represents an integer of 1 or more.

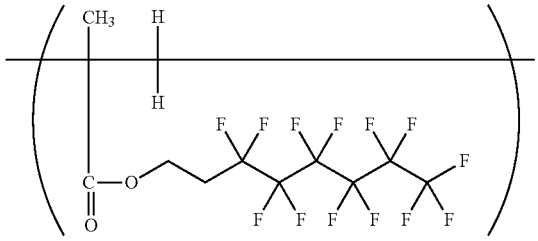

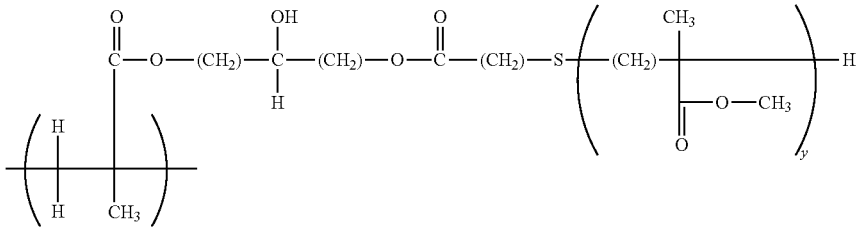

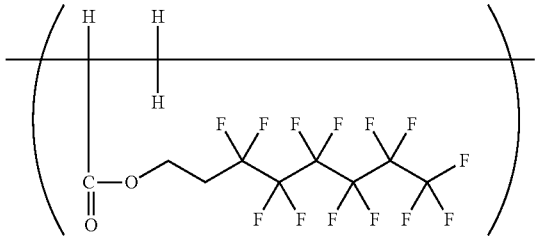

-continued

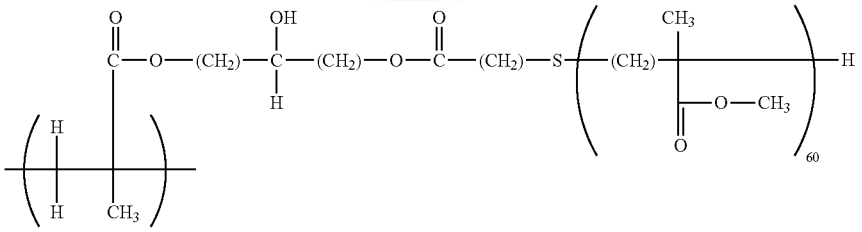

The fact that the photosensitive layer contains the polymer A and the polymer B can be analyzed by obtaining a $^{1}$H-NMR spectrum. In this case, the measurement conditions of $^{1}$H-NMR are not particularly limited, and it is preferable to use deuterated chloroform as a solvent, and the measurement temperature is preferably 25° C. to 50° C.

[Filler]

The photosensitive layer used in the present invention preferably contains a filler.

Examples of the filler include: inorganic particles such as silicon oxide and aluminum oxide; and resin particles such as fluorine atom-containing resin particles, silicone resin particles, melamine resin particles, acrylic resin particles, and styrene resin particles. Among these, preferred are fluorine atom-containing resin particles and silicone resin particles, and more preferred are fluorine atom-containing resin particles from the viewpoint of the abrasion resistance of the obtained electrophotographic photoreceptor.

As the fluorine atom-containing resin particles, it is preferable to appropriately select one or two or more from a tetrafluoroethylene resin, a trifluoroethylene chloride resin, a hexafluoropropylene resin, a vinyl fluoride resin, a vinylidene fluoride resin, a difluoride dichloride ethylene resin, and polymers thereof. More preferred are a tetrafluoroethylene resin and a vinylidene fluoride resin, and particularly preferred is a tetrafluoroethylene resin.

The average primary particle diameter of the filler is preferably 0.01 μm or more, more preferably 0.05 μm or more, still more preferably 0.1 m or more, and particularly preferably 0.2 μm or more, from the viewpoints of abrasion resistance and the dispersibility of the filler. The average primary particle diameter of the filler is preferably 5 μm or less, more preferably 3 μm or less, still more preferably 1 μm or less, and particularly preferably 0.5 μm or less, from the viewpoint of the stability of the coating liquid. The average primary particle diameter of the filler is measured, for example, by a dynamic light scattering method by FPAR-1000 (manufactured by Otsuka Electronics Co., Ltd.) or a laser diffraction/scattering method by Microtrack (manufactured by Nikkiso Co., Ltd.).

In a case where the photosensitive layer is the outermost surface layer of the electrophotographic photoreceptor, the content of the filler in the outermost surface layer is preferably 2 mass % or more, more preferably 5 mass % or more, and still more preferably 10 mass % or more, from the viewpoint of the abrasion resistance of the obtained electrophotographic photoreceptor. On the other hand, the content of the filler in the outermost surface layer is preferably 30 mass % or less, more preferably 20 mass % or less, and still more preferably 15 mass % or less, from the viewpoint of the flexibility and strength of the coating film (that is, the layer containing the filler).

The solvent to be used in a case of dispersing the filler is preferably a non-aqueous solvent, and examples thereof include: hydrocarbon solvents such as xylene, toluene, and cyclohexane; ketone solvents such as acetone, methyl ethyl ketone, cyclohexanone, and methyl isobutyl ketone; ether solvents such as tetrahydrofuran, anisole, dimethoxyethane, 1,4-dioxane, dioxolane, methyl cellosolve, cellosolve, butyl cellosolve, methyl carbitol, carbitol, butyl carbitol, diethyl carbitol, and propylene glycol monomethyl ether; ester solvents such as ethyl acetate, n-butyl acetate, isobutyl acetate, n-amyl acetate, cellosolve acetate, propylene glycol monomethyl ether acetate, and 3-methoxybutyl acetate; and alcohol solvents such as n-butyl alcohol, sec-butyl alcohol, isobutyl alcohol, cyclohexanol, 2-ethylhexanol, and 3-methyl-3-methoxybutanol.

From the viewpoints of the solubility of the polymer A and the polymer B, and the effect on the electrical characteristics of the obtained electrophotographic photoreceptor, preferred are toluene, xylene, anisole, tetrahydrofuran, and dimethoxyethane. These solvents may be used alone or in combination of two or more thereof.

Preparation of the dispersion liquid of the filler can be performed by: mixing the filler, a non-aqueous liquid solvent, the polymer A and the polymer B; and then dispersing the filler by using a dispersion apparatus such as ultrasonic, paint shaker, bead mill, ball mill, various mixers, or various high-pressure wet dispersers.

The content of the polymer A is preferably 100 mass % or less relative to the mass of the filler. From the viewpoint of the dispersibility of the filler in the outermost surface layer, the content of the polymer A is preferably 0.5 mass % or more, more preferably 1 mass % or more, and still more preferably 2 mass % or more, relative to the mass of the filler. On the other hand, from the viewpoint of preventing the increase in residual potential (VL) of the obtained electrophotographic photoreceptor under high temperature and high humidity, the content of the polymer A is preferably 10 mass % or less, more preferably 8 mass % or less, and still more preferably 6 mass % or less, relative to the mass of the filler.

From the viewpoint of the dispersibility of the filler in the coating liquid, the content of the polymer B is preferably 0.5 mass % or more, more preferably 1 mass % or more, and still more preferably 2 mass % or more, relative to the mass of the filler. On the other hand, from the viewpoint of preventing the increase in residual potential of the obtained electrophotographic photoreceptor under high temperature and high humidity, the content of the polymer B is preferably 10 mass % or less, more preferably 8 mass % or less, and still more preferably 6 mass % or less, relative to the mass of the filler.

From the viewpoint of the dispersibility of the filler in the coating liquid and in the outermost surface layer, the total content of the polymer A and the polymer B is preferably 1 mass % or more, more preferably 2 mass % or more, still more preferably 4 mass % or more, and most preferably 6 mass % or more, relative to the mass of the filler. On the other hand, from the viewpoint of preventing the increase in residual potential of the obtained electrophotographic photoreceptor under high temperature and high humidity, the total content of the polymer A and the polymer B is preferably 20 mass % or less, more preferably 16 mass % or less, still more preferably 12 mass % or less, and most preferably 10 mass % or less, relative to the mass of the filler.

The polymer A and the polymer B can be mixed at an any ratio, and from the viewpoint of the dispersibility of the filler in the coating liquid and in the outermost surface layer, the mass ratio of the polymer A to the polymer B is preferably 4:1 to 1:4, more preferably 7:3 to 3:7, and particularly preferably 3:2 to 2:3. The polymer A and the polymer B may be used in combination of two or more thereof.

Recently, the inventors of the present invention have focused on the structure and combination of polymers in order to develop an electrophotographic photoreceptor in which the dispersibility of the filler such as fluorine atom-containing resin particles is not only excellent in the coating liquid for forming the outermost surface layer of the electrophotographic photoreceptor but also excellent in the outermost surface layer of the electrophotographic photoreceptor, and have conducted various studies on the effects of various polymers and combinations thereof.

As a result, in an electrophotographic photoreceptor including a photosensitive layer on a conductive support, by making the photosensitive layer contain at least the above polymer A and polymer B, a technique has been developed in which the dispersibility of the filler in the coating liquid for forming the outermost surface layer of the electrophotographic photoreceptor and the dispersibility of the filler in the outermost surface of the electrophotographic photoreceptor can be simultaneously improved.

Each of the polymer A and the polymer B contains a repeating structural unit represented by the Formula (2), and contains a structure capable of interacting with the surface of the filler. In addition, the polymer A contains a repeating structural unit represented by the Formula (1), while the polymer B does not contain a repeating structural unit represented by the Formula (1).

The reason why the effects of the present invention can be achieved is under intensive study, and is presumed as follows. In the state of the coating liquid for forming the outermost surface layer of the electrophotographic photoreceptor, when the polymer A contains the repeating structural unit represented by the Formula (1), the compatibility with other components such as a binder resin in the coating liquid is improved particularly by $R^3$.

In addition, among the repeating structural units represented by the Formula (1), $R^3$ mainly forms steric hindrance in the coating liquid, and contributes to preventing the aggregation of the filler. The polymer A and the polymer B each form an interaction with the filler, but since the polymer A is also excellent in compatibility with other components, the interaction between the polymer B and the filler is prioritized over the interaction between the polymer A and the filler. It is considered that the polymer B densely surrounds the surface of the filler and contributes to preventing the aggregation of the filler.

Since the polymer A and the polymer B contain a common repeating structural unit represented by the Formula (2), they exhibit high compatibility with each other. Therefore, it is considered that the dispersibility of the filler is improved by using the polymer A and the polymer B together.

In the process of producing the electrophotographic photoreceptor, there is a drying step after coating the coating liquid for forming the outermost surface layer of the electrophotographic photoreceptor. In the drying step, the solvent in the coating liquid gradually decreases, so that it is generally difficult to continue the state of preventing the aggregation of the filler due to the steric hindrance described above.

In the present invention, the surface of the filler is densely surrounded by the polymer B, and the polymer B and the polymer A are highly compatible. Therefore, it is considered that the aggregation of the filler due to the steric hindrance is continued, and as a result, the dispersibility of the filler in the outermost surface of the electrophotographic photoreceptor is also improved.

Here, it is known that when the filler is added to the electrophotographic photoreceptor, abrasion resistance is improved. On the other hand, when the filler is added, the image quality tends to deteriorate.

The reason why the image quality deteriorates when the filler is added to the photosensitive layer of the electrophotographic photoreceptor is not clear, and is considered as follows. When the filler is added to the photosensitive layer, the exposure light tends to be scattered. When the exposure light is scattered, a portion where the amount of light incident on the photosensitive layer is not uniform may occur even in the same electrophotographic photoreceptor. In particular, when an aggregate of fillers having a size of 10 μm or more is present, the degree of scattering is increased, and a portion where the amount of incident light is not uniform is remarkably generated.

The filler has extremely low charge transport ability. Therefore, the charge transport ability may differ between the portion where the filler is present and the portion where the filler is not present. Therefore, when the filler is added to the photosensitive layer, the charge mobility of the photosensitive layer tends to be not uniform even in the same electrophotographic photoreceptor. In particular, when an aggregate of fillers of 10 μm or more is present, the charge mobility of the photosensitive layer is significantly not uniform.

When the amount of incident light on the photosensitive layer is not uniform and the charge mobility of the photosensitive layer is not uniform, the photoinduced decay curve (PIDC) of the surface potential is also not uniform, making it difficult to obtain a desired electrostatic latent image. When the electrostatic latent image is disturbed, dot thickening, dot thinning, and dot omission are likely to occur, and the image quality deteriorates. In particular, when performing printing in a high resolution mode, the image quality deterioration tends to be noticeable.

However, it is considered that even when the filler is added, the image quality deterioration can be prevented as much as possible in a case where a dispersant is used in combination to improve the dispersibility of the filler. The reasons are as follows.

In order to obtain an image with good image quality, the PIDC needs to be uniform in a region having a dot size corresponding to the resolution.

Even when the dispersibility of the filler in the photosensitive layer is good, the PIDC is not uniform in a microscopic region. For example, in the case of 1200 dpi, which is a high resolution, the PIDC is almost uniform when viewed in a region of one dot size (about 20 $\mu m^2$). Therefore, even when performing printing in the high resolution mode, the image quality is good. On the other hand, when the dispersibility of the filler is poor, the PIDC tends to be not uniform even in a region of one dot size of 1200 dpi. Therefore, when performing printing at 1200 dpi, which is a high resolution, the image quality is more likely to be deteriorated as compared with a photoreceptor to which no filler is added and a case where the filler has good dispersibility.

Therefore, in the case of an electrophotographic photoreceptor not containing the polymer A nor the polymer B in the photosensitive layer but containing a filler, the dispersibility of the filler is poor, making it difficult to achieve high image quality at high resolution.

In a case where the photosensitive layer contains the polymer A and the filler, the repeating structural unit represented by the Formula (2) in the polymer A interacts with the surface of the filler, and the repeating structural unit (particularly, $R^3$) represented by the Formula (1) in the polymer A interacts with the binder resin. Therefore, the dispersibility of the filler in the photosensitive layer after drying the solvent is good.

However, the polymer A improves the dispersibility of the filler in the photosensitive layer after the solvent is dried, but the ability of the polymer A to prevent the aggregation of the filler in the coating liquid is not sufficient since the polymer A does not have a high affinity for the solvent. Thus, even when the coating liquid contains the polymer A, no improvement is seen in the dispersibility and filterability.

Therefore, the coating liquid containing the polymer A needs to be replaced with a filter paper many times for filtration, and thus the productivity tends to be low. Further, even when filtration is possible, the filler is trapped during the filtration, which causes the amount of the filler present in the outermost surface layer fluctuate even under the same conditions, and it is difficult to stabilize the quality.

In a case where the photosensitive layer contains the polymer B and the filler, the polymer B does not contain the repeating structural unit represented by the Formula (1), which is a structure capable of interacting with the binder resin. Therefore, no improvement in the dispersibility of the filler in the photosensitive layer is observed after solvent drying.

On the other hand, in a case where the photosensitive layer contains the polymer A, the polymer B, and the filler, the dispersibility of the filler in the coating liquid and in the photosensitive layer after drying the solvent is simultaneously improved. In the coating liquid, each of the polymer A and the polymer B contains the repeating structural unit represented by the Formula (2) interacting with the surface of the filler. On the other hand, the polymer A has excellent compatibility with the binder resin. Therefore, the interaction between the polymer B and the filler is prioritized over the interaction between the polymer A and the filler. Accordingly, it is considered that the polymer B densely surrounds the surface of the filler and contributes to preventing the aggregation of the filler.

In addition, since the polymer A and the polymer B contain a common repeating structural unit represented by the Formula (2), they exhibit high compatibility with each other. Therefore, it is considered that the dispersibility of the filler in the coating liquid is further improved. Even in the photosensitive layer after the solvent is dried, the state where the polymer A and the polymer B are highly compatible by using the polymer A and the polymer B together is maintained. Therefore, it is considered that the aggregation of the filler is continuously prevented, and the dispersibility of the filler is further improved.

Therefore, in the case where the photosensitive layer contains the polymer A, the polymer B, and the filler, the dispersibility of the filler in the photosensitive layer after drying the solvent is good, and simultaneously the dispersibility or filterability of the filler in the coating liquid is also good. Therefore, the filler is hardly captured during the filtration, and an appropriate amount of the filler is added. Thus, it is considered that the image quality deterioration is prevented even at high resolution.

The photosensitive layer used in the present invention may be a lamination type photosensitive layer in which a charge generation layer and a charge transport layer are sequentially laminated from the conductive support side, or may be a single-layer type photosensitive layer.

[Lamination Type Photosensitive Layer—Charge Generation Layer]

In the case where the photosensitive layer used in the present invention is a lamination type photosensitive layer (function separation type photosensitive layer), the charge generation layer is formed by binding a charge generation substance with a binder resin.

Examples of the charge generation substance include: inorganic photoconductive materials such as selenium and alloys thereof and cadmium sulfide; and organic photoconductive materials such as organic pigments. Preferred are organic photoconductive materials, and particularly preferred are organic pigments.

Examples of the organic pigments include a phthalocyanine pigment, an azo pigment, a dithioketopyrrolopyrrole pigment, a squalene (squarylium) pigment, a quinacridone pigment, an indigo pigment, a perylene pigment, a polycyclic quinone pigment, an anthanthrone pigment, and a benzimidazole pigment. Particularly preferred among these are a phthalocyanine pigment and an azo pigment. In a case of using the organic pigment as the charge generation substance, the organic pigment is used generally in the form of a dispersion layer in which fine particles of the organic pigment are bound with various binder resins.

In a case where the phthalocyanine pigment is used as the charge generation substance, specific examples thereof include: metal-free phthalocyanine; those having crystal forms of phthalocyanines in which metals such as copper, indium, gallium, tin, titanium, zinc, vanadium, silicon, germanium, and aluminum, and an oxide thereof, a halide thereof, a hydroxide thereof or an alkoxide thereof are coordinated; and phthalocyanine dimers using an oxygen atom or the like as a bridging atom.

Particularly preferred are crystal forms having high sensitivity including: X-form and τ-form metal-free phthalocyanines; A-form (also called β-form), B-form (also called α-form), and D-form (also called Y-form) titanyl phthalocyanines (other name: oxytitanium phthalocyanines); vanadyl phthalocyanines, chloroindium phthalocyanines; hydroxyindium phthalocyanines; II-form chlorogallium phthalocyanines; V-form hydroxygallium phthalocyanines; G-form and I-form μ-oxo-gallium phthalocyanine dimers; and II-form μ-oxo-aluminum phthalocyanine dimers.

Particularly preferred among these phthalocyanine pigments are: A-form (also called β-form) and B-form (also called α-form) titanyl phthalocyanines; D-form (Y-form) titanyl phthalocyanine characterized by showing a distinct peak at a diffraction angle 2θ (±0.2°) of 27.10 or 27.3° in X-ray powder diffractometry; II-form chlorogallium phthalocyanine; V-form hydroxygallium phthalocyanine characterized by having a most intense peak at 28.1°, having no peak at 26.2°, having a distinct peak at 28.1°, and having a half-value width W at 25.9° of $0.1° \leq W \leq 0.4°$; and G-form μ-oxo-gallium phthalocyanine dimers.

A single phthalocyanine pigment compound may be used alone, or a mixture of several phthalocyanine pigment compounds or a phthalocyanine pigment compound in a mixed-crystal state may be used. As a mixing or mixed crystal state of several phthalocyanine pigment compounds, the mixing of the respective constituent elements may be performed later, or a mixing or mixed crystal state may be generated in the production and treatment steps of a phthalocyanine compound such as synthesis, pigmentation, and crystallization.

Such treatments as known include an acid paste treatment, a grinding treatment, and a solvent treatment. Examples of methods for producing a mixing or a mixed crystal state include a method in which two kinds of crystals are mixed together and the resultant mixture is mechanically ground and made amorphous and is then subjected to a solvent treatment, thereby being converted into a specific crystalline state, as described in JP-A-H10-48859.

The binder resin to be used in the charge generation layer is not particularly limited. Examples thereof include: insulating resins such as polyvinyl acetal resins including a polyvinyl butyral resin, a polyvinyl formal resin, and a partly acetalized polyvinyl butyral resin in which the butyral moieties have been partly modified with formal or acetal, a polyarylate resin, a polycarbonate resin, a polyester resin, a modified ether polyester resin, a phenoxy resin, a polyvinyl chloride resin, a polyvinylidene chloride resin, a polyvinyl acetate resin, a polystyrene resin, an acrylic resin, a methacrylic resin, a polyacrylamide resin, a polyamide resin, a polyvinylpyridine resin, a cellulose resin, a polyurethane resin, an epoxy resin, a silicone resin, a polyvinyl alcohol resin, a polyvinylpyrrolidone resin, casein, vinyl chloride-vinyl acetate copolymers including a vinyl chloride-vinyl acetate copolymer, a hydroxy-modified vinyl chloride-vinyl acetate copolymer, a carboxyl-modified vinyl chloride-vinyl acetate copolymer, and a vinyl chloride-vinyl acetate-maleic anhydride copolymer, a styrene-butadiene copolymer, a vinylidene chloride-acrylonitrile copolymer, a styrene-alkyd resin, a silicone-alkyd resin, and a phenol-formaldehyde resin; and organic photoconductive polymers such as poly-N-vinylcarbazole, polyvinylanthracene, and polyvinyl perylene.

Among these, particularly preferred is a polyvinyl acetal resin, and a polyvinyl butyral resin is generally used as the polyvinyl acetal resin. These binder resins may be used alone, or may be used in combination of two or more thereof.

In the charge generation layer, regarding a blending ratio (mass) between the binder resin and the charge generation layer, the charge generation substance is generally 10 parts by mass or more, preferably 30 parts by mass or more, and is generally 1,000 parts by mass or less, preferably 500 parts by mass or less, relative to 100 parts by mass of the binder resin. The thickness of the charge generation layer is generally 0.1 μm or more, preferably 0.15 μm or more, and is generally 10 μm or less, preferably 0.6 μm or less.

When the blending ratio of the charge generation substance is too high, the stability of the coating liquid may decrease due to aggregation of the charge generation material or the like. On the other hand, when the blending ratio of the charge generation substance is too low, the sensitivity of the electrophotographic photoreceptor may decrease.

In the case of using the organic pigment as the charge generation substance, it is effective to reduce the particle size of the organic pigment to a particle size in a range of preferably 0.5 μm or less, more preferably 0.3 μm or less, and still more preferably 0.15 μm or less.

[Lamination Type Photosensitive Layer—Charge Transport Layer (Outermost Surface Layer)]

The charge transport layer of the lamination type photosensitive layer generally contains a charge transport substance and a binder resin, and may further contain other components as necessary. Among these, it is preferable that the charge transport layer is the outermost surface layer of the electrophotographic photoreceptor and further contains a polymer A, a polymer B and a filler.

Examples of the binder resin to be used in the charge transport layer include a butadiene resin, a styrene resin, a vinyl acetate resin, a vinyl chloride resin, an acrylate resin, a methacrylate resin, a vinyl alcohol resin, polymers and copolymers of vinyl compounds such as ethyl vinyl ether, a polyvinyl butyral resin, a polyvinyl formal resin, a partially modified polyvinyl acetal resin, a polycarbonate resin, a polyarylate resin, a polyester resin, a polyamide resin, a polyurethane resin, a cellulose ester resin, a phenoxy resin, a silicone resin, a silicone-alkyd resin, and a poly-N-vinylcarbazole resin. Among these, preferred are a polycarbonate resin and a polyarylate resin. These binder resins can also be used after being crosslinked by heat, light or the like using a suitable curing agent. These binder resins may be used alone, or may be used in combination of two or more thereof. Specific examples of a repeating structural unit suitable for the binder resin are shown below. In the present invention, Me represents a methyl group.

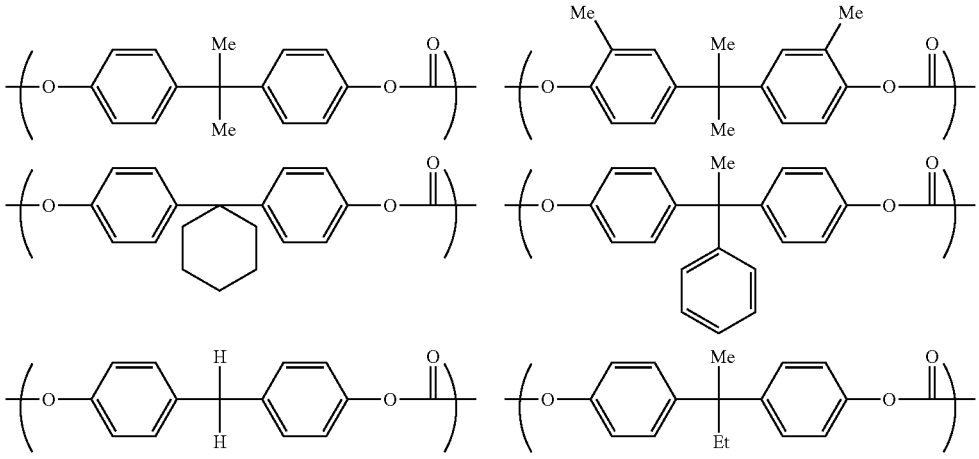

-continued

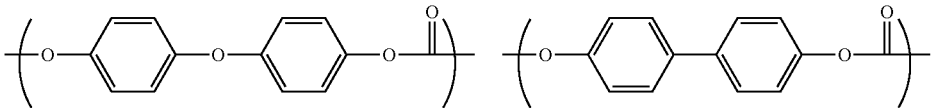

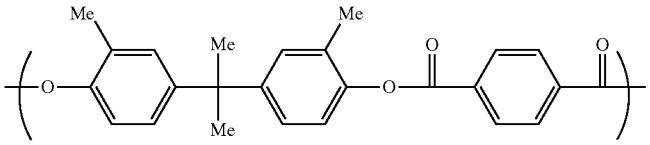

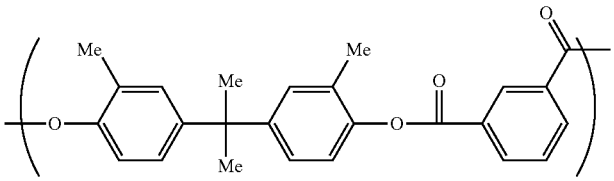

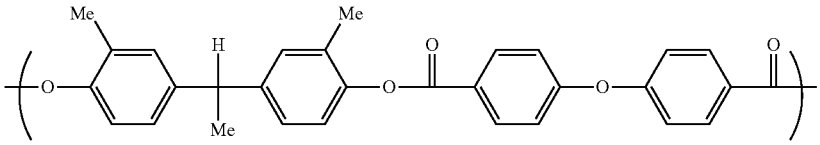

Among the above, the following repeating structural units are particularly preferred from the viewpoint of abrasion resistance.

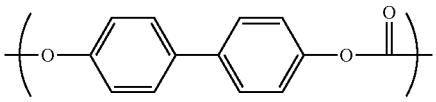

From the viewpoint of mechanical strength, the viscosity average molecular weight of the binder resin is generally 20,000 or more, preferably 30,000 or more, more preferably 40,000 or more, and still more preferably 50,000 or more. In addition, from the viewpoint of preparing a coating liquid for forming the photosensitive layer, the viscosity average molecular weight of the binder resin is generally 150,000 or less, preferably 120,000 or less, and more preferably 100,000 or less. The method for measuring the viscosity average molecular weight is as follows.

(Measurement Method)

A sample is dissolved in methylene chloride to prepare a solution having a concentration of 6.00 g/L. Using an Ubbelohde capillary viscometer with a solvent (methylene chloride) flow time to of 136.21 seconds, the flow time t of the sample solution is measured in a thermostatic water bath set at 20.0° C. The viscosity average molecular weight Mv is calculated according to the following equation.

$$a=0.438\times\eta sp+1$$

$$b=100\times\eta sp/C$$

$$\eta sp=t/t_0-1$$

$$C=6.00\ (g/L)$$

$$\eta=b/a$$

$$Mv=3207\times\eta 1.205$$

Examples of the charge transport substance include: electron transport materials including aromatic nitro compounds such as 2,4,7-trinitrofluorenone, cyano compounds such as tetracyanoquinodimethane, and quinone compounds such as diphenoquinone; and hole transport materials including heterocyclic compounds such as a carbazole derivative, an indole derivative, an imidazole derivative, an oxazole derivative, a pyrazole derivative, a thiadiazole derivative, and a benzofuran derivative, an aniline derivative, a hydrazone derivative, an aromatic amine derivative, a stilbene derivative, a butadiene derivative, an enamine derivative, a substance in which plural types of these compounds bind, and a polymer containing a group composed of these compounds in a main chain or a side chain.

Among these, from the viewpoint of electrical characteristics, preferred are a carbazole derivative, an aromatic amine derivative, a stilbene derivative, a butadiene derivative, an enamine derivative, and a substance in which plural kinds of these compounds bind. These charge transport substances may be used alone, or may be used in combination of two or more thereof. Specific examples of the structure of the charge transport substance are shown as follows. In the present invention, Et represents an ethyl group, and t-Bu represents a t-butyl group.

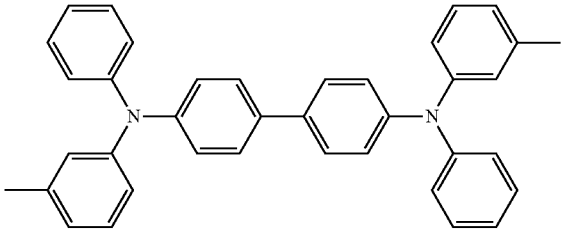
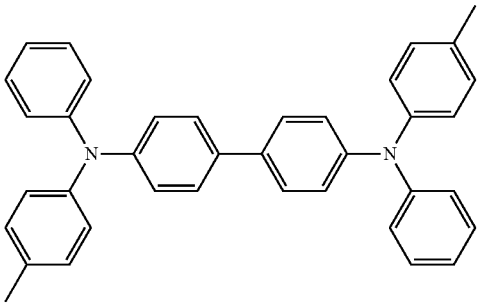
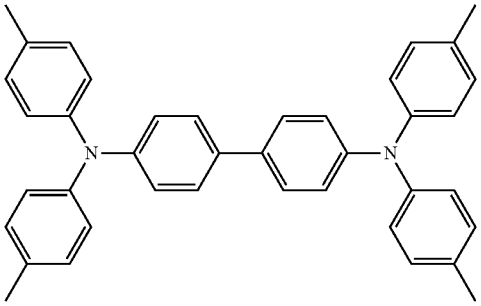
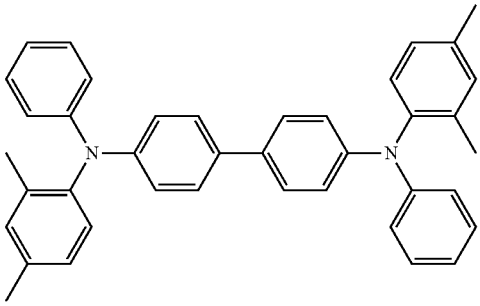
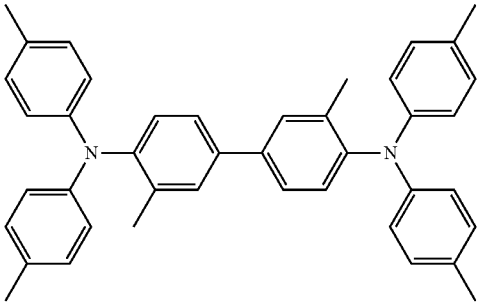
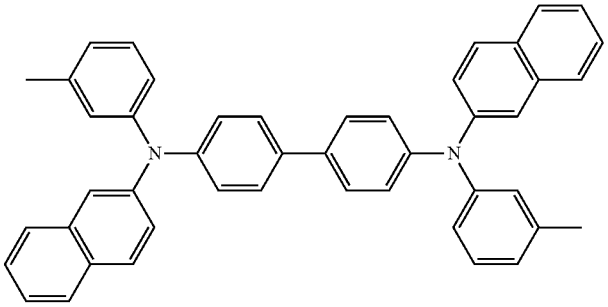
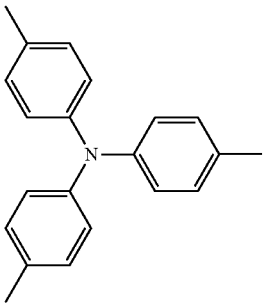
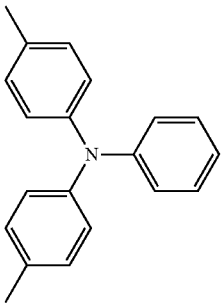
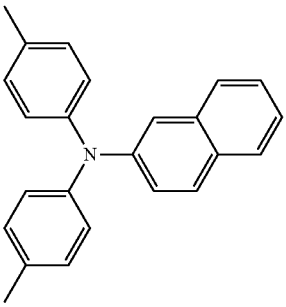
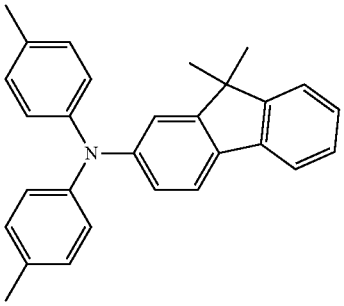
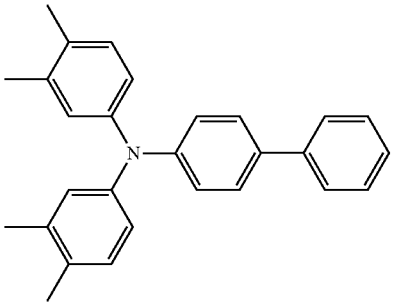

-continued
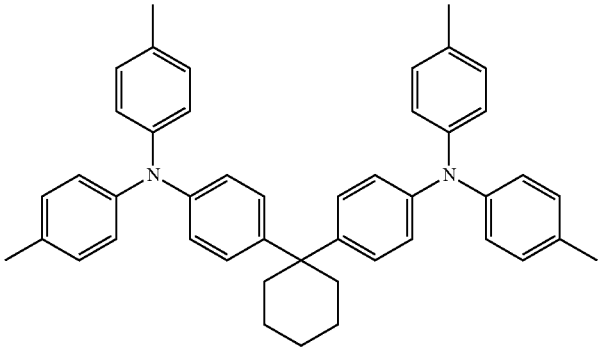
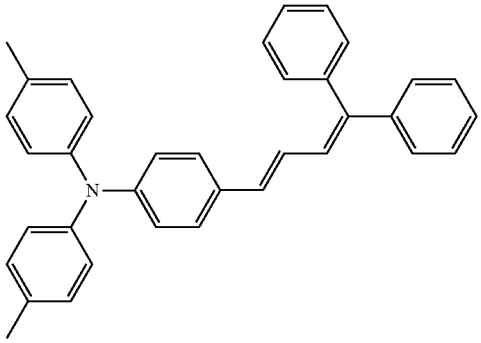
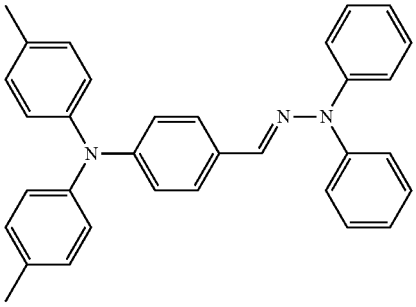
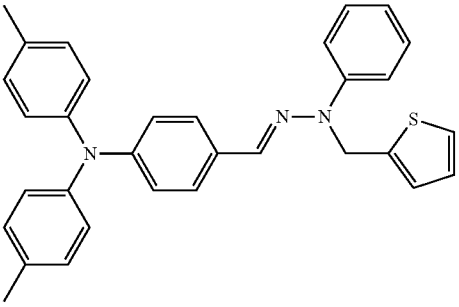
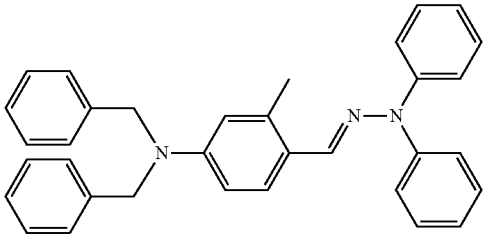
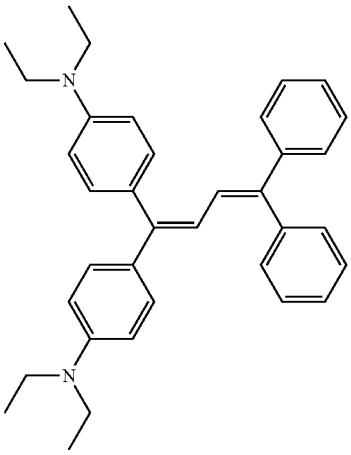
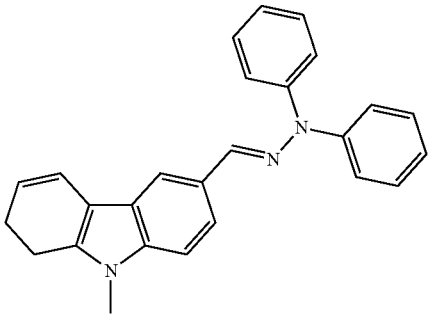
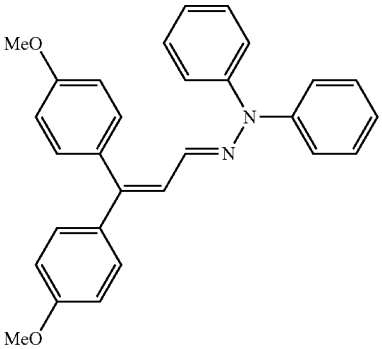
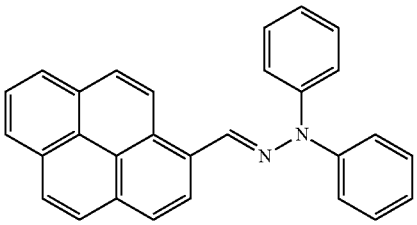
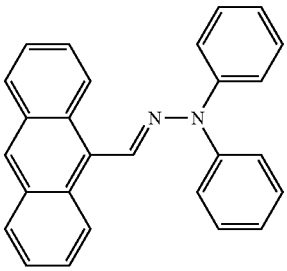

-continued
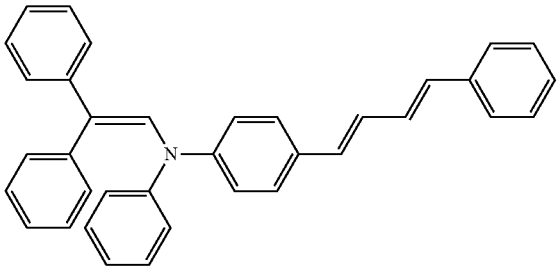
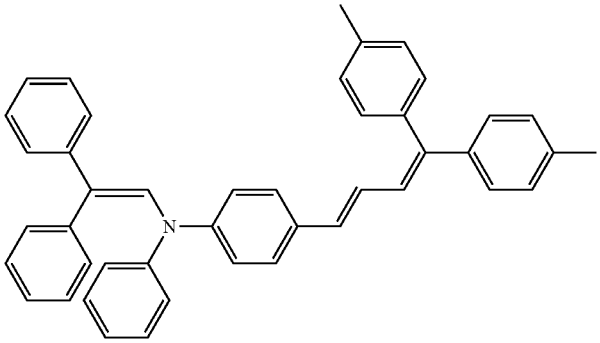
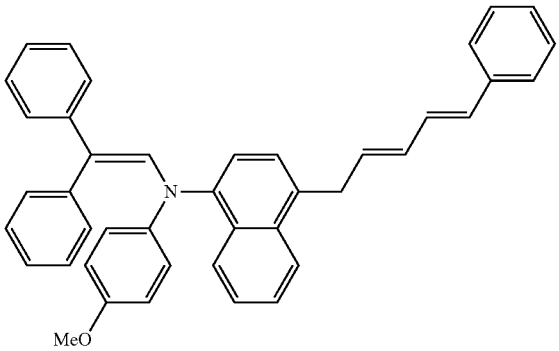
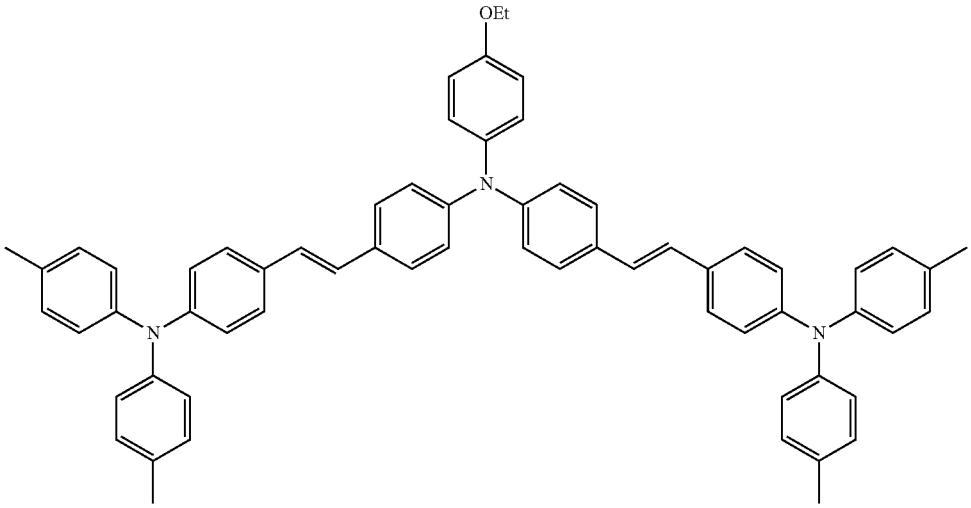

-continued
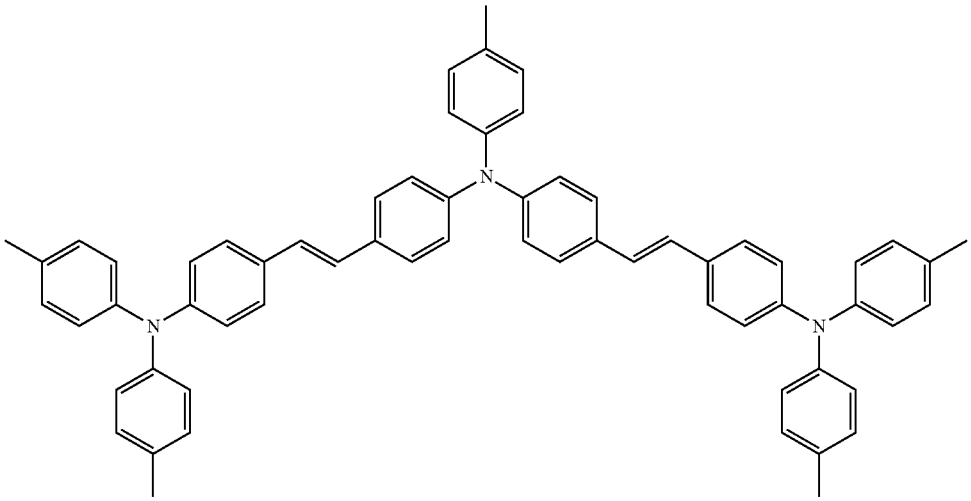
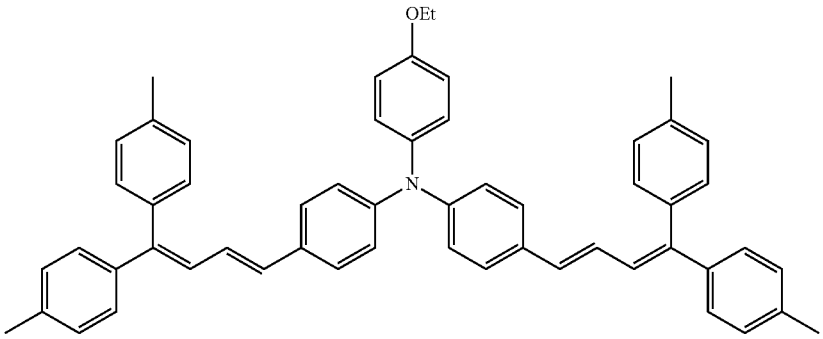
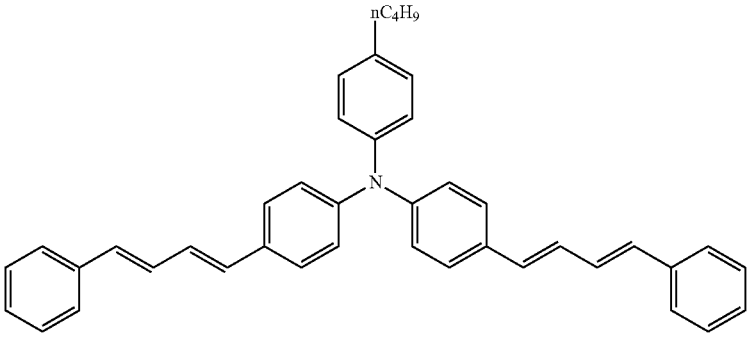
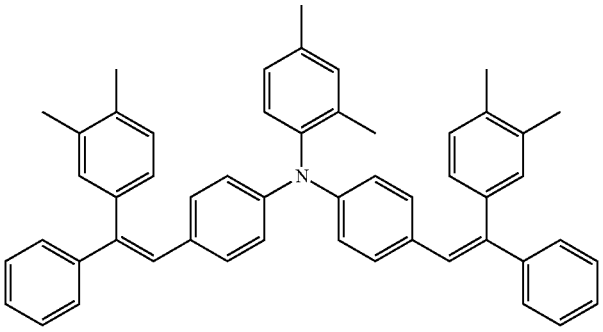

-continued
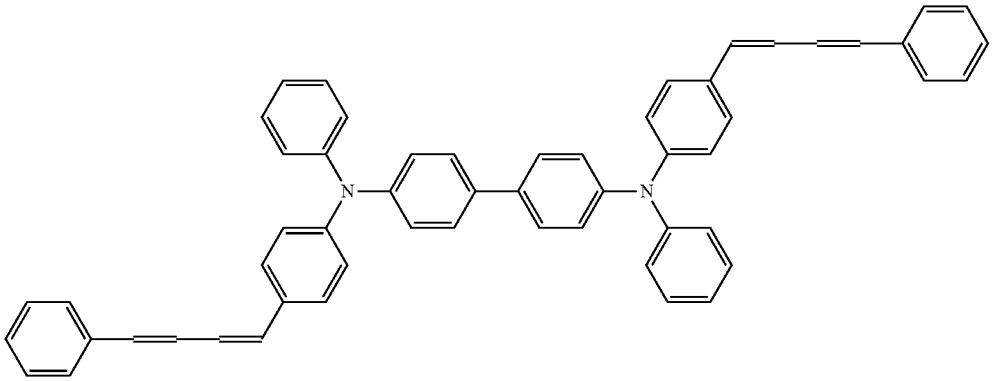
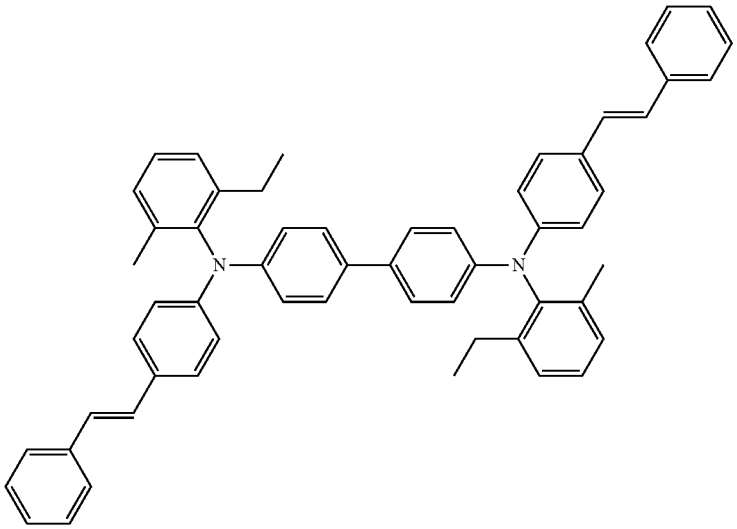
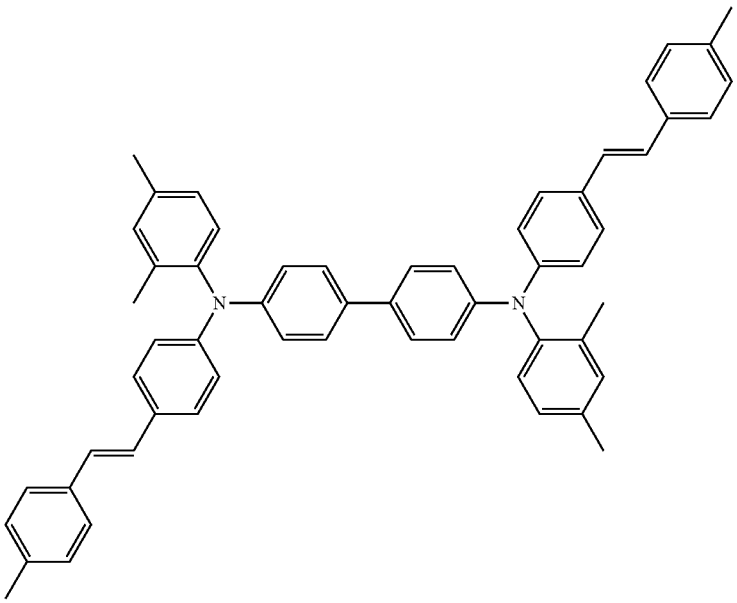

-continued
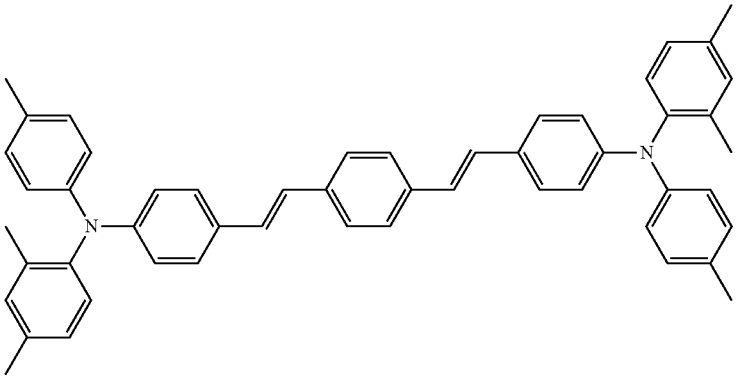
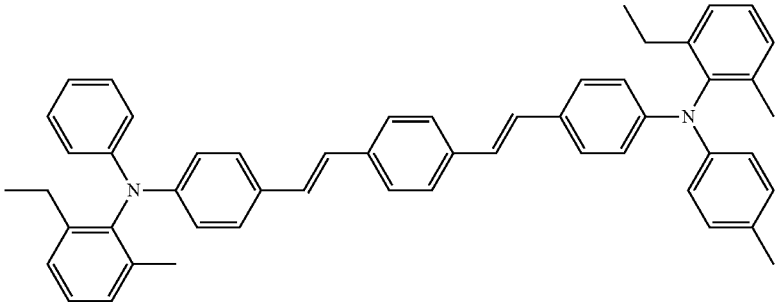
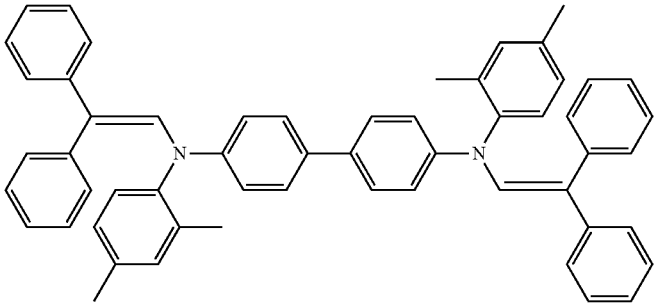
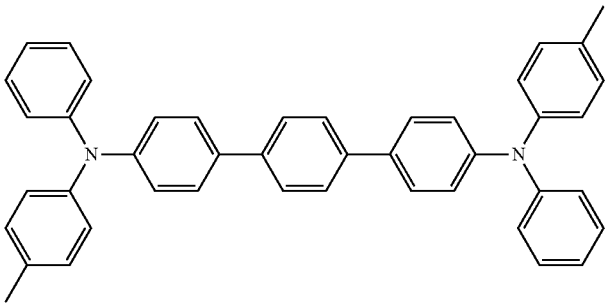
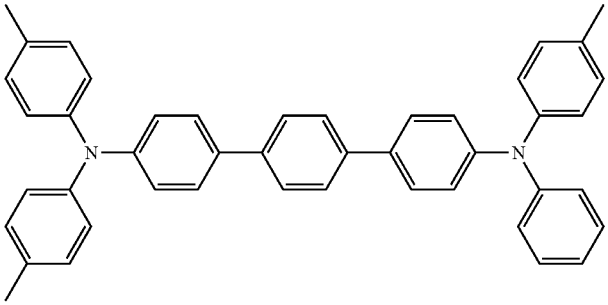

-continued
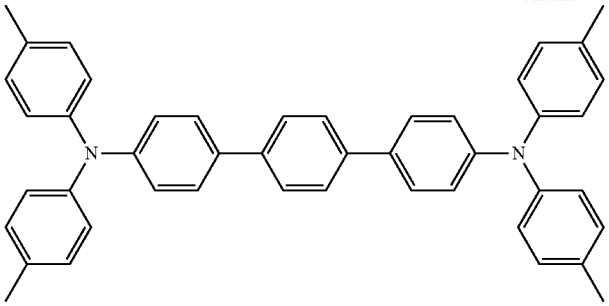
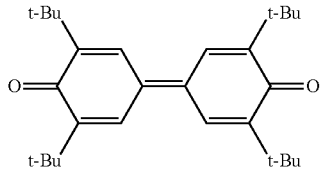
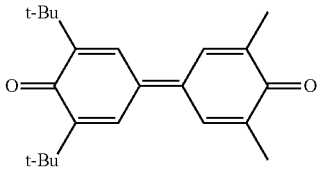
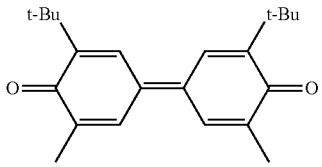
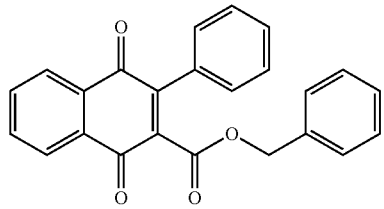
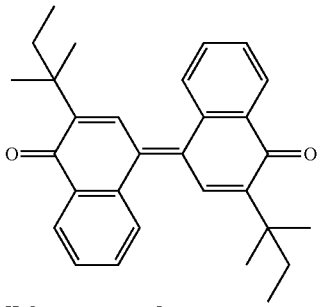
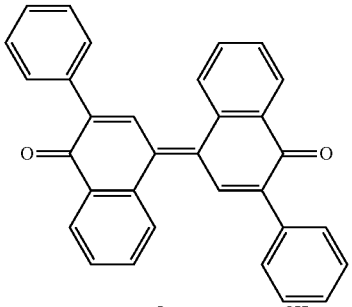
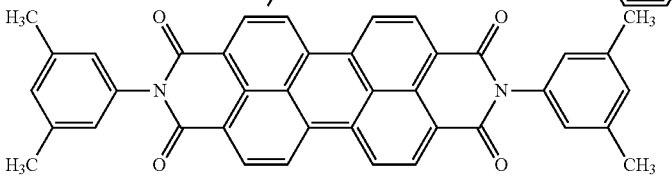
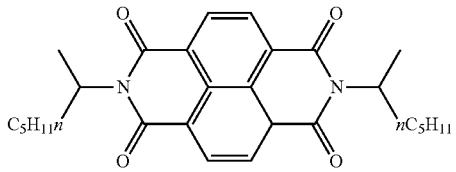
40
Among the above charge transport substances, the following compounds are preferred from the viewpoint of mobility.
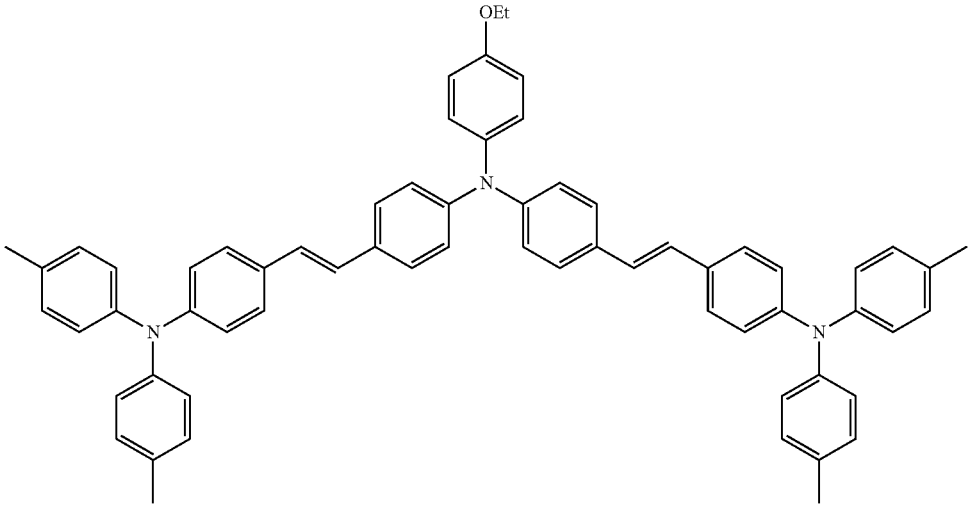

-continued
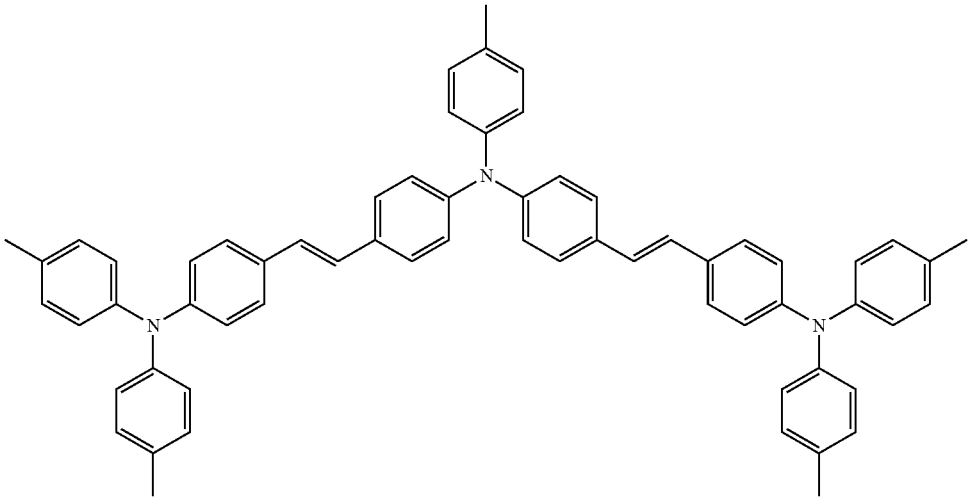
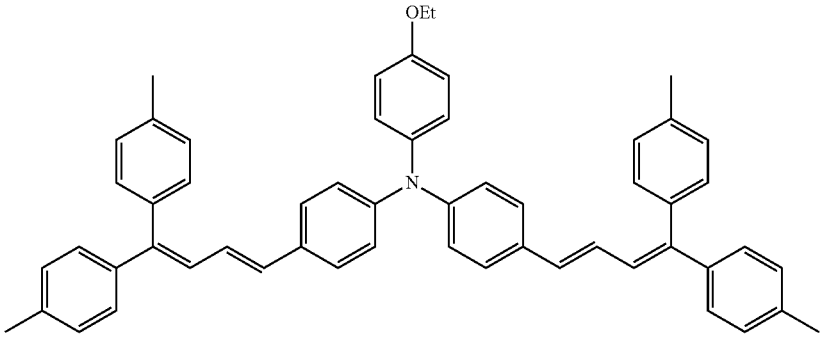
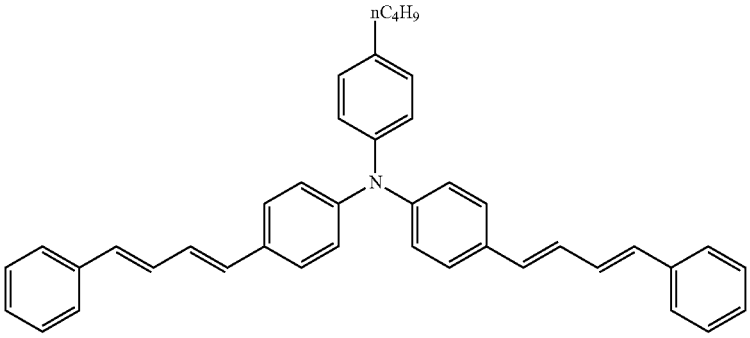
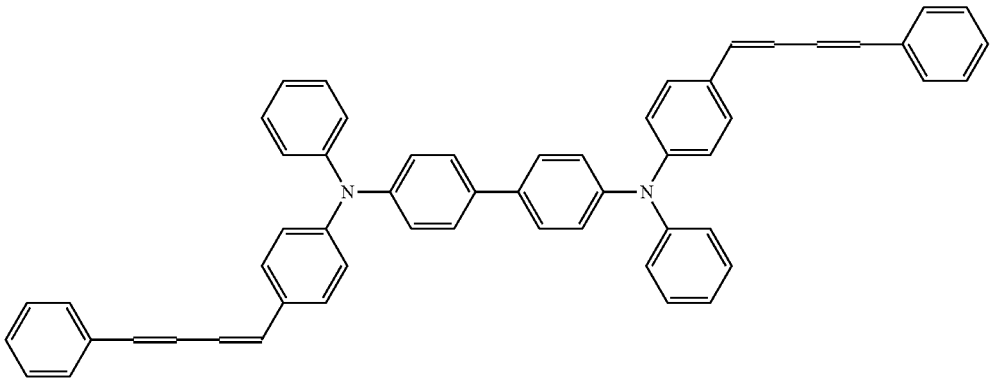

-continued
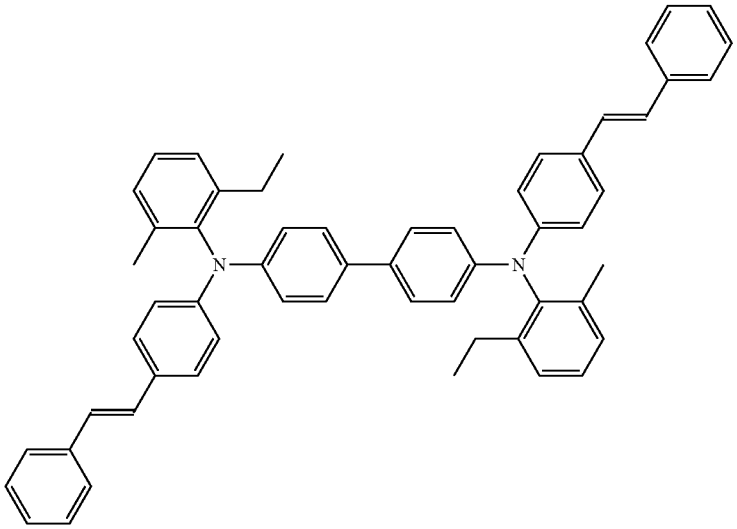
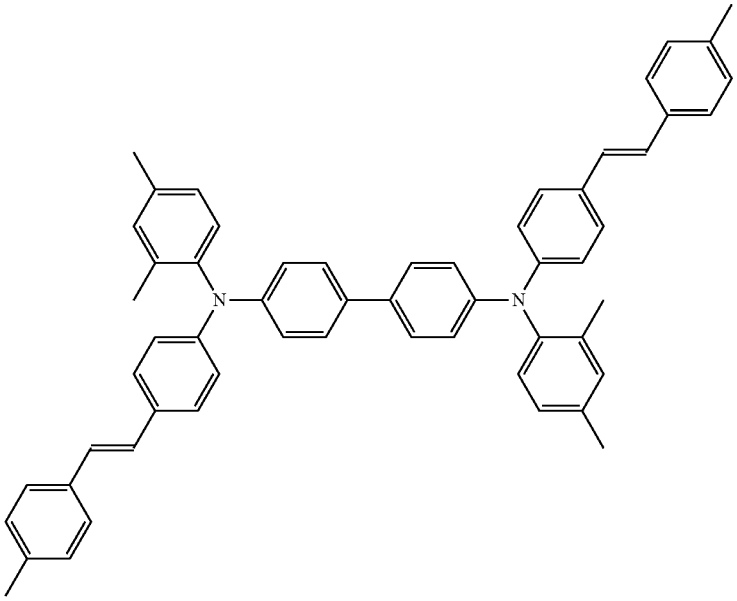
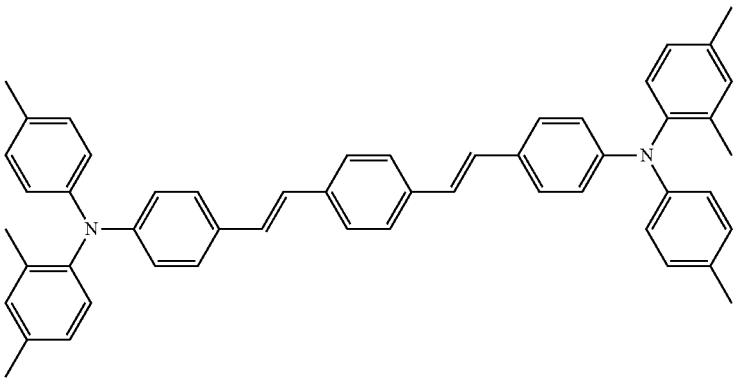

-continued
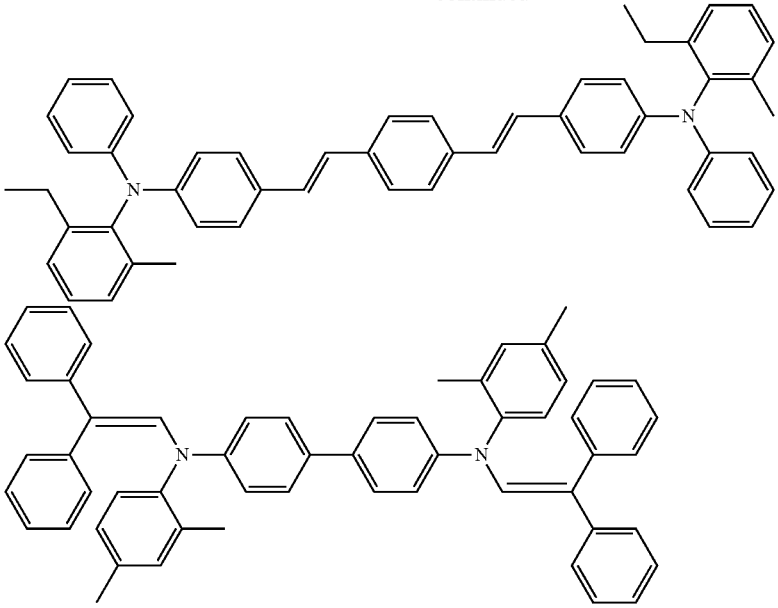
The following compounds are more preferred from the viewpoint of preventing reduction in chargeability due to repetition.
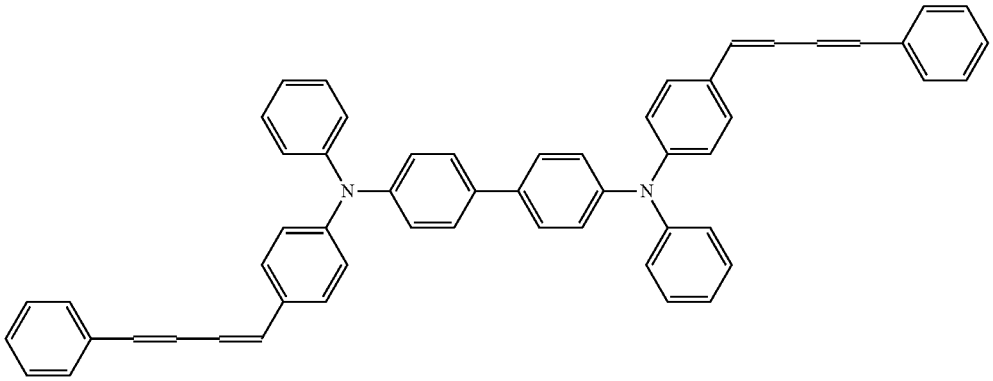
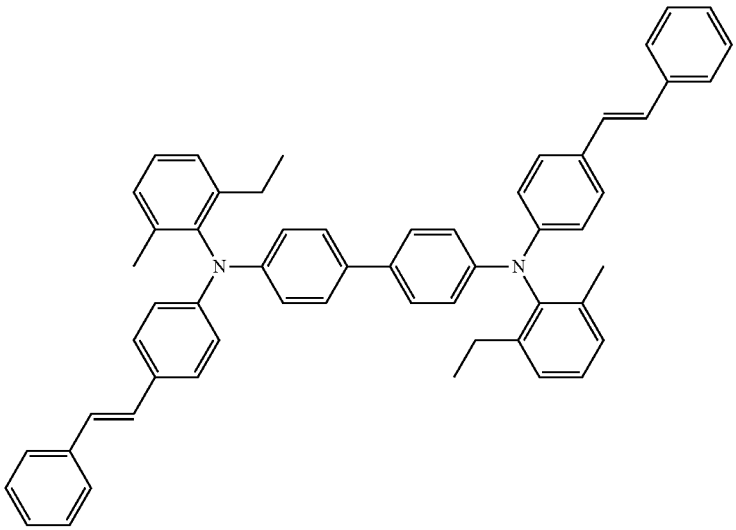

-continued

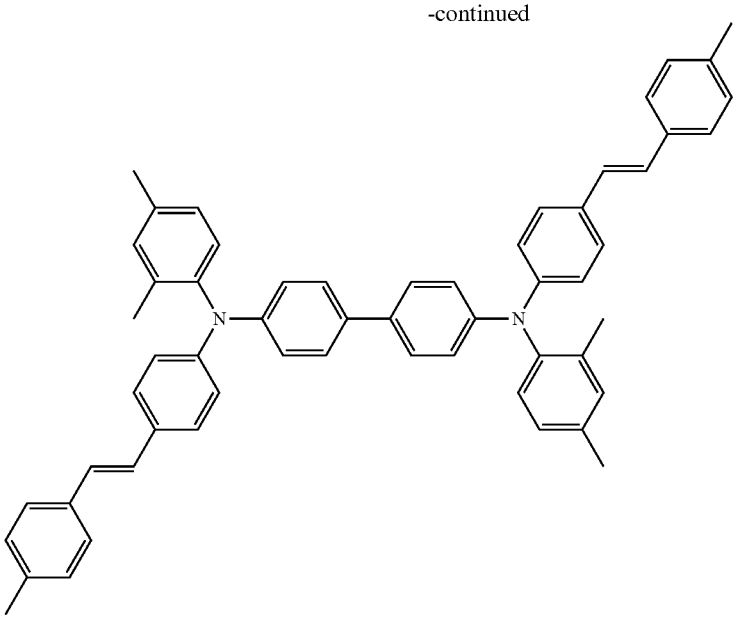

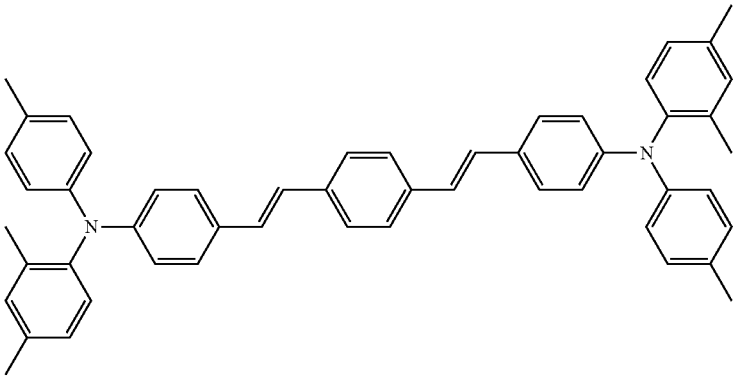

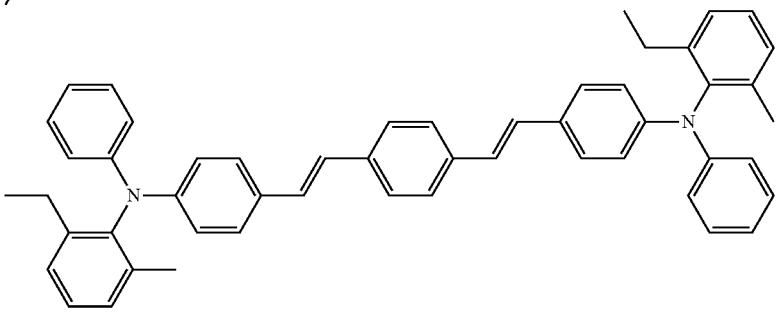

The ratio of the charge transport substance to be used is generally 20 parts by mass or more, preferably 30 parts by mass or more, and particularly preferably 40 parts by mass or more, relative to 100 parts by mass of the binder resin from the viewpoint of electrical characteristics. On the other hand, the ratio of the charge transport substance to be used is generally 100 parts by mass or less, preferably 90 parts by mass or less, and particularly preferably 80 parts by mass or less, relative to 100 parts by mass of the binder resin from the viewpoint of abrasion resistance.

The thickness of the charge transport layer is not particularly limited, and is generally 20 μm or more, preferably 30 μm or more from the viewpoint of long life, and is generally 50 μm or less, preferably 45 μm or less from the viewpoint of high resolution and coatability.

Both the lamination type photosensitive layer and the single-layer type photosensitive layer to be described later may contain additives such as known antioxidants, plasticizers, ultraviolet absorbers, electron withdrawing compounds, leveling agents, and visible light blocking agents in the photosensitive layer or each layer constituting the photosensitive layer, so as to improve the film forming property, flexibility, coatability, stain resistance, gas resistance, and light resistance.

[Single-Layer Type Photosensitive Layer (Outermost Surface Layer)]

In a case where the photosensitive layer used in the present invention is a single-layer type photosensitive layer, and the photosensitive layer is the outermost surface layer, the photosensitive layer contains a filler, a polymer A and a polymer B, a charge generation substance and a charge transport substance. The photosensitive layer generally further contains a binder resin, and may further contain other components as necessary.

The types of the charge transport substance and the ratio of the charge transport substance to the binder resin to be used are the same as those described for the charge transport layer of the lamination type photosensitive layer. A charge generation substance is further dispersed in a charge transport medium containing the charge transport substance and the binder resin. As the charge generation substance, those similar to those described for the charge generation layer of the lamination type photosensitive layer can be used.

In the case of the single-layer type photosensitive layer, the particle diameter of the charge generation substance is generally 1 μm or less, and preferably 0.5 μm or less. The amount of the charge generation substance dispersed in the single-layer type photosensitive layer is generally 0.5 mass % or more, and preferably 1 mass % or more relative to the entire single-layer type photosensitive layer. The amount of the charge generation substance is generally 50 mass % or less, and preferably 20 mass % or less.

Regarding the ratio of the charge generation substance to the binder resin to be used in the single-layer type photosensitive layer, the charge generation substance is generally 0.1 part by mass or more, and preferably 1 part by mass or more, relative to 100 parts by mass of the binder resin. In addition, the ratio of the charge generation substance to the binder resin to be used is generally 30 parts by mass or less, and preferably 10 parts by mass or less, relative to 100 parts by mass of the binder resin.

The thickness of the single-layer type photosensitive layer is generally 5 μm or more, and preferably 10 μm or more. In addition, the thickness is generally 100 μm or less, and preferably 50 μm or less.

[Undercoat Layer]

In order to improve the adhesiveness, the blocking property and the like, an undercoat layer may be provided between the conductive support and the photosensitive layer described above. As the undercoat layer, a resin or a resin in which particles of a metal oxide or the like is dispersed is used.

Examples of the particles of the metal oxide to be used in the undercoat layer include particles of a metal oxide containing one metallic element, such as titanium oxide, aluminum oxide, silicon oxide, zirconium oxide, zinc oxide, and iron oxide, and particles of a metal oxide containing a plurality of metallic elements, such as calcium titanate, strontium titanate, and barium titanate. These particles may be used alone or in combination of two or more thereof. Among these particles of a metal oxide, preferred are titanium oxide and aluminum oxide, and particularly preferred is titanium oxide.

The surface of the titanium oxide particle may be treated with inorganic materials such as tin oxide, aluminum oxide, antimony oxide, zirconium oxide, silicon oxide, or organic materials such as stearic acid, polyol, and silicone. As the crystal form of the titanium oxide particles, any of rutile, anatase, brookite, and amorphous can be used. In addition, a plurality of crystalline states may be included.

Further, the metal oxide particles having various particle diameters can be used. Among these, the average primary particle diameter of the metal oxide particles is generally 1 nm or more, and preferably 10 nm or more, from the viewpoints of electrical characteristics and the stability of a coating liquid for forming the undercoat layer. In addition, the average primary particle diameter of the metal oxide particles is generally 100 nm or less, and preferably 50 nm or less. The particle diameter of the metal oxide particles can be calculated based on the particle diameter measured from the observation region by observing the cut surface in the thickness direction of the undercoat layer with a transmission electron microscope (TEM).

The undercoat layer is preferably formed in a form in which metal oxide particles are dispersed in a binder resin. Examples of the binder resin to be used in the undercoat layer include resin materials such as polyvinyl acetal, a polyamide resin, a phenol resin, polyester, an epoxy resin, polyurethane, and polyacrylic acid. These binder resins may be used alone or in combination of two or more thereof.

Among these, preferred is a polyamide resin having excellent adhesiveness to the conductive support and having low solubility in the solvent used for the coating liquid for forming the charge generation layer. Among the polyamide resins, preferred is a copolymerized polyamide resin having a cycloalkane ring structure as a constituent component, and more preferred is a copolyamide resin having a cyclohexane ring structure as a component. Among these, particularly preferred is a copolyamide resin containing a diamine component represented by the following General Formula (41) as a constituent material.

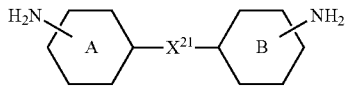

(41)

In the General Formula (41), A and B each independently represent a cyclohexane ring which may have a substituent, and $X^{21}$ represents a methylene group which may have a substituent.

The content of the metal oxide particles relative to the binder resin to be used in the undercoat layer can be optionally selected, and is generally 10 mass % or more, and preferably 500 mass % or less, from the viewpoint of the stability and coatability of the dispersion liquid.

The thickness of the undercoat layer can be optionally selected, and is generally 0.01 μm or more, preferably 0.1 μm or more, and is generally 30 μm or less, preferably 20 μm or less, from the viewpoint of improving photoreceptor characteristics and coatability.

The undercoat layer may contain a known antioxidant or the like. The undercoat layer may contain pigment particles, resin particles or the like for the purpose of preventing image defects.

[Case of Providing Protective Layer (Outermost Surface Layer) on Photosensitive Layer]

The photosensitive layer formed by the above procedure may be used as the outermost surface layer, or another layer may be further provided thereon and used as the outermost surface layer. For example, a protective layer may be provided for the purpose of preventing abrasion of the photosensitive layer or preventing and reducing deterioration of the photosensitive layer due to a discharge product generated from a charger or the like. However, the photosensitive layer is preferably a surface layer from the viewpoint that the number of production steps can be reduced.

The protective layer can be formed by, for example, incorporating a conductive material into an appropriate binder resin, or using a copolymer using a compound having a charge transport ability, such as a triphenylamine skeleton described in JP-A-H09-190004.

In a case where the protective layer is provided on the photosensitive layer, the polymer A and the polymer B may be added to the protective layer.

The protective layer preferably further contains a filler and a binder resin. In a case where the protective layer is the outermost surface layer of the electrophotographic photoreceptor, the content of the filler in the outermost surface layer is the same as the content of the filler in the outermost surface layer in a case where the photosensitive layer in the lamination type photosensitive layer is the outermost surface layer.

The thickness of the protective layer is generally 1 μm or more, preferably 3 μm or more from the viewpoint of life, and is preferably 15 μm or less, more preferably 10 μm or less from the viewpoint of electrical characteristics.

[Method for Forming Electrophotographic Photoreceptor]

In order to form the electrophotographic photoreceptor of the present invention, first, a coating liquid is prepared by dissolving or dispersing a substance contained in an undercoat layer provided as necessary and a photosensitive layer constituting an electrophotographic photoreceptor in a solvent. Then, the obtained coating liquid is repeatedly coated and dried on the conductive support for each layer by known methods such as dip coating, spray coating, nozzle coating, bar coating, roll coating, and blade coating, so as to form the electrophotographic photoreceptor of the present invention. When forming the outermost surface layer of the electrophotographic photoreceptor of the present invention, the above filler dispersion liquid may be added in preparing the coating liquid.

The solvent or dispersion medium to be used in preparation of the coating liquid is not particularly limited, and specific examples thereof include: alcohols such as methanol, ethanol, propanol, and 2-methoxyethanol; ethers such as tetrahydrofuran, 1,4-dioxane, and dimethoxyethane; esters such as methyl formate and ethyl acetate; ketones such as acetone, methyl ethyl ketone and cyclohexanone; aromatic hydrocarbons such as benzene, toluene and xylene; chlorinated hydrocarbons such as dichloromethane, chloroform, 1,2-dichloroethane, 1,1,2-trichloroethane, 1,1,1-trichloroethane, tetrachloroethane, 1,2-dichloropropane, and trichlorethylene; nitrogen-containing compounds such as n-butylamine, isopropanolamine, diethylamine, triethanolamine, ethylene diamine, and triethylenediamine; and aprotic polar solvents such as acetonitrile, N-methyl pyrrolidone, N,N-dimethylformamide, and dimethyl sulfoxide. These solvents or dispersion media may be used alone or in combination of two or more thereof.

The amount of the solvent or dispersion medium to be used is not particularly limited, and is preferably adjusted, as appropriate, according to the intended purpose of each layer and nature of the selected solvent and dispersion medium, so as to set properties such as the solid content concentration or viscosity of the coating liquid, into desired ranges.

For example, in the case of producing a single-layer type photosensitive layer, and a charge transport layer of lamination type photosensitive layer, the solid content concentration of the coating liquid is in a range of generally 5 mass % or more, preferably 10 mass % or more, and generally 40 mass % or less, preferably 35 mass % or less. In addition, the viscosity of the coating liquid in this case is in a range of generally 100 mPa·s or more, preferably 300 mPa·s or more, and generally 2,000 mPa·s or less, preferably 1,500 mPa·s or less.

In addition, in the case of producing a charge generation layer of the lamination type photosensitive layer, the solid content concentration of the coating liquid is in a range of generally 0.1 mass % or more, preferably 1 mass % or more, and generally 15 mass % or less, preferably 10 mass % or less. In addition, the viscosity of the coating liquid in this case is in a range of generally 0.01 mPa·s or more, preferably 0.1 mPa·s or more, and generally 20 mPa·s or less, preferably 10 mPa·s or less.

Examples of a method for coating the coating liquid include a dip coating method, a spray coating method, a spinner coating method, a bead coating, a wire bar coating method, a blade coating method, a roller coating method, an air-knife coating method, and a curtain coating method, and other known coating methods can also be used.

<Image Forming Apparatus and Electrophotographic Photoreceptor Cartridge>

The image forming apparatus of the present invention such as a copying machine and a printer including the electrophotographic photoreceptor of the present invention includes at least respective units for performing respective processes of charging, exposure, development, transfer, and static elimination, and as each process, any of the methods commonly used in each process may be used.

As shown in FIG. 1, the image forming apparatus of the present invention includes an electrophotographic photoreceptor 1, a charging device 2, an exposure device 3, and a developing device 4, and may further include, as necessary, a transfer device 5, a cleaning device 6, and a fixing device 7.

The developing device 4 includes a toner T, a developing tank 41, an agitator 42, a supply roller 43, a developing roller 44, and a regulating member 45. The fixing device 7 includes an upper fixing member 71, a lower fixing member 72, and a heating device 73.

The electrophotographic photoreceptor cartridge of the present invention can be produced by combining the electrophotographic photoreceptor 1 with at least one selected from the group consisting of the charging device 2, the exposure device 3, the developing device 4, the transfer device 5, the cleaning device 6, and the fixing device 7.

The electrophotographic photoreceptor cartridge of the present invention may be configured to be detachable from an image forming apparatus body such as a copying machine or a printer. When the electrophotographic photoreceptor cartridge of the present invention is detachable, for example, in a case where the member of the electrophotographic photoreceptor cartridge of the present invention is deteriorated, the electrophotographic photoreceptor cartridge of the present invention can be removed and another electrophotographic photoreceptor cartridge can be mounted, so that maintenance and management of the image forming apparatus can be performed easily.

EXAMPLES

Hereinafter, the present invention will be described in more detail with reference to Examples and Comparative Examples, but the present invention is not limited thereto unless the gist is exceeded. "Parts" used in Examples are "parts by mass" unless otherwise specified.

<Preparation of Tetrafluoroethylene Resin Particle Dispersion Slurry P1>

A ultrasonic dispersion treatment was performed on 10 parts of tetrafluoroethylene resin particles (KTL-500F manufactured by Kitamura Limited) having an average primary particle diameter of submicron and 90 parts of tetrahydrofuran for one hour using an ultrasonic transmitter with a frequency of 25 kHz and an output of 600 W, to obtain a pre-dispersed slurry. The obtained slurry was subjected to a treatment for 10 passes at 70 MPa by a high-pressure liquid collision machine (Starburst Lab Manufactured by Sugino Machine Co., Ltd.) to prepare a tetrafluoroethylene resin particle dispersion slurry P1.

<Preparation of Tetrafluoroethylene Resin Particle Dispersion Slurry P2>

A ultrasonic dispersion treatment was performed on 10 parts of tetrafluoroethylene resin particles (KTL-500F manufactured by Kitamura Limited) having an average primary particle diameter of submicron, 0.25 part of a copolymer (I) represented by the following structural formula (I), and 89.75 parts of tetrahydrofuran for one hour using an ultrasonic transmitter with a frequency of 25 kHz and an output of 600 W, to obtain a pre-dispersed slurry. The obtained slurry was subjected to a treatment for 10 passes at 70 MPa by a high-pressure liquid collision machine (Starburst Lab Manufactured by Sugino Machine Co., Ltd.) to prepare a tetrafluoroethylene resin particle dispersion slurry P2.

STRUCTURAL FORMULA (I)

(Z1-1)

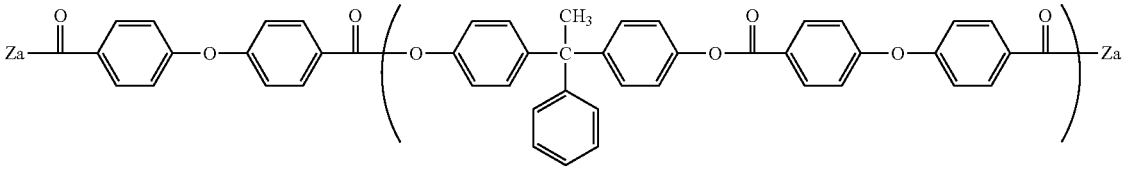

(Z1-2)

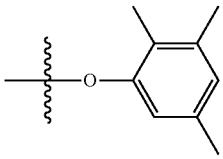

(Z1-3)

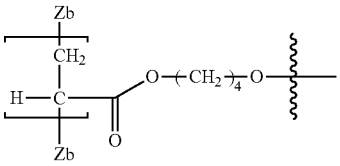

(Z1-4)

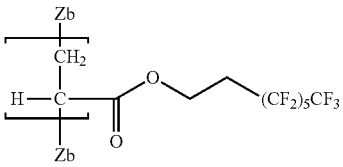

(Z1-5)

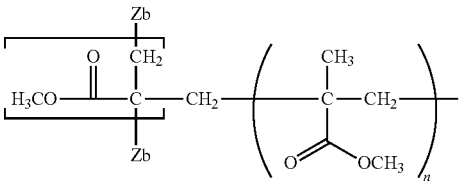

In the binding site Za in (Z1-1), (Z1-2) or (Z1-3) is independently present, and in the binding sites Zb in (Z1-3), (Z1-4) and (Z1-5), Zbs are present independently by binding each other. In addition, (Z1-1):(Z1-4):(Z1-5)=55:40:5 (mass ratio), and n represents the average number of repeating units, n being 35.

<Preparation of Tetrafluoroethylene Resin Particle Dispersion Slurry P3>

A ultrasonic dispersion treatment was performed on 10 parts of tetrafluoroethylene resin particles (KTL-500F manufactured by Kitamura Limited) having an average primary particle diameter of submicron, 0.25 part of the copolymer (I) represented by the above structural formula (I), 0.25 part of GF-400 having the following structural formula (manufactured by Toagosei Co., Ltd.), and 89.5 parts of tetrahydrofuran for one hour using an ultrasonic transmitter with a frequency of 25 kHz and an output of 600 W, to obtain a pre-dispersed slurry. The obtained slurry was subjected to a treatment for 10 passes at 70 MPa by a high-pressure liquid collision machine (Starburst Lab Manufactured by Sugino Machine Co., Ltd.) to prepare a tetrafluoroethylene resin particle dispersion slurry P3.

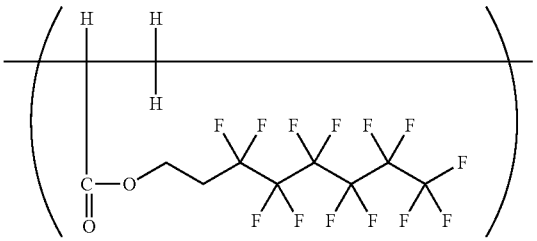

-continued

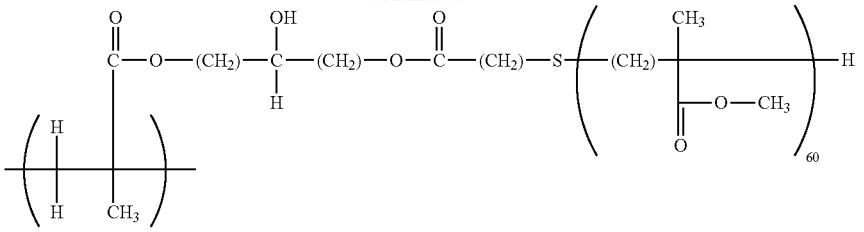

<Preparation of Tetrafluoroethylene Resin Particle Dispersion Slurry P4>

A Ultrasonic Dispersion Treatment was Performed on 10 Parts of Tetrafluoroethylene resin particles (KTL-500F manufactured by Kitamura Limited) having an average primary particle diameter of submicron, 0.5 part of the copolymer (I) represented by the above structural formula (I), and 89.5 parts of tetrahydrofuran for one hour using an ultrasonic transmitter with a frequency of 25 kHz and an output of 600 W, to obtain a pre-dispersed slurry. The obtained slurry was subjected to a treatment for 10 passes at 70 MPa by a high-pressure liquid collision machine (Starburst Lab Manufactured by Sugino Machine Co., Ltd.) to prepare a tetrafluoroethylene resin particle dispersion slurry P4.

<Preparation of Tetrafluoroethylene Resin Particle Dispersion Slurry P5>

A ultrasonic dispersion treatment was performed on 10 parts of tetrafluoroethylene resin particles (KTL-500F manufactured by Kitamura Limited) having an average primary particle diameter of submicron, 0.5 part of GF-400 (manufactured by Toagosei Co., Ltd.) and 89.5 parts of tetrahydrofuran for one hour using an ultrasonic transmitter with a frequency of 25 kHz and an output of 600 W, to obtain a pre-dispersed slurry. The obtained slurry was subjected to a treatment for 10 passes at 70 MPa by a high-pressure liquid collision machine (Starburst Lab Manufactured by Sugino Machine Co., Ltd.) to prepare a tetrafluoroethylene resin particle dispersion slurry P5.

<Preparation of Tetrafluoroethylene Resin Particle Dispersion Slurry P6>

A ultrasonic dispersion treatment was performed on 10 parts of tetrafluoroethylene resin particles (KTL-500F manufactured by Kitamura Limited) having an average primary particle diameter of submicron, 0.5 part of the copolymer (I) represented by the above structural formula (I), 0.5 part of GF-400 (manufactured by Toagosei Co., Ltd.), and 89 parts of tetrahydrofuran for one hour using an ultrasonic transmitter with a frequency of 25 kHz and an output of 600 W, to obtain a pre-dispersed slurry. The obtained slurry was subjected to a treatment for 10 passes at 70 MPa by a high-pressure liquid collision machine (Starburst Lab Manufactured by Sugino Machine Co., Ltd.) to prepare a tetrafluoroethylene resin particle dispersion slurry P6.

<Preparation of Tetrafluoroethylene Resin Particle Dispersion Slurry P7>

A ultrasonic dispersion treatment was performed on 10 parts of tetrafluoroethylene resin particles (KTL-500F manufactured by Kitamura Limited) having an average primary particle diameter of submicron, 1.0 part of the copolymer (I) represented by the above structural formula (I), and 89 parts of tetrahydrofuran for one hour using an ultrasonic transmitter with a frequency of 25 kHz and an output of 600 W, to obtain a pre-dispersed slurry. The obtained slurry was subjected to a treatment for 10 passes at 70 MPa by a high-pressure liquid collision machine (Starburst Lab Manufactured by Sugino Machine Co., Ltd.) to prepare a tetrafluoroethylene resin particle dispersion slurry P7.

<Preparation of Tetrafluoroethylene Resin Particle Dispersion Slurry P8>

A ultrasonic dispersion treatment was performed on 10 parts of tetrafluoroethylene resin particles (KTL-500F manufactured by Kitamura Limited) having an average primary particle diameter of submicron, 1.0 part of GF-400 (manufactured by Toagosei Co., Ltd.) and 89 parts of tetrahydrofuran for one hour using an ultrasonic transmitter with a frequency of 25 kHz and an output of 600 W, to obtain a pre-dispersed slurry. The obtained slurry was subjected to a treatment for 10 passes at 70 MPa by a high-pressure liquid collision machine (Starburst Lab Manufactured by Sugino Machine Co., Ltd.) to prepare a tetrafluoroethylene resin particle dispersion slurry P8.

<Preparation of Tetrafluoroethylene Resin Particle Dispersion Slurry P9>

A ultrasonic dispersion treatment was performed on 10 parts of tetrafluoroethylene resin particles (KTL-500F manufactured by Kitamura Limited) having an average primary particle diameter of submicron, 0.25 part of a copolymer (II) represented by the following structural formula (II), 0.25 part of the copolymer (I) represented by the above structural formula (I), and 89.5 parts of tetrahydrofuran for one hour using an ultrasonic transmitter with a frequency of 25 kHz and an output of 600 W, to obtain a pre-dispersed slurry. The obtained slurry was subjected to a treatment for 10 passes at 70 MPa by a high-pressure liquid collision machine (Starburst Lab Manufactured by Sugino Machine Co., Ltd.) to prepare a tetrafluoroethylene resin particle dispersion slurry P9.

STRUCTURAL FORMULA (II)

(Z1-4)

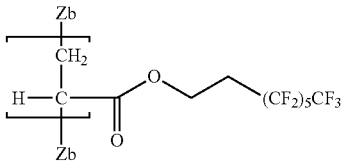

(Z1-5)

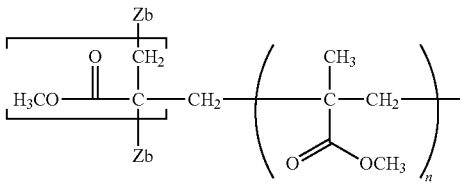

-continued (Z1-6)

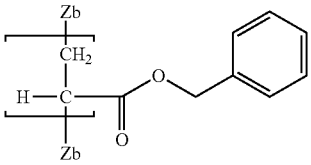

(Z1-7)

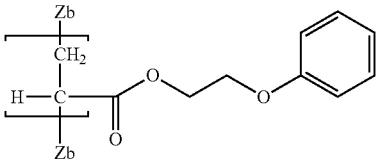

In the binding sites Zb in (Z1-4), (Z1-5), (Z1-6) and (Z1-7), Zbs are present independently by binding each other. In addition, (Z1-4):(Z1-5):(Z1-6):(Z1-7)=40:50:5:5 (mass ratio), and n represents the average number of repeating units, n being 35.

<Preparation of Tetrafluoroethylene Resin Particle Dispersion Slurry P10>

A ultrasonic dispersion treatment was performed on 10 parts of tetrafluoroethylene resin particles (KTL-500F manufactured by Kitamura Limited) having an average primary particle diameter of submicron, 0.5 part of the copolymer (II) represented by the above structural formula (II), and 89.5 parts of tetrahydrofuran for one hour using an ultrasonic transmitter with a frequency of 25 kHz and an output of 600 W, to obtain a pre-dispersed slurry. The obtained slurry was subjected to a treatment for 10 passes at 70 MPa by a high-pressure liquid collision machine (Starburst Lab Manufactured by Sugino Machine Co., Ltd.) to prepare a tetrafluoroethylene resin particle dispersion slurry P10.

<Preparation of Tetrafluoroethylene Resin Particle Dispersion Slurry P11>

A ultrasonic dispersion treatment was performed on 10 parts of tetrafluoroethylene resin particles (KTL-500F manufactured by Kitamura Limited) having an average primary particle diameter of submicron, 0.25 part of a copolymer (III) represented by the following structural formula (III), 0.25 part of the copolymer (I) represented by the above structural formula (I), and 89.5 parts of tetrahydrofuran for one hour using an ultrasonic transmitter with a frequency of 25 kHz and an output of 600 W, to obtain a pre-dispersed slurry. The obtained slurry was subjected to a treatment for 10 passes at 70 MPa by a high-pressure liquid collision machine (Starburst Lab Manufactured by Sugino Machine Co., Ltd.) to prepare a tetrafluoroethylene resin particle dispersion slurry P11.

STRUCTURAL FORMULA (III)

(Z1-4)

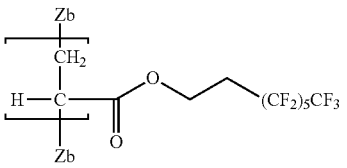

-continued (Z1-5)

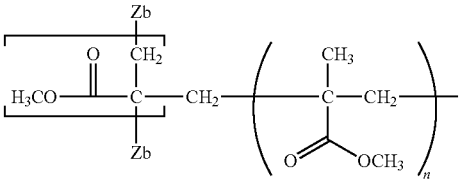

(Z1-6)

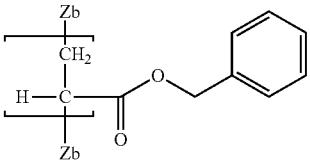

(Z1-7)

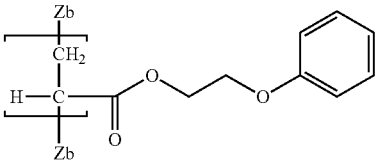

In the binding sites Zb in (Z1-4), (Z1-5), (Z1-6) and (Z1-7), Zbs are present independently by binding each other. In addition, (Z1-4):(Z1-5):(Z1-6):(Z1-7)=45:45:5:5 (mass ratio), and n represents the average number of repeating units, n being 35.

<Preparation of Tetrafluoroethylene Resin Particle Dispersion Slurry P12>

A ultrasonic dispersion treatment was performed on 10 parts of tetrafluoroethylene resin particles (KTL-500F manufactured by Kitamura Limited) having an average primary particle diameter of submicron, 0.5 part of the copolymer (III) represented by the above structural formula (III), and 89.5 parts of tetrahydrofuran for one hour using an ultrasonic transmitter with a frequency of 25 kHz and an output of 600 W, to obtain a pre-dispersed slurry. The obtained slurry was subjected to a treatment for 10 passes at 70 MPa by a high-pressure liquid collision machine (Starburst Lab Manufactured by Sugino Machine Co., Ltd.) to prepare a tetrafluoroethylene resin particle dispersion slurry P12.

TABLE 1

| Tetrafluoroethylene resin particle dispersion slurry | Polymer A [part by mass] | Polymer B [part by mass] |
|---|---|---|
| P1 | x | x |
| P2 | Copolymer (I) [0.25] | x |
| P3 | Copolymer (I) [0.25] | GF-400 [0.25] |
| P4 | Copolymer (I) [0.5] | x |
| P5 | x | GF-400 [0.5] |
| P6 | Copolymer (I) [0.5] | GF-400 [0.5] |
| P7 | Copolymer (I) [1.0] | x |
| P8 | x | GF-400 [1.0] |
| P9 | Copolymer (I) [0.25] | Copolymer (II) [0.25] |
| P10 | x | Copolymer (II) [0.5] |
| P11 | Copolymer (1) [0.25] | Copolymer (III) [0.25] |
| P12 | x | Copolymer (III) [0.5] |

<Preparation of Charge Transport Layer Forming Coating Liquid Q1>

To a mixed solvent of tetrahydrofuran and anisole (88.5/11.5), 89.6 parts of a polycarbonate resin represented by the following structural formula (D) (viscosity average molecular weight 50,000), 10.4 parts of a siloxane-modified polycarbonate resin represented by the following structural formula (E), 60 parts of a charge transport substance represented by the following structural formula (F), 2 parts of dibutylhydroxytoluene, and 0.05 part of silicone oil (KF96-10cs manufactured by Shin-Etsu Chemical Co., Ltd.) were dissolved and mixed with stirring, to obtain a charge transport layer forming coating liquid Q0 having a solid content concentration of 21.24%.

STRUCTURAL FORMULA (D)

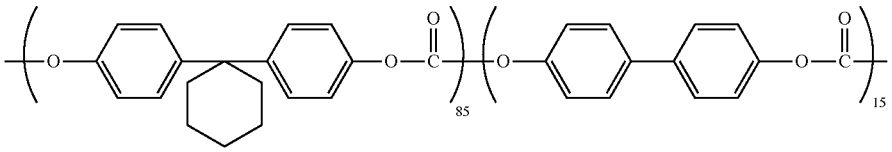

STRUCTURAL FORMULA (E)

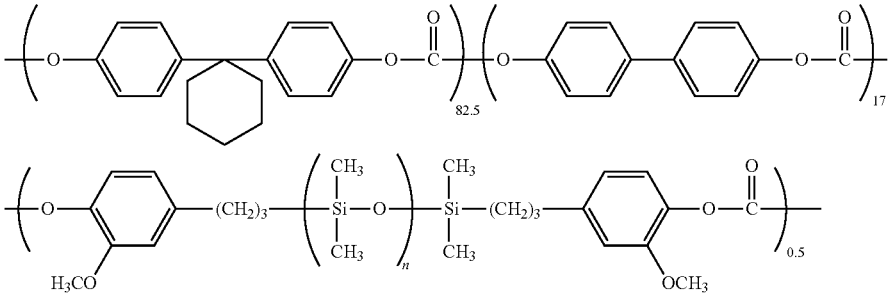

STRUCTURAL FORMULA (F)

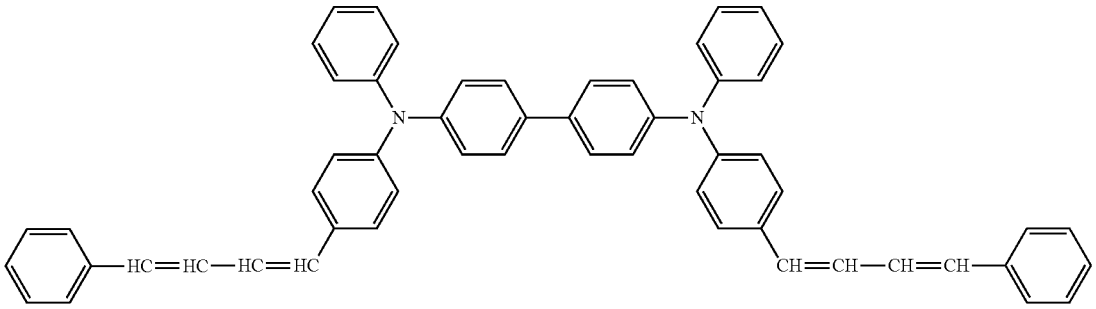

972.5 g of the charge transport layer forming coating liquid Q0 and 127.5 g of the tetrafluoroethylene resin particle dispersion slurry P1 were dispersed and mixed using a homomixer at 7000 rpm/1 hour under ice-cooling to prepare a charge transport layer forming coating liquid Q1.

<Preparation of Charge Transport Layer Forming Coating Liquid Q2>

A charge transport layer forming coating liquid Q2 was prepared in exactly the same manner as the charge transport layer forming coating liquid Q1 except that the tetrafluoroethylene resin particle dispersion slurry P1 was changed to the tetrafluoroethylene resin particle dispersion slurry P2.

<Preparation of Charge Transport Layer Forming Coating Liquid Q3>

A charge transport layer forming coating liquid Q3 was prepared in exactly the same manner as the charge transport layer forming coating liquid Q1 except that the tetrafluoroethylene resin particle dispersion slurry P1 was changed to the tetrafluoroethylene resin particle dispersion slurry P3.

<Preparation of Charge Transport Layer Forming Coating Liquid Q4>

A charge transport layer forming coating liquid Q4 was prepared in exactly the same manner as the charge transport layer forming coating liquid Q1 except that the tetrafluoroethylene resin particle dispersion slurry P1 was changed to the tetrafluoroethylene resin particle dispersion slurry P4.

<Preparation of Charge Transport Layer Forming Coating Liquid Q5>

A charge transport layer forming coating liquid Q5 was prepared in exactly the same manner as the charge transport layer forming coating liquid Q1 except that the tetrafluoroethylene resin particle dispersion slurry P1 was changed to the tetrafluoroethylene resin particle dispersion slurry P5.

<Preparation of Charge Transport Layer Forming Coating Liquid Q6>

A charge transport layer forming coating liquid Q6 was prepared in exactly the same manner as the charge transport layer forming coating liquid Q1 except that the tetrafluoroethylene resin particle dispersion slurry P1 was changed to the tetrafluoroethylene resin particle dispersion slurry P6.

<Preparation of Charge Transport Layer Forming Coating Liquid Q7>

A charge transport layer forming coating liquid Q7 was prepared in exactly the same manner as the charge transport layer forming coating liquid Q1 except that the tetrafluoroethylene resin particle dispersion slurry P1 was changed to the tetrafluoroethylene resin particle dispersion slurry P7.

<Preparation of Charge Transport Layer Forming Coating Liquid Q8>

A charge transport layer forming coating liquid Q8 was prepared in exactly the same manner as the charge transport layer forming coating liquid Q1 except that the tetrafluoroethylene resin particle dispersion slurry P1 was changed to the tetrafluoroethylene resin particle dispersion slurry P8.

<Preparation of Charge Transport Layer Forming Coating Liquid Q9>

A charge transport layer forming coating liquid Q9 was prepared in exactly the same manner as the charge transport layer forming coating liquid Q1 except that the tetrafluoroethylene resin particle dispersion slurry P1 was changed to the tetrafluoroethylene resin particle dispersion slurry P9.

<Preparation of Charge Transport Layer Forming Coating Liquid Q10>

A charge transport layer forming coating liquid Q10 was prepared in exactly the same manner as the charge transport layer forming coating liquid Q1 except that the tetrafluoroethylene resin particle dispersion slurry P1 was changed to the tetrafluoroethylene resin particle dispersion slurry P10.

<Preparation of Charge Transport Layer Forming Coating Liquid Q11>

A charge transport layer forming coating liquid Q11 was prepared in exactly the same manner as the charge transport layer forming coating liquid Q1 except that the tetrafluoroethylene resin particle dispersion slurry P1 was changed to the tetrafluoroethylene resin particle dispersion slurry P11.

<Preparation of Charge Transport Layer Forming Coating Liquid Q12>

A charge transport layer forming coating liquid Q12 was prepared in exactly the same manner as the charge transport layer forming coating liquid Q1 except that the tetrafluoroethylene resin particle dispersion slurry P1 was changed to the tetrafluoroethylene resin particle dispersion slurry P12.

<Evaluation on Filterability>

A PTFE (polytetrafluoroethylenc) membrane filter having a pore diameter of 10 μm (Mytex LC manufactured by Advantech Co. Ltd) and a glass filter paper GF series of grade GF/D manufactured by GE Healthcare Japan were set in a cylinder having an inner diameter of 35 mm, and 270 g of the charge transport layer forming coating liquids Q1 to Q12 were filled thereto. The amount of the coating liquid that could be filtered at a nitrogen pressure of 0.18 MPa was measured. The measurement results were evaluated based on the following criteria. The results are shown in Table 2.

The filterability was evaluated as D when the amount of filtration was less than 80 g, as C when the amount of filtration was 80 g or more and less than 160 g, as B when the amount of filtration was 160 g or more and less than 240 g, and as A when the amount of filtration was 240 g or more. The filtration was ended when the amount of filtration was 250 g.

When the filterability of the charge transport layer forming coating liquid is good, it is not necessary to replace the filter paper many times during the filtration, and the productivity of the coating liquid is improved. In a case where the filtration is omitted, it is difficult to remove the contaminant.

<Preparation of Undercoat Layer Forming Coating Liquid R1>

A surface treatment was performed by stirring 100 parts of rutile-type titanium oxide having an average primary particle diameter of 40 nm (product name TTO55N manufactured by Ishihara Sangyo Kaisha, Ltd.) and 3 parts of methyldimethoxysilane by a shearing force using a supermixer until the temperature in the mixer reached 160° C. Next, this surface-treated titanium oxide, methanol, and 1-propanol were dispersed in a ball mill with alumina beads having a diameter of 5 mm to obtain a titanium oxide dispersion liquid.

Pellets of a copolyamide, in which the composition molar ratio of ε-caprolactam/bis(4-amino-3-methylcyclohexyl) methane/hexamethylenediamine/decamethylenedicarboxylic acid/octadecamethylenedicarboxylic acid was 60%/15%/5%/15%/5%, were stirred and mixed in a mixed solvent of methanol/1-propanol/toluene while being heated to obtain a copolymerized polyamide resin solution.

The above titanium oxide dispersion liquid and the copolyamide resin solution were stirred and mixed, and then an ultrasonic dispersion treatment was performed for one hour using an ultrasonic transmitter with a frequency of 25 kHz and an output of 1200 W. Further, the mixed solution was filtered through the PTFE membrane filter made having a pore diameter of 5 μm (Mytex LC manufactured by Advantech Co. Ltd). A undercoat layer forming coating liquid R1 containing titanium oxide/copolyamide in a mass ratio of 3/1, and a mixed solvent of methanol/1-propanol/toluene in a mass ratio of 7/1/2, and having a solid content concentration of 18.0 mass % was obtained.

<Preparation of Charge Generation Layer Forming Coating Liquid S1>

5.5 parts of oxytitanium phthalocyanine showing a characteristic peak at a Bragg angle (2θ±0.2°) of 27.3° in a powder X-ray spectrum pattern obtained with CuKα rays, 4.5 parts of oxytitanium phthalocyanine showing a characteristic peak at Bragg angle (2θ+0.2°) of 26.2° in a powder X-ray spectrum pattern obtained with CuKα rays, 5 parts of a polyvinyl acetal resin (trade name DK31 manufactured by Denki Kagaku Kogyo K.K.) and 500 parts of 1,2-dimethoxyethane were mixed, pulverized by a sand grind mill, and dispersed to obtain a charge generation layer forming coating liquid S1.

Comparative Example 1

The undercoat layer forming coating liquid R1 was dip-coated onto an aluminum cylinder having a mirror-finished surface and having a diameter of 30 mm and a length of 248 mm, and an undercoat layer was provided to have a film thickness of 1.5 μm after drying. The charge generation layer forming coating liquid S1 was dip-coated onto the undercoat layer, and a charge generation layer was provided to have a film thickness of 0.3 μm after drying. The charge transport layer forming coating liquid Q1 was dip-coated onto the charge generation layer, and a photoreceptor D1 was produced to have a film thickness of 36.0 μm after drying.

Comparative Example 2

A photoreceptor D2 was prepared in exactly the same manner as the photoreceptor D1, except that the charge transport layer forming coating liquid Q1 was changed to the charge transport layer forming coating liquid Q2.

Example 1

A photoreceptor D3 was prepared in exactly the same manner as the photoreceptor D1, except that the charge transport layer forming coating liquid Q1 was changed to the charge transport layer forming coating liquid Q3.

Comparative Example 3

A photoreceptor D4 was prepared in exactly the same manner as the photoreceptor D1, except that the charge transport layer forming coating liquid Q1 was changed to the charge transport layer forming coating liquid Q4.

Comparative Example 4

A photoreceptor D5 was prepared in exactly the same manner as the photoreceptor D1, except that the charge transport layer forming coating liquid Q1 was changed to the charge transport layer forming coating liquid Q5.

Example 2

A photoreceptor D6 was prepared in exactly the same manner as the photoreceptor D1, except that the charge transport layer forming coating liquid Q1 was changed to the charge transport layer forming coating liquid Q6.

Comparative Example 5

A photoreceptor D7 was prepared in exactly the same manner as the photoreceptor D1, except that the charge transport layer forming coating liquid Q1 was changed to the charge transport layer forming coating liquid Q7.

Comparative Example 6

A photoreceptor D8 was prepared in exactly the same manner as the photoreceptor D1, except that the charge transport layer forming coating liquid Q1 was changed to the charge transport layer forming coating liquid Q8.

Example 3

A photoreceptor D9 was prepared in exactly the same manner as the photoreceptor D1, except that the charge transport layer forming coating liquid Q1 was changed to the charge transport layer forming coating liquid Q9.

Comparative Example 7

A photoreceptor D10 was prepared in exactly the same manner as the photoreceptor D1, except that the charge transport layer forming coating liquid Q1 was changed to the charge transport layer forming coating liquid Q10.

Example 4

A photoreceptor D11 was prepared in exactly the same manner as the photoreceptor D1, except that the charge transport layer forming coating liquid Q1 was changed to the charge transport layer forming coating liquid Q11.

Comparative Example 8

A photoreceptor D12 was prepared in exactly the same manner as the photoreceptor D1, except that the charge transport layer forming coating liquid Q1 was changed to the charge transport layer forming coating liquid Q12.

<Evaluation on Dispersion State>

The dispersion state (particle dispersibility) of the tetrafluoroethylene resin particles in the charge transport layer (outermost surface layer) in the photoreceptors D1 to D12 was evaluated based on the following criteria. The results are shown in Table 2.

D: As a result of visually observing the surface of the photoreceptor, the particle dispersibility was clearly poor, and therefore, the surface was not observed with a scanning electron microscope.

C: As a result of visually observing the surface of the photoreceptor, the particle dispersibility was at a satisfactory level, but as a result of being observed by a scanning electron microscope, the particle dispersibility in the charge transport layer was poor.

B: As a result of visually observing the surface of the photoreceptor, the particle dispersibility was at a satisfactory level, but as a result of being observed by a scanning electron microscope, the particle dispersibility in the charge transport layer was somewhat poor.

A: As a result of visually observing the surface of the photoreceptor, the particle dispersibility was at a satisfactory level, and as a result of being observed by a scanning electron microscope, the particle dispersibility in the charge transport layer was good.

TABLE 2

| | Photoreceptor | Polymer A [part by mass] | Polymer B [part by mass] | Filterability [filtration amount g] | Particle dispersibility |
|---|---|---|---|---|---|
| Comparative Example 1 | D1 | x | x | D 30 | D |
| Comparative Example 2 | D2 | Copolymer (I) [0.25] | x | D 23 | C |
| Example 1 | D3 | Copolymer (I) [0.25] | GF-400 [0.25] | A 250 | A |
| Comparative Example 3 | D4 | Copolymer (I) [0.5] | x | D 24 | A |
| Comparative Example 4 | D5 | x | GF-400 [0.5] | A 250 | C |
| Example 2 | D6 | Copolymer (I) [0.5] | GF-400 [0.5] | A 250 | A |
| Comparative Example 5 | D7 | Copolymer (I) [1.0] | x | D 60 | A |
| Comparative Example 6 | D8 | x | GF-400 [1.0] | A 250 | B |
| Example 3 | D9 | Copolymer (I) [0.25] | Copolymer (II) [0.25] | B 173 | A |
| Comparative Example 7 | D10 | x | Copolymer (II) [0.5] | A 250 | B |
| Example 4 | D11 | Copolymer (I) [0.25] | Copolymer (III) [0.25] | B 160 | A |
| Comparative Example 8 | D12 | x | Copolymer (III) [0.5] | A 250 | B |

In Examples 1 to 4 containing both the polymer A and the polymer B, the performance was simultaneously improved in both the filterability of the charge transport layer forming coating liquid and the dispersion state (particle dispersibility) of the tetrafluoroethylene resin particles in the charge transport layer (outermost surface layer).

On the other hand, in a case where only the polymer A was added (Comparative Example 2, Comparative Example 3, and Comparative Example 5), the filterability of the charge transport layer forming coating liquid was poorer than that in Examples 1 to 4. That is, this result indicates that, in Comparative Example 2, Comparative Example 3, and Comparative Example 5, the dispersibility of the tetrafluoroethylene resin particles in the charge transport layer forming coating liquid was poor. Even when the amount of the polymer A was increased, the filterability of the charge transport layer forming coating liquid was not improved (comparison between Comparative Example 2 and Comparative Example 5).

In addition, in a case where only the polymer B was added (Comparative Example 4, Comparative Example 6, Comparative Example 7, and Comparative Example 8), the dispersion state (particle dispersibility) of the tetrafluoroethylene resin particles in the charge transport layer (outermost surface layer) was poorer than that in Examples 1 to 4.

Only when both the polymer A and the polymer B were contained, both the filterability of the charge transport layer forming coating liquid and the dispersibility of the filler in the outermost surface layer of the photoreceptor were improved.

Although the present invention has been described in detail with reference to the specific embodiment, it will be apparent to those skilled in the art that various changes and modifications can be made without departing from the spirit and scope of the present invention. The present application is based on a Japanese Patent Application (Japanese Patent Application No. 2017-194629) filed on Oct. 4, 2017, contents of which are incorporated herein by reference.

INDUSTRIAL APPLICABILITY

The present invention can be implemented in any field requiring an electrophotographic photoreceptor, and is suitably used for, for example, a copying machine, a printer, or a printing machine.

REFERENCES SIGNS LIST

1 Photoreceptor (elcctrophotographic photoreceptor)
2 Charging device (charging roller; charging unit)
3 Exposure device (exposure unit)
4 Developing device (developing unit)
5 Transfer device
6 Cleaning device
7 Fixing device
41 Developing tank
42 Agitator
43 Supply roller
44 Developing roller
45 Regulating member
71 Upper fixing member (fixing roller)
72 Lower fixing member (fixing roller)
73 Heating device
T Toner
P Recording paper (paper and medium)

The invention claimed is:

1. An electrophotographic photoreceptor comprising: a conductive support; and a photosensitive layer on the conductive support, wherein the photosensitive layer comprises a polymer A containing a repeating structural unit represented by Formula (1) and a repeating structural unit represented by Formula (2), and a polymer B not containing the repeating structural unit of Formula (1) but containing the repeating structural unit of Formula (2):

FORMULA (1)

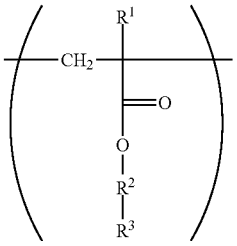

wherein $R^1$ represents a hydrogen atom or a methyl group; $R^2$ represents a single bond, a divalent hydrocarbon group which may have an ether moiety, or a divalent polyether group which may have a substituent; and $R^3$ represents a polycarbonate residue or a polyester residue;

FORMULA (2)

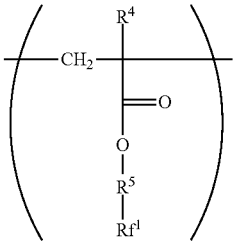

wherein, $R^4$ represents a hydrogen atom or a methyl group; $R^5$ represents a single bond, or a divalent hydrocarbon group which may have an ether moiety; and $Rf^1$ represents a linear perfluoroalkyl group having 2 to 6 carbon atoms, a branched perfluoroalkyl group having 2 to 6 carbon atoms, an alicyclic perfluoroalkyl group having 2 to 6 carbon atoms, or a group of Formula (3); and

FORMULA (3)

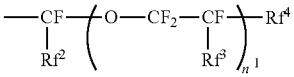

wherein, $Rf^2$ and $Rf^3$ each independently represent a fluorine atom or a trifluoromethyl group;

$Rf^4$ represents a linear perfluoroalkyl group having 1 to 6 carbon atoms or a branched perfluoroalkyl group having 1 to 6 carbon atoms, and $n^1$ represents an integer of 1 to 3.

2. The electrophotographic photoreceptor according to claim 1, wherein the polymer B further comprises a repeating structural unit of Formula (10):

FORMULA (10)

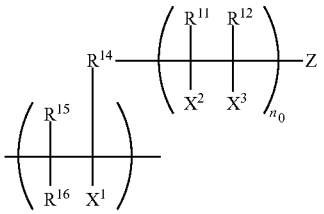

wherein $X^1$, $X^2$ and $X^3$ each independently represent a hydrogen atom, a hydrocarbon group which may have a substituent, or a group represented by Formula (11); $R^{11}$, $R^{12}$, $R^{15}$ and $R^{16}$ each independently represent a hydrogen atom, or a hydrocarbon group which may have a substituent; $R^{14}$ represents a hydrocarbon group which may have a substituent or a group represented by Formula (13); Z represents a hydrogen atom or a group derived from a radical polymerization initiator, and $n_0$ represents an integer of 1 or more;

FORMULA (11)

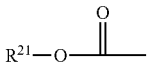

wherein, $R^{21}$ represents a hydrogen atom, a hydrocarbon group which may have a substituent, or a heterocyclic group which may have a substituent; and

FORMULA (13)

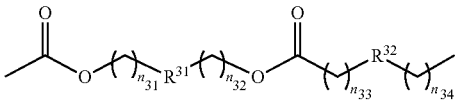

wherein, $n_{31}$, $n_{32}$, $n_{33}$, and $n_{34}$, each independently represent 0 or an integer of 1 or more; $R^{31}$ represents an alkylene group, a halogen-substituted alkylene group, —($C_mH_{2m-1}$(OH))— or a single bond; and $R^{32}$ represents an alkylene group, a halogen-substituted alkylene group, —S—,—O—, —NH— or a single bond, and m represents an integer of 1 or more.

3. The electrophotographic photoreceptor according to claim 1, wherein the polymer A further comprises a repeating structural unit of Formula (10).

4. The electrophotographic photoreceptor according to claim 1, wherein a content ratio of the polymer A to the polymer B in the photosensitive layer is 4:1 to 1:4 in terms of mass ratio.

5. The electrophotographic photoreceptor according to claim 1 wherein the photosensitive layer contains a filler.

6. The electrophotographic photoreceptor according to claim 5, wherein the filler comprises fluorine atom-containing resin particles.

7. The electrophotographic photoreceptor according to claim 5, wherein a total content of the polymer A and the polymer B is 1 mass % or more and 20 mass % or less relative to a mass of the filler.

8. The electrophotographic photoreceptor according to claim 1, wherein the photosensitive layer is an outermost surface layer.

9. The electrophotographic photoreceptor according to claim 1, wherein the photosensitive layer is a lamination type photosensitive layer in which a charge generation layer and a charge transport layer are sequentially laminated from the conductive support side.

10. The electrophotographic photoreceptor according to claim 9, wherein the photosensitive layer contains a filler, and the polymer A, the polymer B, and the filler are all contained in the charge transport layer.

11. An electrophotographic photoreceptor cartridge comprising the electrophotographic photoreceptor according to claim 1.

12. An image forming apparatus comprising the electrophotographic photoreceptor according to claim 1.

* * * * *